US007806202B2

(12) United States Patent
Stewart

(10) Patent No.: US 7,806,202 B2
(45) Date of Patent: Oct. 5, 2010

(54) SYSTEM AND METHOD FOR RESERVOIR CHARACTERIZATION USING UNDERBALANCED DRILLING DATA

(75) Inventor: George Stewart, Edinburgh (GB)

(73) Assignee: Precision Energy Services, Inc., Fort Worth, TX (US)

( * ) Notice: Subject to any disclaimer, the term of this patent is extended or adjusted under 35 U.S.C. 154(b) by 86 days.

(21) Appl. No.: 12/038,715

(22) Filed: Feb. 27, 2008

(65) Prior Publication Data

US 2008/0210470 A1 Sep. 4, 2008

Related U.S. Application Data

(60) Provisional application No. 60/891,760, filed on Feb. 27, 2007.

(51) Int. Cl.
*E21B 21/08* (2006.01)
*E21B 21/16* (2006.01)

(52) U.S. Cl. ..... 175/48; 175/50; 175/65

(58) Field of Classification Search ..... 175/48, 175/50, 65

See application file for complete search history.

(56) References Cited

U.S. PATENT DOCUMENTS 5,303,582 A 4/1994 Miska
6,585,044 B2 7/2003 Rester et al.
6,810,960 B2 11/2004 Pia
7,044,237 B2 5/2006 Leuchtenberg
7,222,022 B2 5/2007 Kneissl et al.
2004/0007131 A1 1/2004 Chitty et al.
2006/0113110 A1 6/2006 Leuchtenberg
2007/0124091 A1* 5/2007 Wee ..... 702/49
2007/0295101 A1* 12/2007 Johansen ..... 73/861.04
2008/0060846 A1* 3/2008 Belcher et al. ..... 175/25

OTHER PUBLICATIONS

Sperry Drilling Service, "New Underbalanced Drilling Solutions Make Real-Time Well Analysis a Reality," obtained from www.Halliburton.com, copyright 2008, 6-pgs.
S. Farshidi, et al., "Permeability Estimation from Inflow Data during Underbalanced Drilling," Petroleum Society Paper 2007-147, 2007, 13-pgs.
Wendy Kneissl, "Reservoir Characterization Whilst Underbalanced Drilling," paper SPE/IADC 67690 presented at SPE/IACD Drilling Conference, copyright 2001, pp. 41-49.
Offshore Engineer, "Compact Multiphase Meters Take Tradition to Task," Oct. 2003, pp. 41-44.
AGAR Corporation, AGAR MPFM 50, 300, 400, & 408 Series Multiphase Flow Meters, dated Dec. 2004, 14-pgs.

(Continued)

*Primary Examiner*—Giovanna C Wright
(74) *Attorney, Agent, or Firm*—Wong, Cabello, Lutsch, Rutherford & Brucculeri, LLP

(57) ABSTRACT

In an underbalanced drilling system and method, a change is induced in flowing bottom hole pressure in a wellbore. Data of the surface flow rate of effluent is then measured in response to the induced change. This measured data is obtained using a multi-phase flow meter before a separator of the underbalanced drilling system. Algorithms in computer software analyze the flowing bottomhole pressure and the measured surface flow rate data and determine both permeability and formation pressure for a portion of the wellbore in real-time during the underbalanced drilling operation. Ultimately, portion of the wellbore is characterized with the determined permeability and formation pressure.

21 Claims, 35 Drawing Sheets

OTHER PUBLICATIONS

International Search Report and Written Opinion for PCT/US08/55176, mailed Aug. 4, 2008, 6-pgs.
Kardolus, C.B. and van Kruijsdijk, C.P.J.W., "Formation Testing While Underbalanced Drilling," SPE 38754, Annual Tech. Conf., San Antonio, Tx, 1997.
Jacob, C. E. and Lohman, S. W., "Nonsteady Flow to a Well of Constant Drawdown in an Extensive Aquifer," Trans AGU (Aug. 1952), 559-569.
Shi, H., Holmes, J.A., Durlovsky, L.J., Aziz, K., Diaz, L.R., Alkaya, B. and Oddie, G., "Drift Flux Modelling of Multphase Flow in Wellbores", SPE 84228, Annual Tech. Conf., Denver, Colorado, Oct. 2003.
Zuber, N. and Finlay, J., Trans. ASME J. Heat Transfer, Series C, 87, 453 (1965).
Wallis, G.B. and Makkenchery, S., "The Hanging Film Phenomenon in Vertical, Annular Two-Phase Flow," Trans ASME, Series I, (1974) 96,297.
Hasan, A.R. and Kabir, C.S., "A Simplified Model for Oil-Water Flow in Vertical and Deviated Wellbores," SPE Prod. & Fac., Feb. 1999, 56-62.
Danesh, A;"PVT and Phase Behaviour of Petroleum Reservoir Fluids", Elsevier, 1998.
Kardolus, C.B., et al., "Formation Testing While Underbalanced Drilling," SPE 38754, copyright 1997.
van Kruijsdijk, Cor, et al., "Testing While Underbalanced Drilling: Horizontal Well Permeability Profiles," SPE 54717, copyright 1999.
Larsen, Leif, et al., "Inflow Predictions and Testing While Underbalanced Drilling," SPE 56684, copyright 1999.

* cited by examiner

TWO DRAWDOWN TEST

AFTER KARDOLUS AND VAN KRUIJSDIJK

ANALYZE BY NONLINEAR REGRESSION

OBJECTIVE: ESTABLISH FORMATION PRESSURE AND BASE PERMEABILITY LEVEL
LIMITATION: RATES IN TWO DRAWDOWN PERIODS MUST BE DETECTABLE

| Well | Start | Flow-Rate |
|---|---|---|
| 1A | $T_0$ | +q |
| 1D | $T_1$ | -q |
| 2A | $T_1$ | +q |
| 2D | $T_2$ | -q |

A: ACTIVE
D: DESUPERPOSITION

SYSTEM AND METHOD FOR RESERVOIR CHARACTERIZATION USING UNDERBALANCED DRILLING DATA

CROSS-REFERENCE TO RELATED APPLICATIONS

This is non-provisional of U.S. Patent Application Ser. No. 60/891,760, filed Feb. 27, 2007 and entitled "System and Method for Reservoir Characterization Using Underbalanced Drilling Data," which is incorporated herein by reference in its entirety and to which priority is claimed.

FIELD OF THE DISCLOSURE

The subject matter of the present disclosure relates to a system and method for characterizing a reservoir using underbalanced drilling data.

BACKGROUND

Conventional tools and overbalanced drilling methods may not be economically viable for drilling some hydrocarbon reserves having a narrow margin between the formation fracture and pore pressures, which would require excessive casing programs and larger, more expensive rigs. Underbalanced drilling, however, offers higher rates of penetration and reduces lost circulation as well as reducing formation damage. In some situations, underbalanced drilling can reduce problems associated with invasion of particulate matter into a reservoir, adverse clay reactions, phase trapping, precipitation and emulsification, and other issues. Underbalanced drilling can also be useful for mature reservoirs that have lower field pressure that makes the reservoir more susceptible to damage caused by traditional overbalanced drilling and completion technologies. Other advantages are also known in the art.

In underbalanced drilling, the pressure in the wellbore is purposefully maintained below the fluid pressure of the formation being drilled. Therefore, underbalanced drilling can use a lower density mud in formations having high pressures. As a more common alternative, inert gas such as nitrogen is injected into the drilling mud for the underbalanced drilling. During operation, a rotating control head at the surface allows the drill string to continue rotating and acts as a seal so produced fluids can be diverted to a separator. Any surface flow-rate measurements if made are typically measured after separator equipment using an orifice plate meter, which presents problems with measurement error and produce discrepancies between the wellhead flow rate and what is actually measured.

Keeping the drilling pressure under the reservoir pressure during underbalanced drilling requires the reservoir pressure to be either deduced or know during the drilling operation. Unfortunately, operators are not capable of knowing the formation pressure during real time, and the operators must estimate the formation pressure based on known pressures of other wells. For new wells in unproduced fields, for example, the pressure is likely to follow a hydrostatic gradient that can be determined from wireline formation tester surveys made in other appraisal wells. In this situation, the formation pressure is known when the first development wells are drilled, and pressure and rate transient analysis can identify a permeability distribution when the pressure is known independently.

When a new well is drilled into a depleted field, however, the major zones are likely to be at different pressures. The underbalanced drilling operation for such new wells is preferably designed using known pressures so that the appropriate degree of underbalance can be maintained during the operation. This pressure information can be obtained from nearby wells in which formation tester measurements have been made using either wireline or drillpipe techniques. For example, a borehole can be drilled in overbalance conditions, and a formation tester can be run in the borehole to obtain pressure information. For the underbalance operation, a sidetrack can then be drilled into the reservoir with minimal formation damage. If the formation pressure is not known accurately enough, then both permeability and pressure distributions need to be determined to characterize the reservoir. Designing an underbalanced drilling system and obtaining and using data from the underbalanced drilling operation to characterize a reservoir present a number of challenges. The subject matter of the present disclosure is directed to overcoming, or at least reducing, effects of at least some of these challenges.

DETAILED DESCRIPTION

If the pressure of a formation being drilled is not known accurately enough, then both permeability and pressure distributions need to be determined to characterize a reservoir. According to the present disclosure, variable rate well testing is used to interpret production associated with the drawdown maintained throughout an underbalanced drilling (IBD) operation. This variable rate well testing then determines both the permeability and the pressure distributions to characterize the reservoir being drilled in real-time during the underbalanced drilling operation. Using a two-rate test, the techniques of the present disclosure identify both the permeability and pressure distributions by achieving enough rate variation to determine the distributions sufficiently. In classical well testing, only average permeability and pressure of the whole formation are usually identified. In the UBD operation, by contrast, it is possible to identify a permeability distribution in which high permeability layers or other similar objects like fractures can be detected.

1A. Underbalanced Drilling System

Figure 1A:
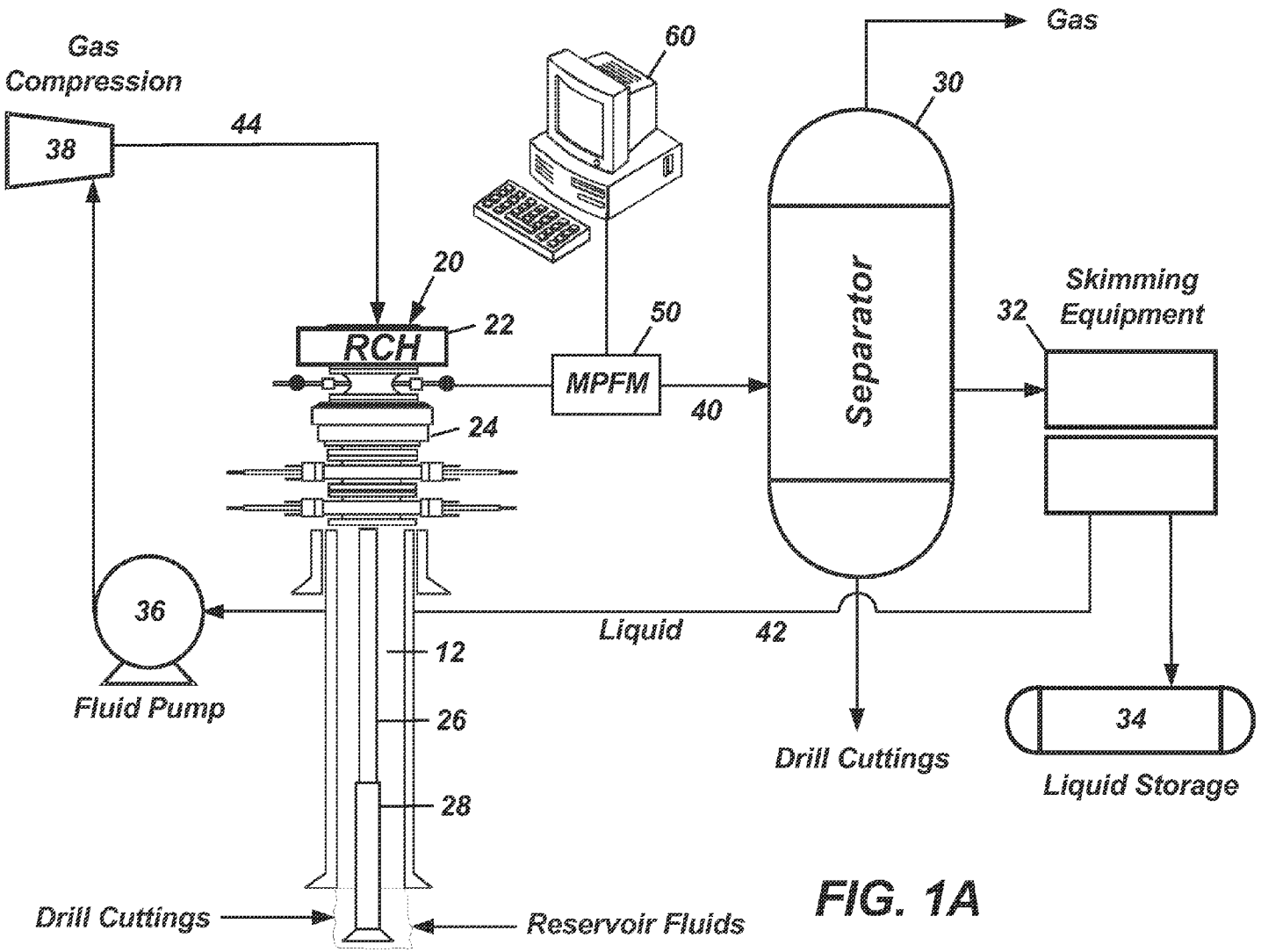
FIG. 1A illustrates an underbalanced drilling system according to certain teachings of the present disclosure.

An underbalanced drilling system 10 according to certain teachings of the present disclosure is illustrated in FIG. 1A. The system 10 includes wellhead equipment 20 (e.g., a rotating control head (RCH) or similar device 22 and a Blow-out preventer (BOP) 24), drill string 26, drill bit 28, separator equipment 30, skimming equipment 32, liquid storage 34, fluid pump equipment 36, and gas compression equipment 38.

In addition to the components discussed above, the system 10 includes a multiphase flow meter 50 positioned along the transfer line 40 from the wellhead 20 before the separator equipment 30. This position is preferred to minimize error in measuring the flow rate encountered in the typical arrangement of the prior art and to avoid discrepancy between the wellhead flow rate and what is actually measured. In addition to the flowmeter 50, a data acquisition and analysis system 60 coupled to the multiphase flow meter 50 analyzes data according to techniques disclosed herein. This data system 60 can be part of a control system (not shown) for the underbalanced drilling system 10 and can include computer systems, software, databases, sensors, and other components for data acquisition, analysis, and control.

General operation of the underbalanced drilling system 10 is well known in the art and is only briefly described here. In general, drilling fluid injected through the drill string 26 exits through the drill bit 28 at the bottom hole and returns up the annulus of the well 12. The BOP 24 remains open during the drilling, and the returned drilling fluid (that includes reservoir fluid, drill cuttings, injected gas, hydrocarbon gas from the formation, etc.) is diverted to the separator equipment 30 via a transfer line 40. The separator equipment 30 separates out gas and drill cuttings and feeds drilling fluid to skimming equipment 32 that is connected to liquid storage 34. Eventually, liquid drilling fluid from the skimming equipment 34 is fed via line 42 by fluid pump equipment 36 to gas compression equipment 38. Gas is injected, and the drilling fluid is re-injected to the drill string 26 via line 44 so that the process repeats itself.

Figure 1B:
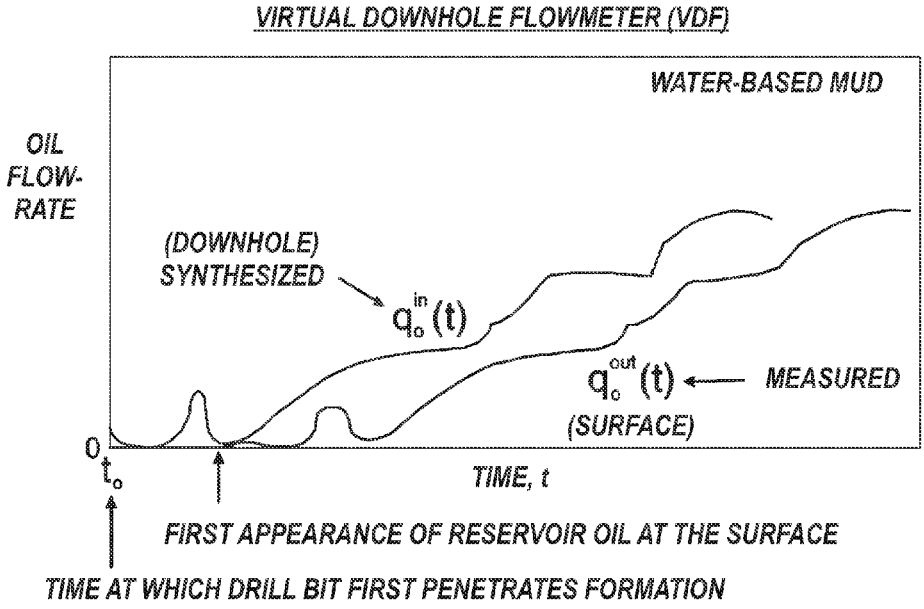
FIG. 1B is a graph depicting a virtual downhole flowmeter (VDF) used to describe the inlet flow from the formation, which is reconstructed from measurement of surface oil flow emerging from the facilities.

In the system 10, the mud system for the drilling fluid is water-based and is designated "liquid." Gas, usually nitrogen, is injected into the circulating mud to lighten the density so the desired underbalance can be achieved. As shown in FIG. 1D, the injected gas is normally added to the injected fluid (mud), and the mixture enters the wellhead 20 and emerges at the bit 28. However, in some cases, the gas is injected separately, as in a gas-lifted system shown in FIG. 1E referred to as a parasitic string.

1B. Underbalanced Drilling Process

Figure 2:
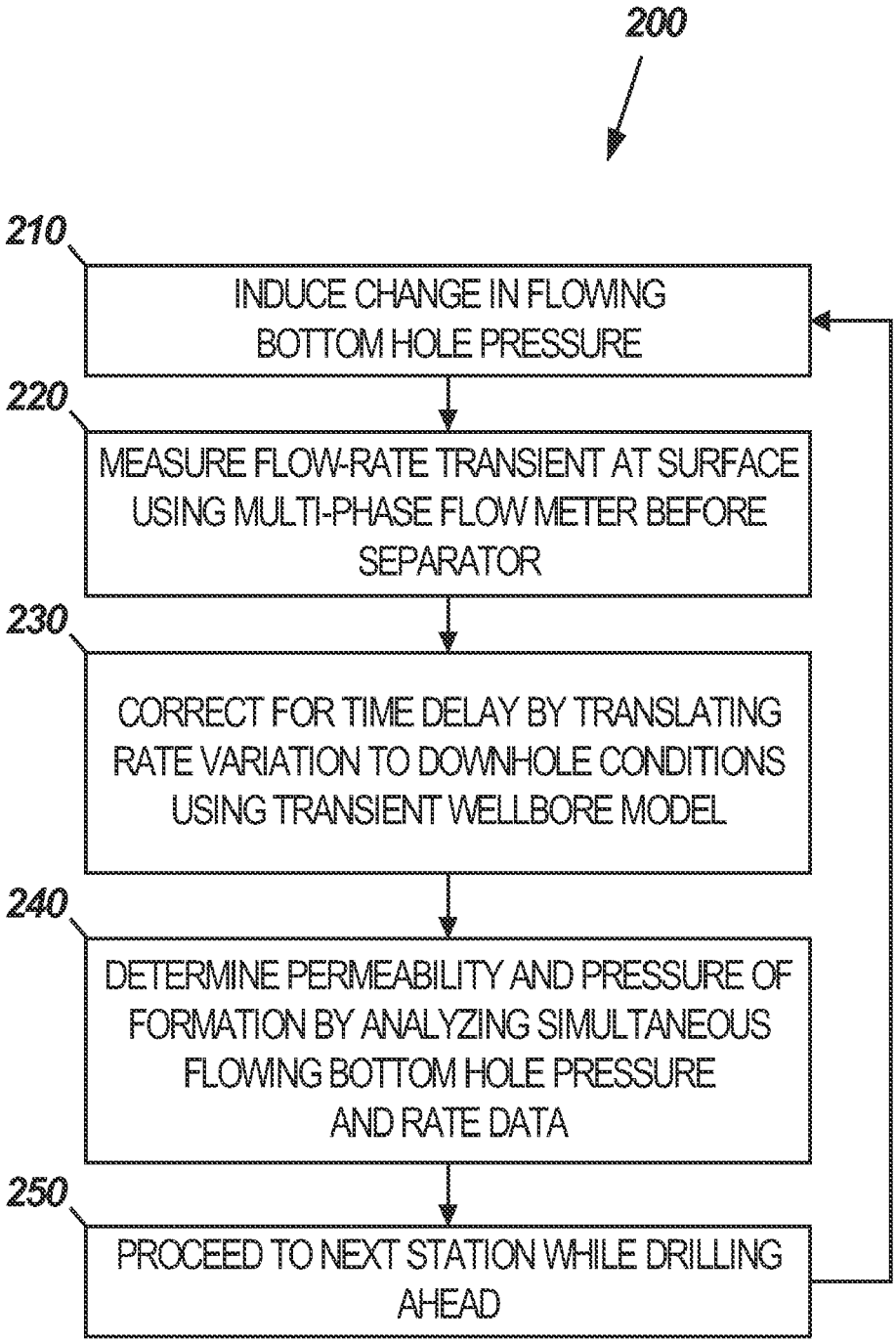
FIG. 2 illustrates an underbalanced drilling process in flowchart form.

In FIG. 2, an underbalanced drilling process 200 for the system 10 of FIG. 1A is illustrated in flowchart form. This process 200 can be performed in real-time during the underbalanced drilling operation or can be performed using logged data. Preferably, however, the data acquisition and analysis system 60 is located at the drilling operation and is used to analyze data in real-time. In this way, operators can obtain real-time information of the formation pressure during the underbalanced drilling operation that can be used to conduct the operation. In addition, the information about pressure and permeability can be used to characterize the reservoir as it is being drilled.

Initially in the process 200, a change is induced in the flowing bottom hole pressure (FBHP) of the system 10 during the underbalanced drilling operation (Block 210). The conventional operation of connecting a new drill section of pipe (referred to as a stand or station) can induce this change in the FBHP. For example, circulation is stopped each time a new stand is connect a stand so that there is a pressure disturbance. In some situations, this convention operation can induce enough change in the FBHP for the present process. If not, then the change can be induced by other techniques, such as changing the flow rate of injected gas (nitrogen) into the system 10, operating a choke, etc.

Throughout the operation, the flow-rate transient is measured at the surface using the multiphase flow meter 50 positioned on the transfer line 40 between the wellhead 20 and the separation equipment 30 (Block 220). The measured data, therefore, detects changes in flow rate before, during, and after the induced change in the FBHP. As noted previously, this multiphase flow meter 50 preferably has an accuracy of at least 95% or greater so that rate data of substantially high quality is acquired.

It may preferred to improve accuracy by correcting the measured data for time delay so that the rate data measured at the surface by the flow meter 50 is correlated to conditions downhole at the drill bit 28. Therefore, a transient wellbore model can be used to translate the variations in the flow rate measured at the surface to the downhole conditions (Block 230). The software product OLGA and its associated algorithms discussed later can be used to make these calculations.

Next in the process 200, the permeability and formation pressure for the current section of the formation being drilled is determined by analyzing the simultaneously measured FBHP and rate data (Block 240). To do this, a transient formation model discussed later in the present disclosure is used. This transient formation model can be incorporated into computer software to perform the analysis with the data acquisition and analysis system 60 in real-time or from logged data. For example, in one embodiment, the transient formation model of the present disclosure can be incorporated into the PanSystem software discussed below. Finally, the process 200 proceeds to the next station while drilling ahead (Block 250) and repeats as the drilling operation continues through the formation.

2. Transient Well Model

Given the description of the underbalanced drilling system 10 and process 200 above, discussion now turns to the analytical model used to determine both permeability and pressure distributions to characterize a reservoir in real-time. In the process 200 of FIG. 2, surface measurements and computer calculations are used to produce a virtual downhole flow meter that provides sufficiently accurate in-situ rate of flow entering the well from the formation downhole so that the permeability and formation pressure can be determined in real-time. FIG. 1B schematically depicts a virtual downhole flowmeter (VDF) used to describe the inlet flow from the formation, where the inlet flow is reconstructed from the measurement of the surface oil flow emerging from the facilities using the flowmeter (50; FIG. 1A). The simultaneous measured downhole pressure response, $p_{wf}(t)$, and synthesised flow response, $q_O^{in}(t)$, are analysed as a variable rate well test with a progressively penetrating well. How this applies to both vertical and horizontal wells, based on superposition, is presented later in the present disclosure.

Figure 1C:
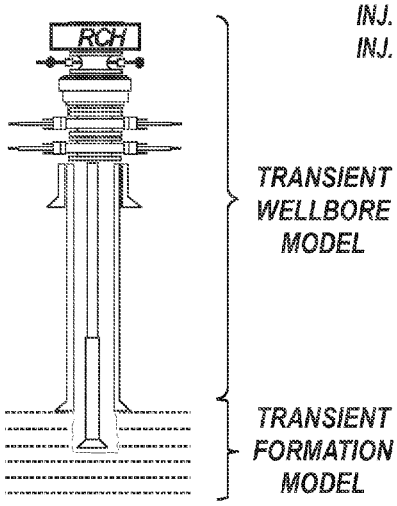
FIG. 1C illustrates independent models for a two-part system of the present disclosure.
Figures 1D, 1E:
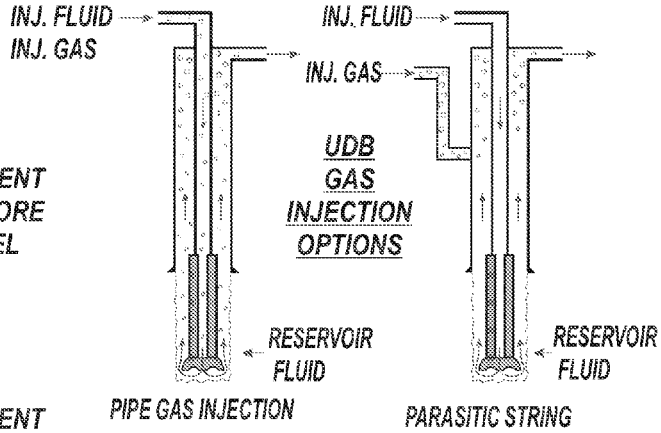
FIGS. 1D-1E illustrate gas injection arrangements for the disclosed underbalanced drilling system.

To achieve the virtual downhole flowmeter, independent models as illustrated FIG. 1C are preferably used for the two parts of the system. As shown, a transient wellbore model and a formation model are used. The transient wellbore model is used to synthesize the downhole flow-rate schedule from the formation into the wellbore, denoted $q_O^{in}(t)$ (i.e., inlet to the well). As noted above, the process 200 uses the transient wellbore model to translate variations in the flow rate measured at the surface to the downhole conditions. The transient wellbore model links the inputs and outputs of the system 10 allowing for any accumulation that takes place. The unsteady-state mass conservation equations for the individual components of the system 10 form the basis of the transient wellbore model. In the context of underbalance drilling, a black oil PVT formulation is usually adequate and should account for hydrocarbon gas (G), nitrogen (N), oil (O), water (W), and solid (S) and associated phases.

In the system 10 of FIG. 1A, the flow-rates of fluid injected into the well 12 are monitored and are referred to as upstream measurements. The fluids issuing from the well 12 are denoted downstream, and the flow-rates of produced gas and oil are also measured. The produced gas is a mixture of injected nitrogen and associated hydrocarbon gas from the formation. In addition, the wellhead pressure and temperature and the bottomhole pressure and temperature are continuously monitored. From a well testing point of view, the flow-rate of produced oil emanating from the formation is not measured directly. The transient wellbore model links the inputs and outputs of the system 10 allowing for any accumulation that may take place.

3. Lumped Parameter Wellbore Model

Computer programs and algorithms are used to analyze the transient wellbore model of the disclosed system 10. One such program for handling transient two-phase flow is the OLGA® program. OLGA is a simulator for flow of oil, water, and gas in wells, pipelines, and receiving facilities. With OLGA, the model predictions have been calibrated against both flow loop data (from the SINTEF loop in Norway) and field data from oil companies using the software. An interface, called UBITS, can be used to simulate underbalance drilling. In accordance with the present disclosure, OLGA can be used as a virtual downhole flowmeter to determine the downhole flow-rate from the measurements of surface flow-rate and wellhead and bottomhole pressure. Because the inflow model of OLGA (and therefore UBITS) is based on a steady- or semi-steady-state P.I., OLGA is preferably modified to allow for a transient formation model to better accommodate well test situations and the UBD case.

To verify the accuracy of this procedure, runs with a distributed model (i.e., OLGA) can be made. The surface flow measurement itself is susceptible to a degree of error perhaps as much as ±10%. The algorithm to reconstruct the downhole rate may only require an accuracy comparable to that of the rate measurement so that a fair degree of error can be tolerated. The changes in holdup and gas density will not be large, and the downhole rate is expected top closely follow the surface rate that is measured. A change in inlet gas rate and the rapidity with which a holdup redistribution in the wellbore propagates through the system indicate that several runs with OLGA may be necessary to validate a lumped parameter model. In this approach, the pressure profile will be a smooth function, e.g. cubic spline, interpolating between the measured wellhead and bottomhole values.

Figure 3A:
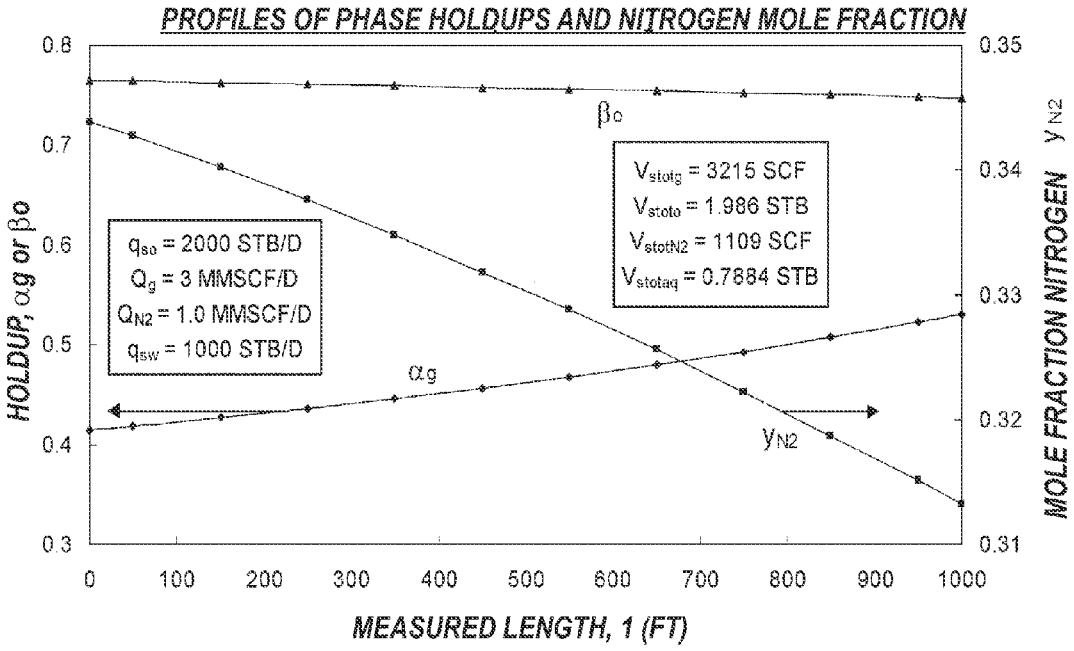
FIG. 3A illustrates profiles of phase holdups and nitrogen mole fraction in an example run showing the effect of having a second liquid phase.
Figure 3B:
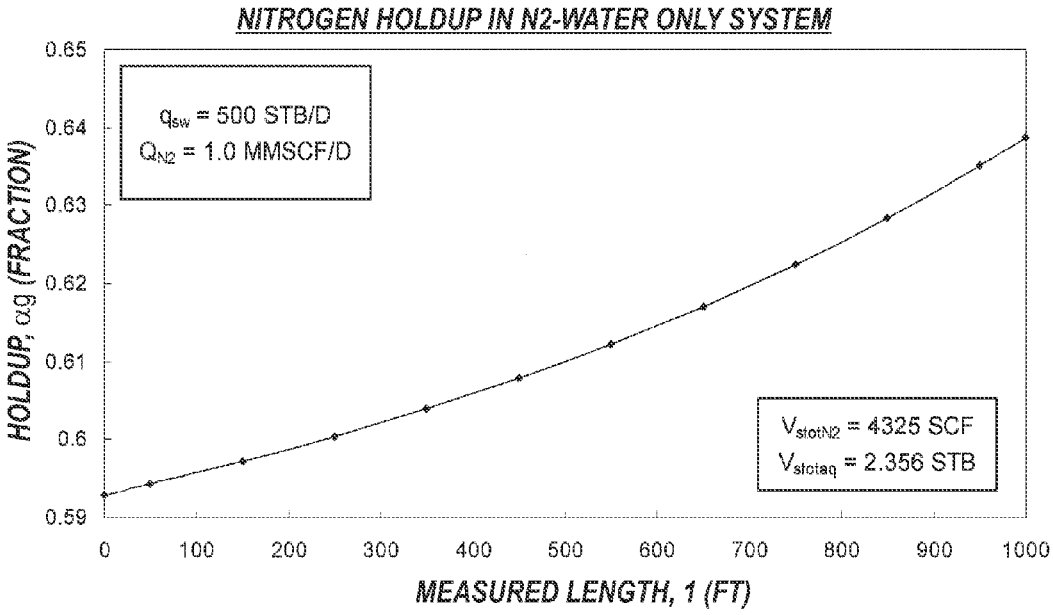
FIG. 3B illustrates profiles of phase holdups and nitrogen mole fraction in an example run showing the effect of having no hydrocarbon present.

In the example run shown in FIG. 3A, the effect of having a second liquid phase (i.e., water) is shown. The holdup profile has both the volume fraction of gas phase and the volume fraction of oil in the combined liquid. In this run, there are four components, and the trapped standard volumes of each one has been computed. Another example case where no hydrocarbon is present (i.e., only nitrogen and water are present) is illustrated in FIG. 3B. As shown, the gas phase (nitrogen) holdup is plotted as a function of measured length.

Figure 3C:
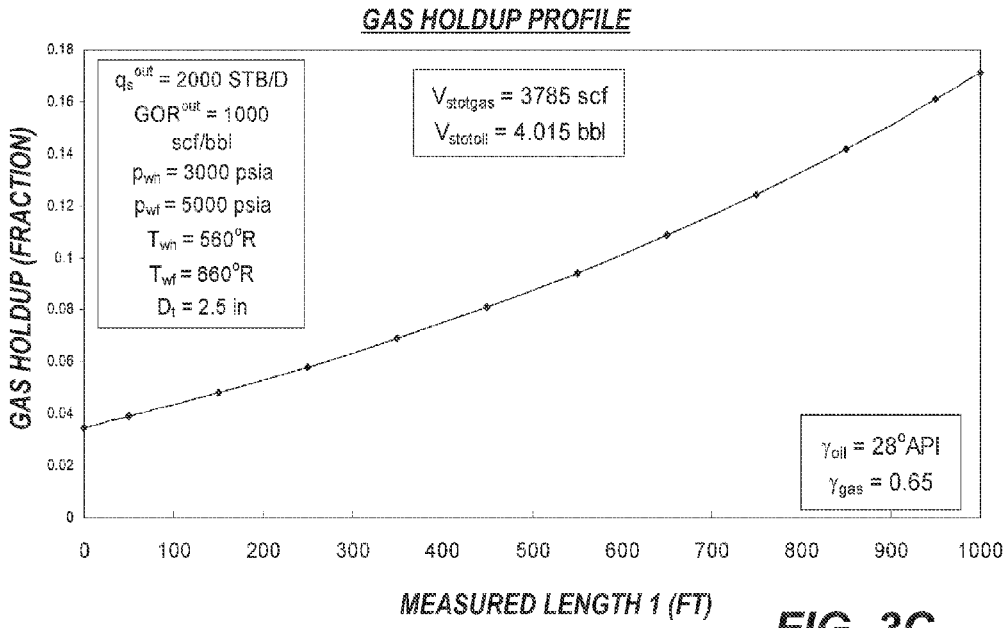
FIG. 3C illustrates a calculated steady-state holdup profile for a well with the parameters given in Table 3.1.
Figure 3D:
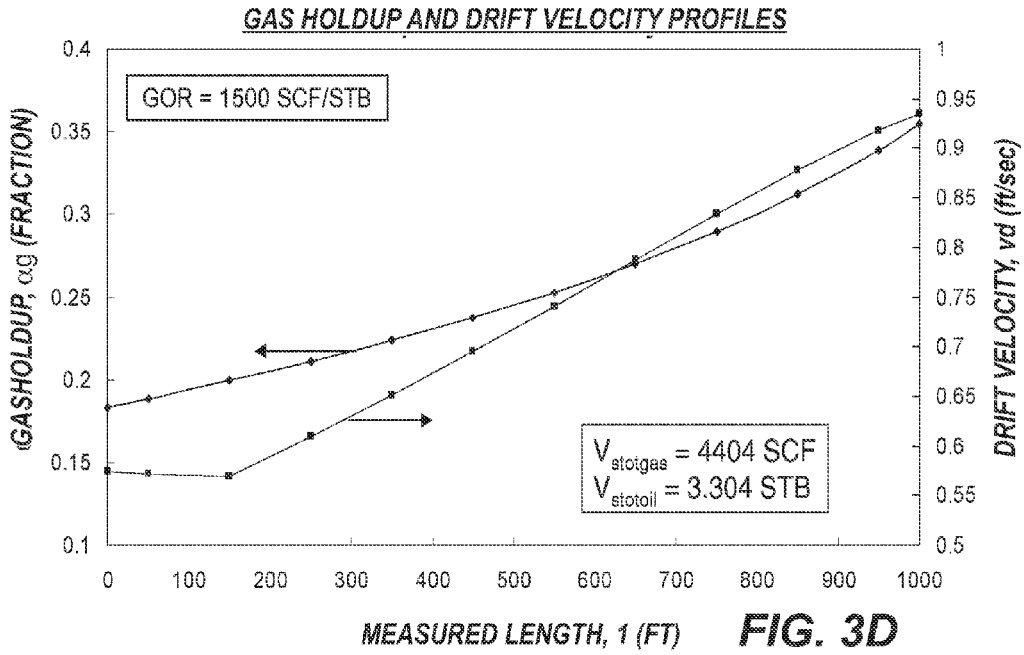
FIG. 3D illustrates gas holdup and drift velocity profiles.

To assess the wellbore storage effects, the two runs at steady-state conditions shown in FIGS. 3C-3D can be used where the producing GOR is 1000 SCF/STB in the first case and 1500 SCF/STB in the second. Thus, if the GOR is changed from one value to another over a certain time period the volume of oil (at stock tank conditions) held up in the 2.5" tubing goes from 4.015 STB to 3.304 STB. Thus, the change in the liquid content is very small. Essentially, the input and output flow-rates of oil are very little different so that:

$$q_{so}^{in}=q_{so}^{out} \tag{3.3}$$

In the present example, the surface flow-rate of stock tank oil is 2000 STB/D, and it should be recognized that the error in flow measurement will be at least 5% i.e. ±100 STB/D. If the change in GOR occurs over a one-hour period, then the time derivative of oil volume is:

$$\frac{dV_{soil}^{tot}}{dt} = (4.015 - 3.304) \times 24 = 17\ STB/D,$$

which is negligible compared to the flow-rate measurement error.

In the prior art, surface flow-rates are typically measured after the separator equipment using an orifice plate meterin an underbalanced system. Therefore, any level change in this separator equipment means there is a discrepancy between wellhead flow-rate and what is actually measured. It is therefore likely that this effect will be much more serious than the wellbore capacity problem. Because the disclosed techniques for determining formation permeability and pressure depends on sensitive rate measurement, the error is preferably minimized.

To minimize error, the system 10 in FIG. 1A uses the multiphase flowmeter 50 in the transfer line 40 from the wellhead 20 to the separator equipment 30. In this arrangement, the flowmeter 50 improves the quality of the data obtained and minimizes error. For example, using the multiphase flow meter 50 in this arrangement can provide higher quality rate data of the effluent communicated from the wellhead 20. In turn, this higher quality rate data can be used in conjunction with the teachings of the present disclosure to characterize whether an encountered layer is of high pressure or high permeability when a change or kick is introduced or observed during the drilling operation.

Various multiphase flow meters 50 can be used. Preferably, the multiphase flow meter 50 is capable of measuring the three-phase effluent from the wellhead 20 with an accuracy of at least 95% or greater (i.e., error of 5% or less). In addition, the multiphase flow meter 50 is preferably in-line, non-intrusive to the flow, and non-radioactive. In one embodiment, for example, the multiphase flow meter 50 in the system 10 is comprised of a relatively short section of integral pipe and utilizes Weatherford's Sonar technology in combination with Red Eye® sensor technology. However, other multiphase flowmeters based on other principles such as Venturi, nuclear, and other systems can be used such as those available from AGAR Corporation, Expro North Sea Limited, Schlumberger or elsewhere.

4. Distributed Parameter Wellbore Model

In the preceding section, the lumped parameter model was used to obtain estimates of the difference between the measured surface rate and the in-situ rate entering the well from the formation. In this section, a full distributed parameter wellbore model (i.e., using OLGA) is used to identify wellbore storage effects and to examine the concept of the virtual downhole flowmeter (See FIG. 1B).

Figure 4A:
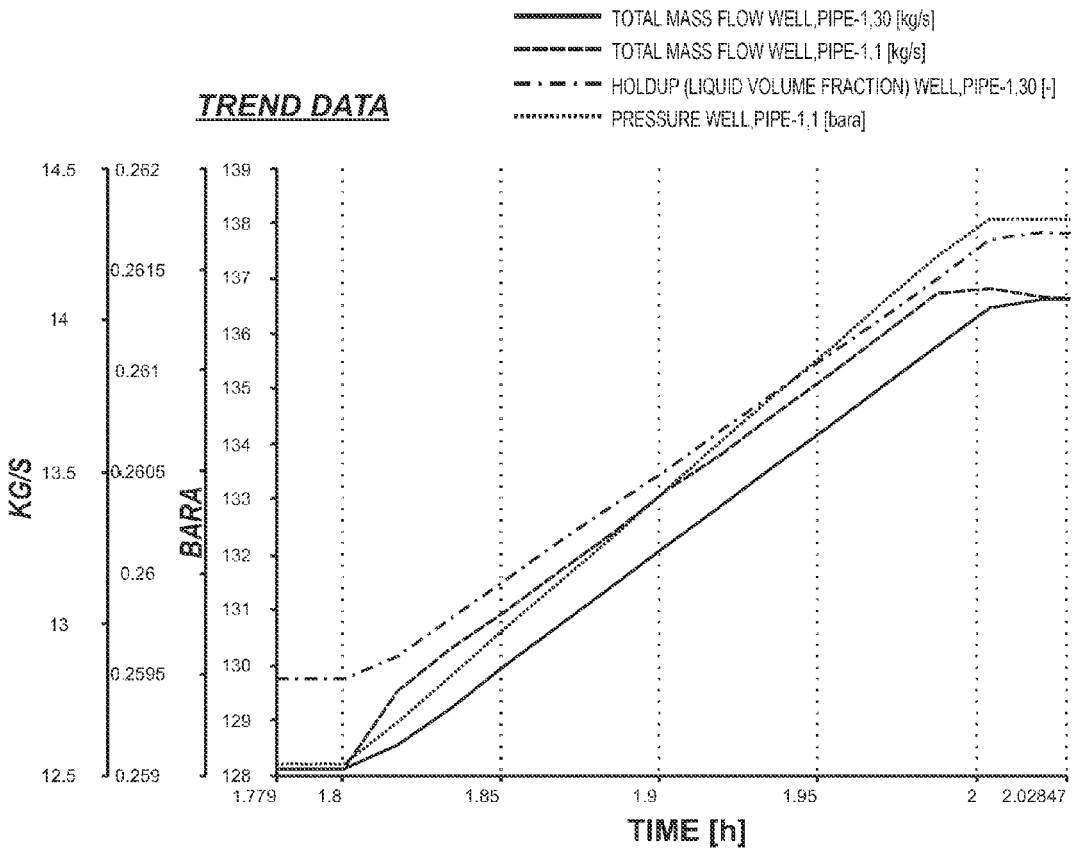
FIG. 4A illustrates an OLGA trend plot of simulation results for a first test case.

Transient simulations in OLGA usually commence from a steady-state situation corresponding to time-independent boundary conditions. In the first test case, a vertical well of length 1500 m and diameter 3" is modeled with a wellhead pressure of 30 bara and a bottomhole flowing pressure of 130 bara. Over the time period 1.8-2.0 hrs, the bottomhole pressure is ramped up to 140 bara. The fluid entering from the reservoir is an oil phase with the properties given in the table below. The OLGA trend plot of the simulation results are shown in FIG. 4A. The wellhead pressure is maintained at 30 bara throughout the transient and the steady-state mass flow-rate before the ramp change in $p_{wf}$ is kg/s.

In OLGA, pressure is a volume variable, and the pressure at the mid-point of the first segment is plotted in FIG. 4A. This changes from 128.3 bara to 138.3 bara over the 0.2 hr ramp period. The mass flow at the inlet (Pipe-1,1) and the mass flow at the outlet (Pipe-1,30) are different during the transient period with the inlet mass flow being greater than that at the exit due to the decreasing gas holdup in the well. In the plot of FIG. 4A, the liquid (oil) holdup is seen to increase (i.e., there is a "negative gas drive" process due to the compression of the gas phase as the pressure rises). At the steady-state before the ramp in inlet pressure, the two mass flows are identical at 12.52 kg/s. The final steady-state at the new inlet pressure of 140 bara is 14.07 kg/sec. During the ramp period, the inlet flow is approximately 1.4% higher (0.18 kg/s) than the exit flow, and the difference is probably less than the resolution of the rate measurement. The liquid holdup in the exit segment increases from 0.2595 to 0.2617. Since this region is essentially at the exit pressure of 30-bara, this is a slip related decrease in gas holdup (i.e., the higher rate means less importance of slip and therefore slightly smaller gas holdup).

Figure 4B:
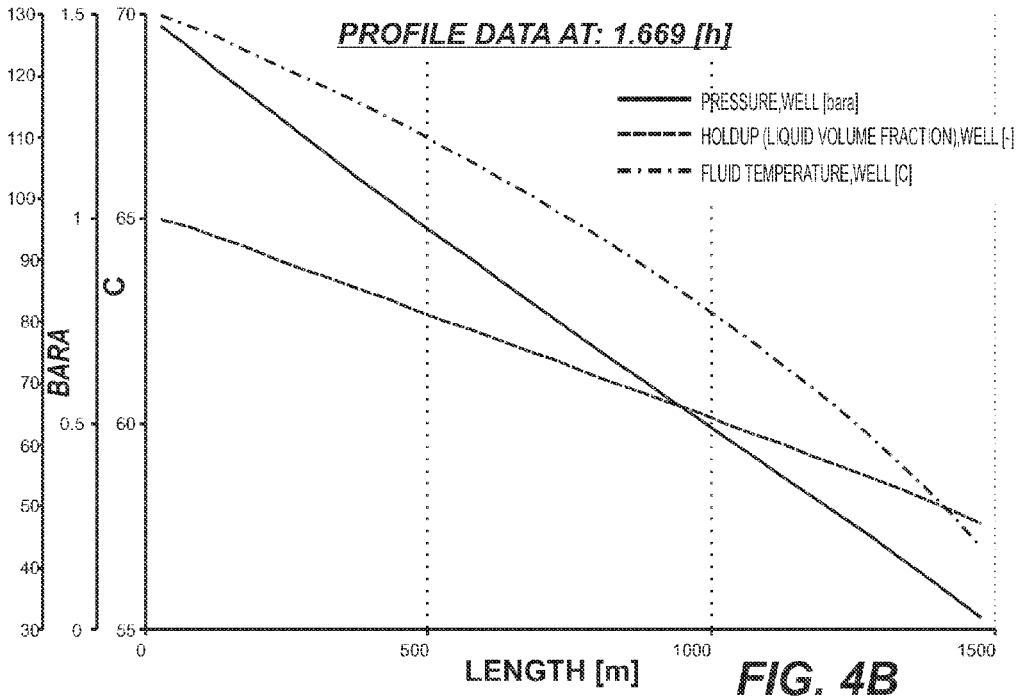
FIG. 4B illustrates steady-state profiles in the well before the disturbance in inlet pressure.

The steady-state profiles in the well before the disturbance in inlet pressure are shown in FIG. 4B. The inlet pressure of 130 bara is just above the oil bubble-point, and there is a short region of single-phase flow. The inlet (reservoir) temperature is 70° C. and with an overall heat transfer coefficient, U, of 10 $W/m^2/°$ C. the exit fluid temperature is 57° C. The whole of the two-phase region is in the bubble flow regime.

Figure 4C:
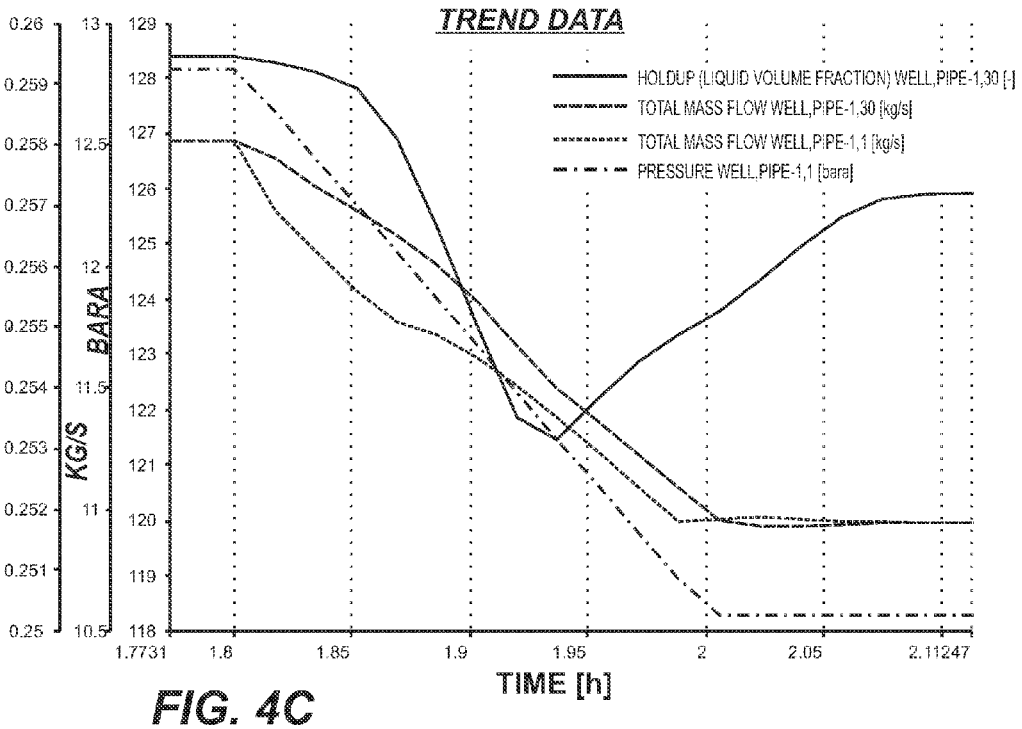
FIG. 4C is an OLGA trend plot of simulation results for a second test case.

In a second test case, the inlet pressure was reduced from 130 bara to 120 bara, which will reduce the mass flow-rate to a final steady-state of 10.94 kg/s. In this case, the reduction in flow-rate tends to increase gas holdup through slip, whereas the reduction in pressure gives rise to a "gas drive" effect associated with bubble expansion and hence increase gas holdup. The second effect is dominant and the inlet mass flow is consistently less than that at the exit as shown in the trend plot of FIG. 4C for the second case. Because of the opposing effects, the trend in liquid holdup at the exit end shows a complicated behavior as indicated in the diagram and exhibits a minimum about half way through the ramp. The maximum difference between inlet and exit mass flow-rates at 1.87 hr is 2.9% (0.35 kg/s), which is just large enough to warrant consideration.

These preliminary runs with OLGA also confirm that the wellbore capacity effects are quite small, but if the flow measurement accuracy merits this refinement, then OLGA is a useful tool to make the correction.

5. Transient Formation Model

Figure 5A:
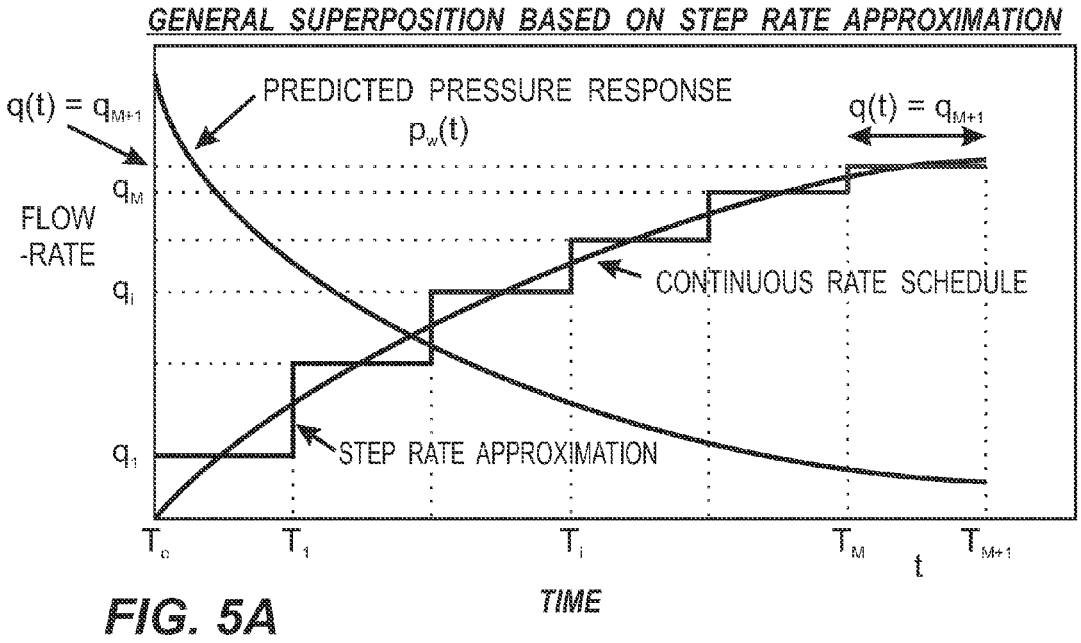
FIG. 5A illustrates general superposition based on step rate approximation for the variable rate analysis.

Given the previous discussion of the system 10, flowmeter 50, and transient wellbore model above, discussion now turns to the second part of the two-part system—the transient formation model. Layered well testing in the underbalance drilling context requires an algorithm that can compute the rate response of a layer given a measured pressure history. The basis of variable rate analysis is the convolution or superposition theorem that is illustrated in FIG. 5A. The convolution equation takes the form of:

$$p_i - p_w(t) = \frac{\mu}{2\pi kh}\left(\sum_{i=1}^{M} q_i(p_D(t-T_{i-1})_D - p_D(t-T_i)_D) + q(t)p_D(t-T_M)_D\right) \tag{5.1}$$

Usually, this superposition principle is used to predict the bottom-hole flowing pressure, $p_{wf}(t)$, knowing the rate history of the well. Here, the dimensionless constant rate $p_D$ function often refers to infinite-acting radial flow such that:

$$p_D(t_D) = \frac{1}{2}\ln\frac{4kt}{\gamma\phi\mu c_t r_w^2} + S \tag{5.2}$$

Figure 5B:
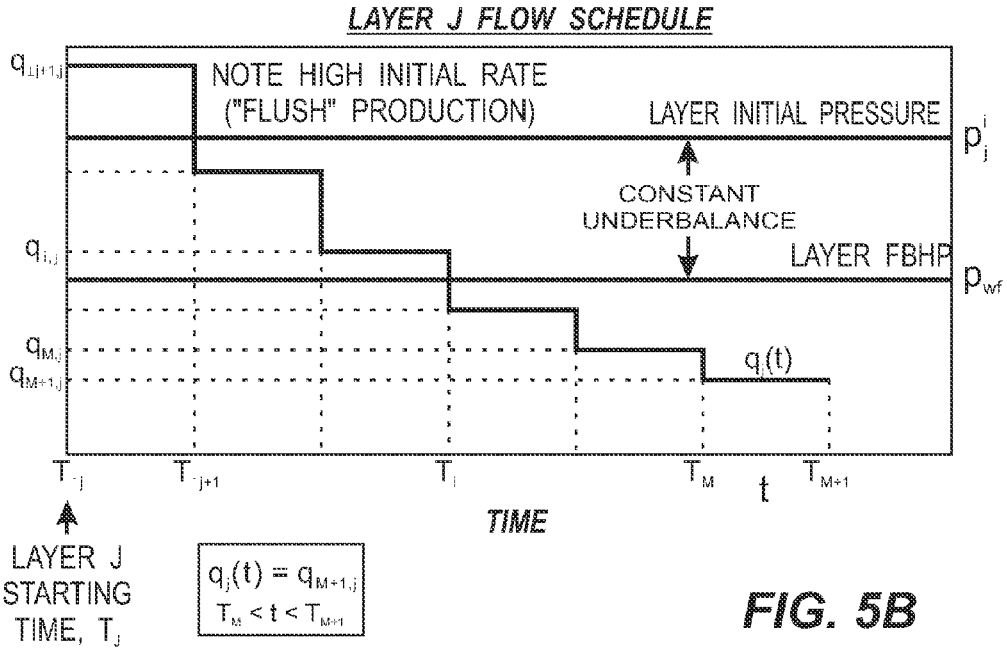
FIG. 5B is a flow schedule for a Layer J.

However, in the UBD context, the flowing pressure, $p_{wf}(t)$, is known, and it is desired to predict the rate transient. Consider the problem, for example, of determining the rate in the timestep between $T_M$ and $T_{M+1}$ as indicated in FIG. 5B. It is presumed that the rate in the preceding time steps has already been computed. Since individual layers of the formation are involved, it is convenient to apply equations (5.1) and (5.2) to each layer (j) with starting time $\tau_j = T_{lj}$; Equation (5.1), subscripted j for a specific layer, can the be solved for the new layer rate as follows:

$$q_{M+1,j} = \frac{2\pi k_j h_j(p_j^i - p_w(T_{M+1}))}{\mu p_{Dj}(T_{M+1}-T_M)_{Dj}} - \frac{\sum_{i=lj+1}^{M} q_{ij}\left(p_{Dj}(T_{M+1}-T_{i-1})_{Dj} - p_{Dj}(T_{M+1}-T_i)_{Dj}\right)}{p_{Dj}(T_{M+1}-T_M)_{Dj}} \tag{5.3}$$

In equation 5.3, the integer, lj, is the index of the time step at which the layer (j) commences to flow. Because the wellbore pressure can be measured very accurately, computing the layer flow-rate response, $q_j(t)$, for a forced pressure transient and for assumed model parameters forms is preferably used in the testing method of the present disclosure. The general flow response mode is illustrated in FIG. 5B, if the pressure and time points are now recognized as input to the sequential calculation of $q_j(t)$ (j=1 . . . N) using the step-rate formula in equation (5.0).

Equation (5.3) applies when the imposed pressure is specified from time, t=0, and the initial layer pressure, $p_j^i$, is known. In FIG. 5B, the flowing bottom-hole pressure (FBHP), $p_{wf}(t)$, is depicted as constant, and the computed flow schedule is the transient response to a step change in the wellbore pressure. This constant underbalance case is the canonical behavior for UBD analysis. Computing the rate response for a specified pressure history using equation (5.3) was developed for layered well testing using the up-and-down passes of a production logging tool.

In the preceding treatment, the convolution is based on the constant rate solution to the diffusivity equation (5.2), following the approach adopted in conventional well test interpretation. However, it is also possible to derive a convolution based on the constant terminal pressure solution of Jacob and Lohman, disclosed in (Jacob, C. E. and Lohman, S. W., "Non-steady Flow to a Well of Constant Drawdown in an Extensive Aquifer," *Trans A GU* (August 1952), 559-569), which takes the form of:

$$q_D = \frac{1}{\frac{1}{2}\ln\frac{4t_D}{\gamma} + S} \tag{5.4}$$

where:

$$q_D = \frac{\mu q(t)}{2\pi kh(p_i - p_{wf})}$$

$$t_D = \frac{kt}{\phi\mu c_t r_w^2}$$

Figure 5C:
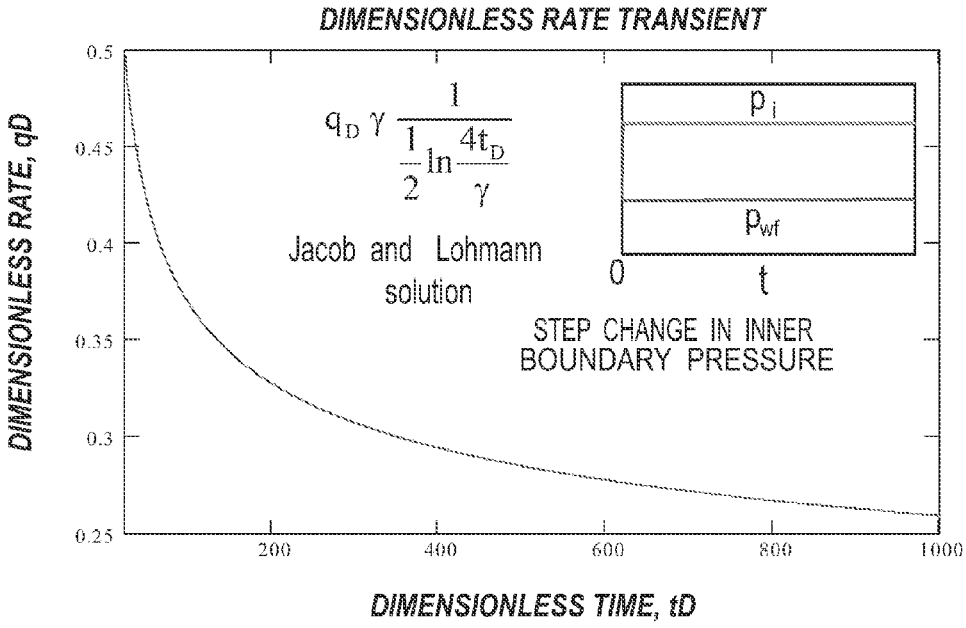
FIG. 5C is a graph of a dimensionless rate transient.

In equation (5.4), the time dependent rate, q(t), is predicted for a step change, $\Delta p = p_i - p_{wf}$, in the inner boundary (wellbore) pressure. The dimensionless rate transient according to equation (5.4) is plotted in FIG. 5C for S=0, which again illustrates the initial flush production at early time. Note, however, that equation (5.4)—the log approximation—is not valid at very small values of $t_D$. In fact, Jacob and Lohman refer to equation (5.4) as the long time solution, but in modem well test terms this would be referred to as middle time region. Typically, the log approximation is valid for dimensionless times, $t_D$, greater than 25.

In the context of the inverse problem of parameter estimation, the analytical solution is of the form of:

$$\frac{1}{q(t)} = \frac{\mu}{4\pi kh(p_i - p_{wf})}\left(\ln t + \ln\frac{4k}{\gamma\phi\mu c_t r_w^2}\right) \tag{5.5}$$

Figure 5D:
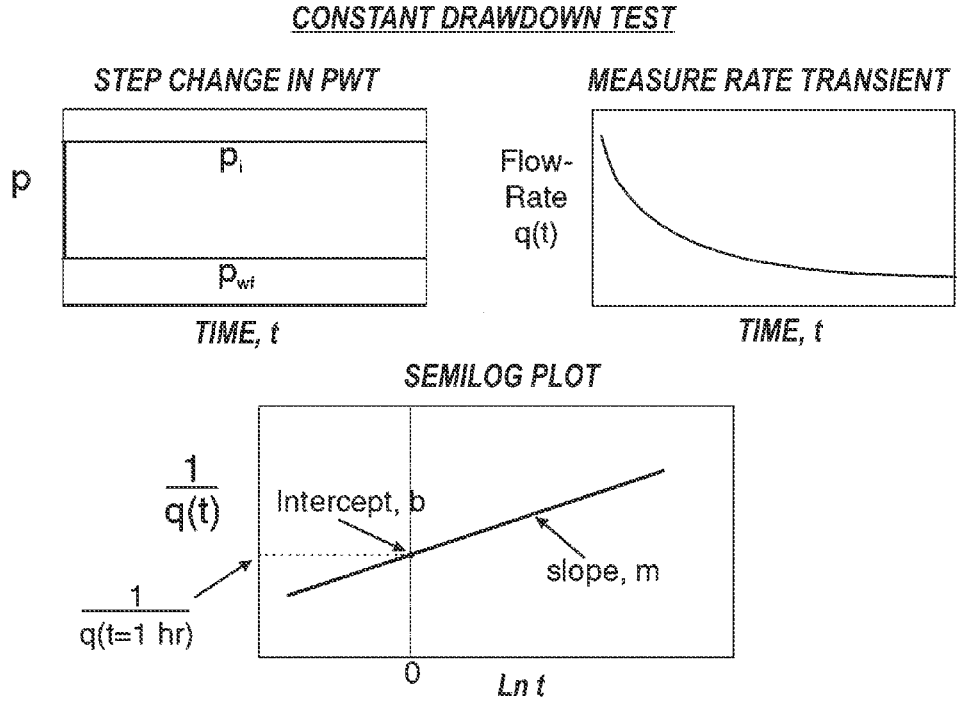
FIG. 5D illustrates plots of a constant drawdown test.

In this formulation, the skin has deliberately been set to zero which conforms to the UBD scenario. A semilog plot of 1/q(t) (i.e., $q^{-1}(t)$) versus ln(t) will exhibit a straight-line form (as shown in FIG. 5D) given by:

$$q^{-1}(t) = m\ln t + b \tag{5.6}$$

where:

$$\text{slope, } m = \frac{\mu}{4\pi kh(p_i - p_{wf})}; \text{ and} \tag{5.7}$$

$$\text{intercept, } b = \frac{\mu}{4\pi kh(p_i - p_{wf})} \ln \frac{4k}{\gamma \phi \mu c_t r_w^2} \tag{5.8}$$

Thus, if the slope and intercept, m and b, of the semilog plot are determined, then these values can be used to identify the permeability, k, and the formation pressure, $p_i$, because there are two equations (5.7) and (5.8) in two unknowns, k and $p_i$. It is only possible to determine the pressure in a single step drawdown because the skin is deemed to be zero. Yet, this is an interesting theoretical result for the constant terminal pressure situation. In this theory of a single layer system, it is assumed that the drawdown can be applied instantaneously to the whole zone, although in the UBD situation progressive penetration occurs.

In the case where the inner pressure boundary condition is time dependent, a superposition principle takes the form of:

$$q = \frac{2\pi kh}{\mu}\left(\begin{array}{c}\Delta p_1 q_D(t_D) + (\Delta p_2 - \Delta p_1) q_D(t_D - T_{1,D}) + \\ (\Delta p_3 - \Delta p_2) q_D(t_D - T_{2,D}) + \ldots\end{array}\right) \tag{5.9}$$

Equation (5.9) is used, for example, in the classical treatment of transient aquifer influx and in cases where the $q_D$ function is available. Given the pressure history, equation (5.9) gives a better solution for the prediction of rate transients than equation (5.3). However, constant rate $p_D$ functions are available for a wide range of models because of their application in conventional pressure transient analysis and hence the approach based on equation (5.3) is also useful.

Figure 5E:
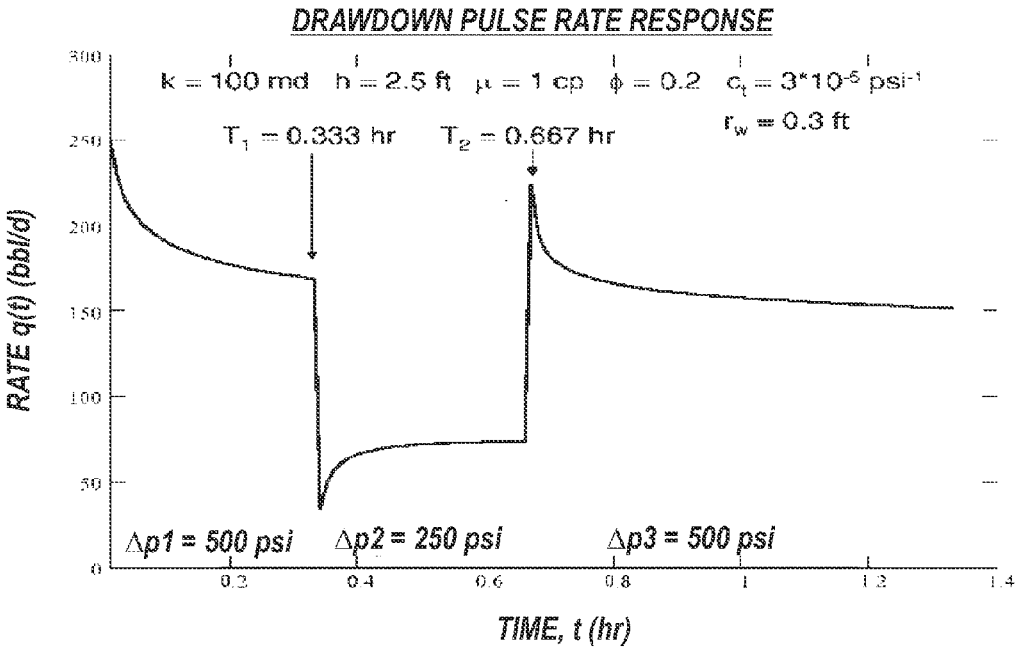
FIG. 5E is a graph of a drawdown pulse rate response.

In FIG. 5E, the response of the rate to a pulse change in wellbore pressure, computed from superposition equation (5.9), is plotted. The reservoir data for this simulation is listed below in Table 5.2.

TABLE 5.2

Reservoir Data for Pulse Change in Drawdown (Three period test)

| | | | | |
|---|---|---|---|---|
| $\mu = 1$ cp | $\phi = 0.2$ | $r_w = 0.3$ ft | $c_t = 3 \times 10^{-5}$ psi$^{-1}$ | h = 2.5 ft |
| k = 100 md | $p_i = 5000$ psia | $T_1 = 0.333$ hr | $T_2 = 0.667$ hr | $\Delta p_1 = 500$ psi |
| $\Delta p_2 = 250$ psi | $\Delta p_3 = 500$ psi | | | |

Figure 5F:
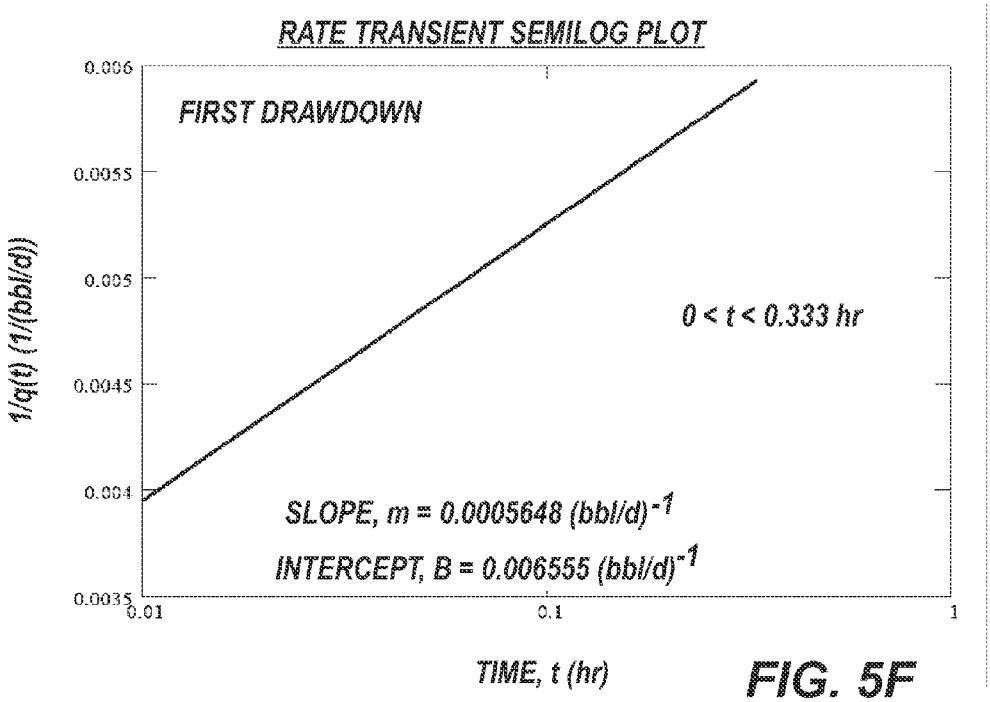
FIG. 5F is a rate transient semilog plot.

The semilog plot for the first drawdown period (0<t<0.333 hr) is shown in FIG. 5F where the predicted straight line is apparent. Substituting the fitted slope and intercept in equations (5.7) and (5.8) and solving for k and $p_i$ yields the values listed in the Table 5.2 above of k=100 md and $p_i$=5000 psia.

It is interesting to examine the behavior of a two-drawdown test that corresponds to the first two periods in FIG. 5E. In this case, the rate during the second period is given by equation (5.9) with two terms such that:

$$q_2 = \frac{2\pi kh}{\mu}(\Delta p_1 q_D(t_D) + (\Delta p_2 - \Delta p_1) q_D(t_D - T_{1,D})) \tag{5.10}$$

which on substitution of the model ($q_D$ function) of equation (5.4) becomes:

$$q_2 = \frac{4\pi kh}{\mu}\left(\frac{\Delta p_1}{\ln\frac{4t_D}{\gamma}} + \frac{\Delta p_2 - \Delta p_1}{\ln\frac{4(t_D - T_{1,D})}{\gamma}}\right) \tag{5.11a}$$

or $$q_2 = \frac{4\pi kh}{\mu}\left(\Delta p_1\left(\frac{1}{\ln\frac{4(T_1 + \Delta t)_D}{\gamma}} - \frac{1}{\ln\frac{4(t_D)}{\gamma}}\right) + \frac{\Delta p_2}{\ln\frac{4(t_D)}{\gamma}}\right) \tag{5.11b}$$

In the special case where $\Delta p_2$=0 i.e. $p_{wf}$=$p_i$ during the second period, this becomes:

$$q_2 = \frac{4\pi kh \Delta p_1}{\mu}\left(\frac{1}{\ln\frac{4(T_1 + \Delta t)_D}{\gamma}} - \frac{1}{\ln\frac{4(\Delta t_D)}{\gamma}}\right). \tag{5.12a}$$

Figure 5G:
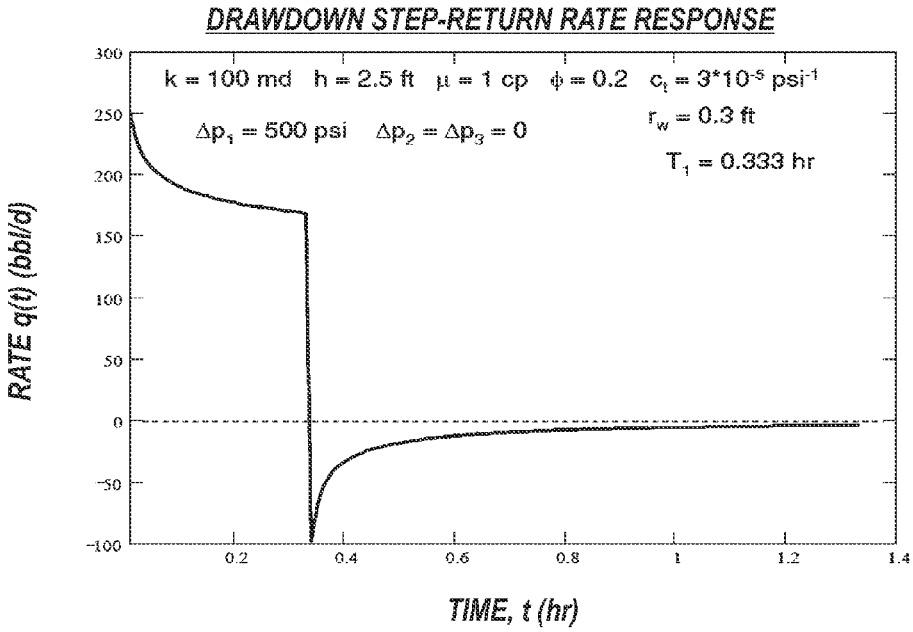
FIG. 5G is a graph of a drawdown step-return rate response.
Figure 5H:
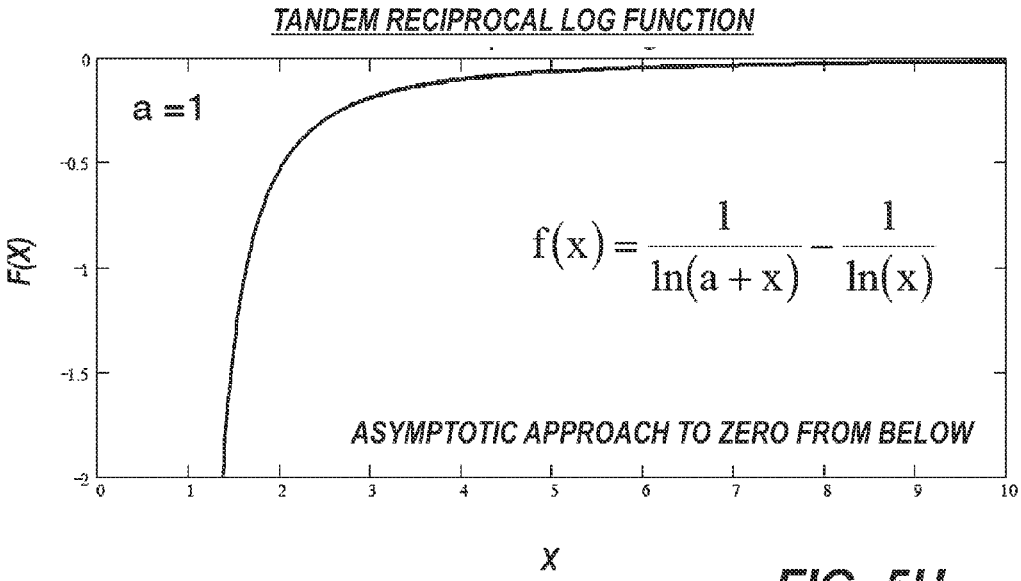
FIG. 5H is a graph of a tandem reciprocal log function.
Figure 5I:
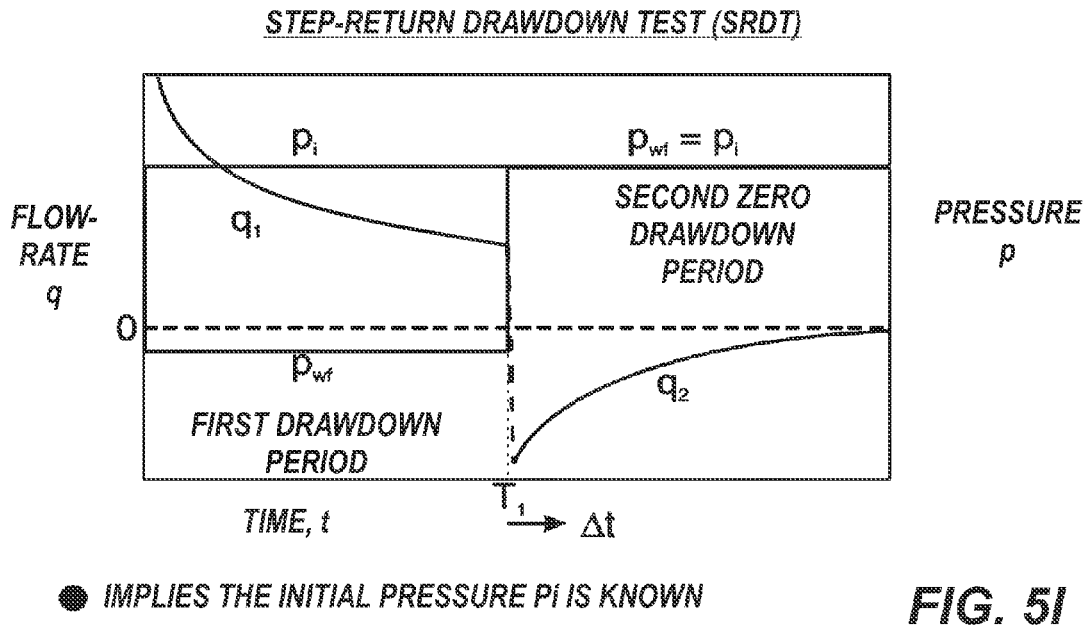
FIG. 5I is a graph of a step-return drawdown test.
Figure 5J:
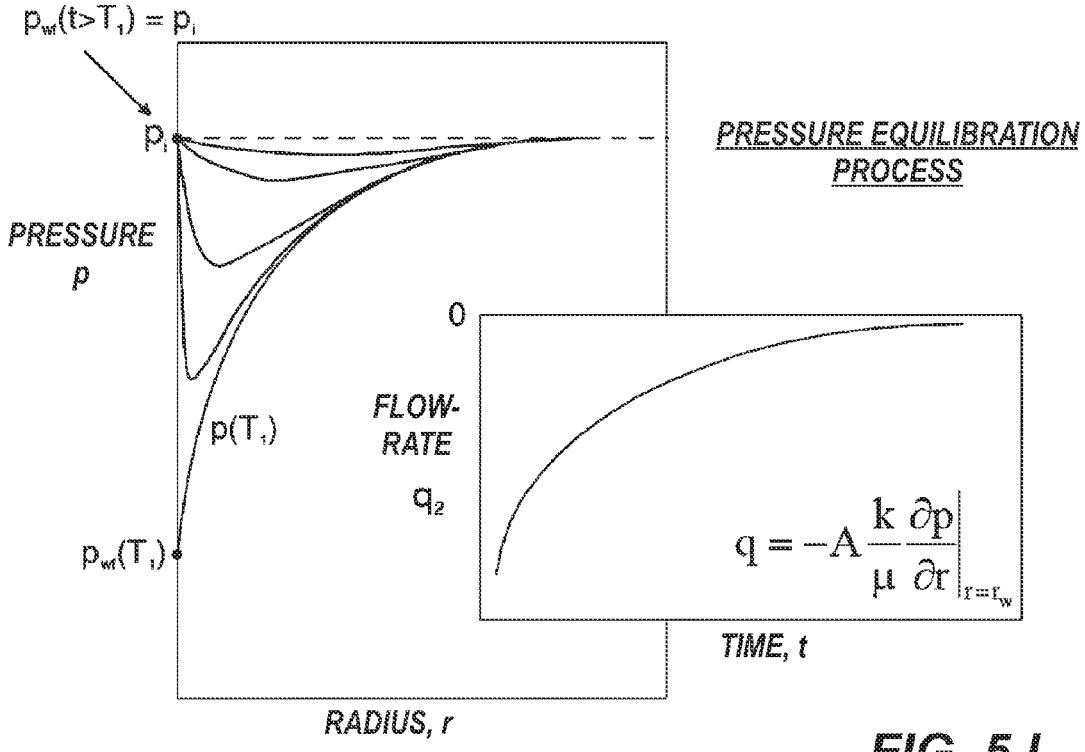
FIG. 5J is a graph of a pressure equilibrium process.

For the data listed in Table 5.2, the drawdown in the second and third periods was set to zero, and the predicted rate response is plotted in FIG. 5G. The function in the brackets is a tandem reciprocal log form that asymptotically approaches zero from below as shown in FIG. 5H. This is the constant drawdown analogue of a buildup and the flow schedule during such a test is shown diagrammatically in FIG. 5I. Such a test can be conveniently described as a step-return process. The process of pressure equilibration in the step-return drawdown situation is illustrated in FIG. 5J, and it can be seen that the effect of setting the sandface pressure back to $p_i$ is quite different from setting $$\frac{\partial p}{\partial r}$$

equal to zero in a shut-in. In particular, the rate immediately goes negative when $p_{wf}$ returns to $p_i$.

Figure 5K:
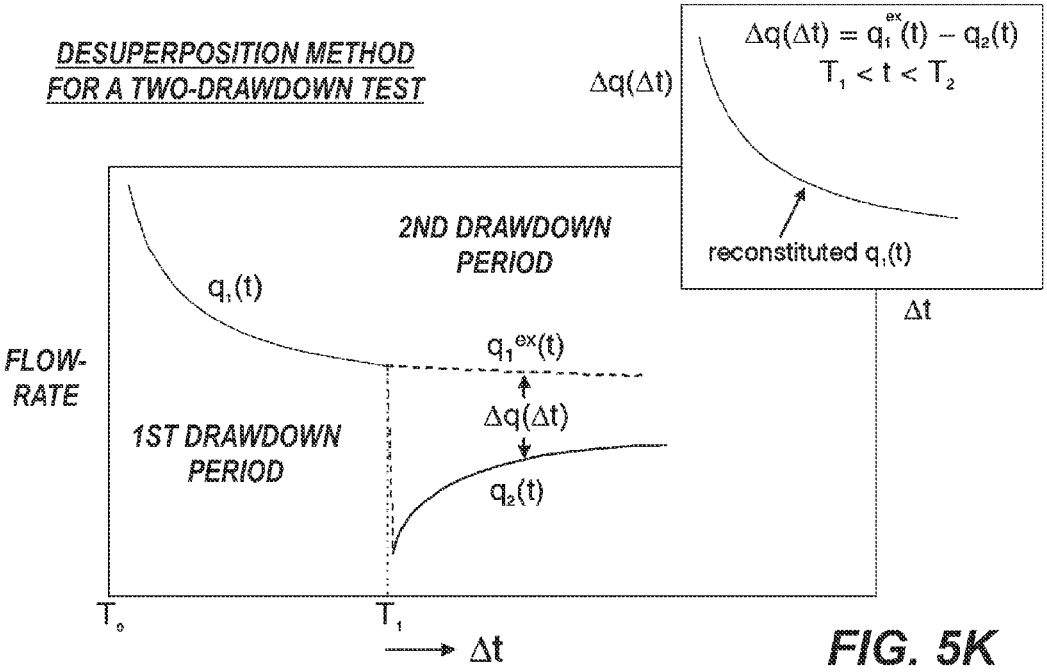
FIG. 5K illustrates a de-superposition method for a two-drawdown test.
Figure 5L:
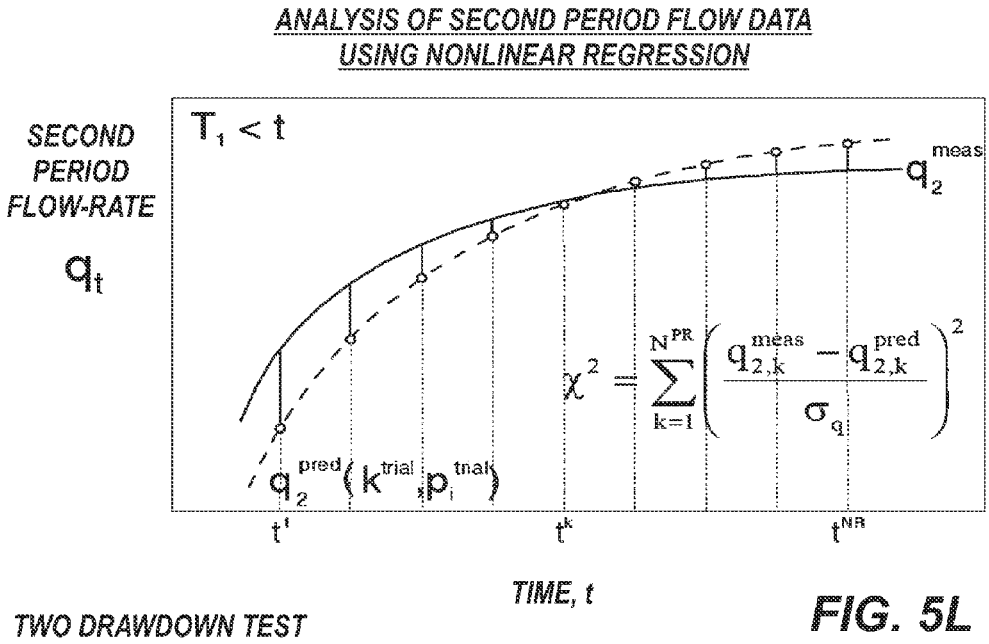
FIG. 5L illustrates analysis of second period flow data using non-linear regression.

In the general case where $\Delta p_2 \neq 0$, the second rate period can be analyzed by de-superposition (as illustrated in FIG. 5K) or by nonlinear regression (as illustrated in FIG. 5L). Equation (5.11) may not lead to a convenient superposition time function through which a direct, specialist semi-log plot can be formulated even when $\Delta p_2$=0. Trials using the MATHCAD supplied minimization routine on the test problem data of FIG. 5E (second period) showed that the permeability and initial pressure could be determined by nonlinear regression provided the starting value for k was higher than the actual.

Figure 5M:
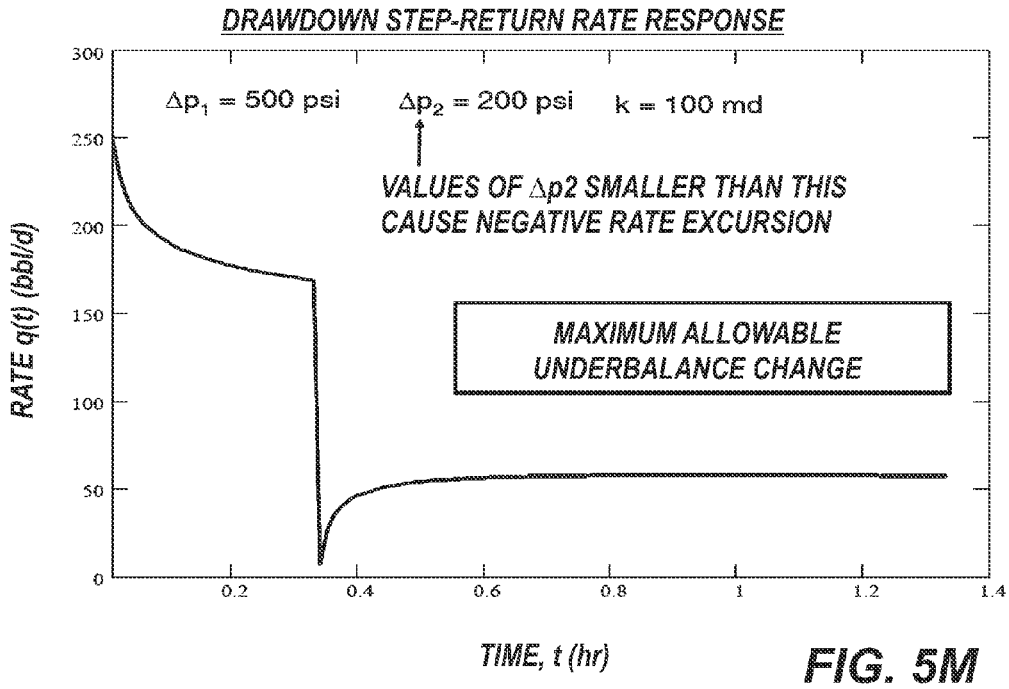
FIG. 5M is a graph of a drawdown step-return rate response.

A negative rate excursion, of the form illustrated in FIG. 5G, is undesirable from an underbalanced drilling point of view because mud invasion leads to formation damage. It is interesting to determine what is the maximum change in underbalance that just avoids a negative rate excursion. In the present example with $\Delta p_1$=500 psi, the rate response with a second period where $\Delta p_2$=200 psi is shown in FIG. 5M where the rate falls to a value just greater than zero. A smaller drawdown in the second period will lead to negative rates. The ability to forecast conditions under which negative rate excursions will occur represents one application of the system and methods disclosed herein.

The maximum permissible reduction in the underbalance will be denoted $\Delta p_{red}$. In the preceding example, this is 300 psi (i.e., the underbalance can be reduced from 500 psi to 300 psi). Simulations using the MATHCAD program showed that for any degree of underbalance in the initial period, $\Delta p_1$, the corresponding permissible reduction may be expressed as a fraction, $F_{max}$, where:

$$F_{max} = \frac{\Delta p_{red}}{\Delta p_1}$$

Figure 5N:
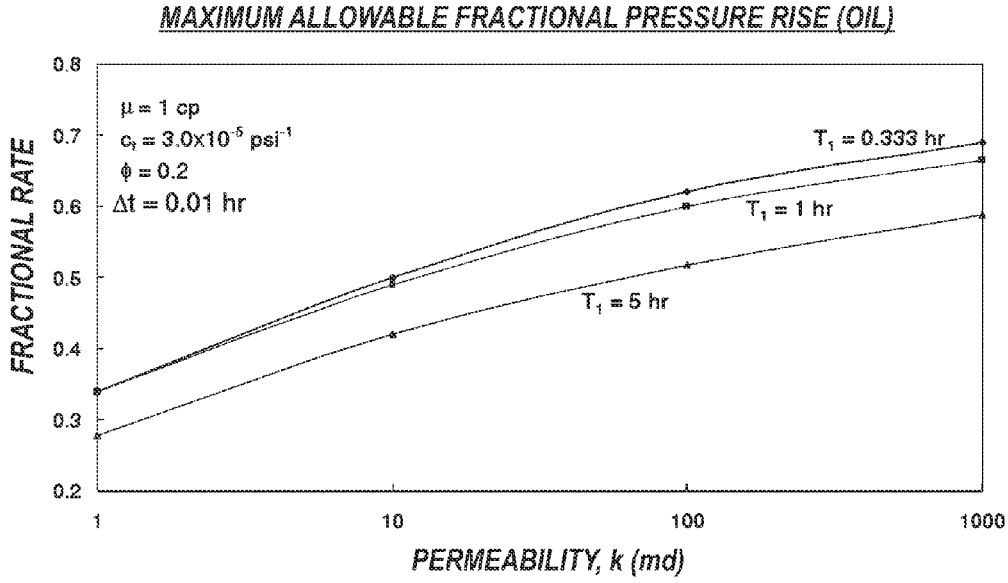
FIG. 5N is a graph of maximum allowable fractional pressure rise (Oil).
Figure 5O:
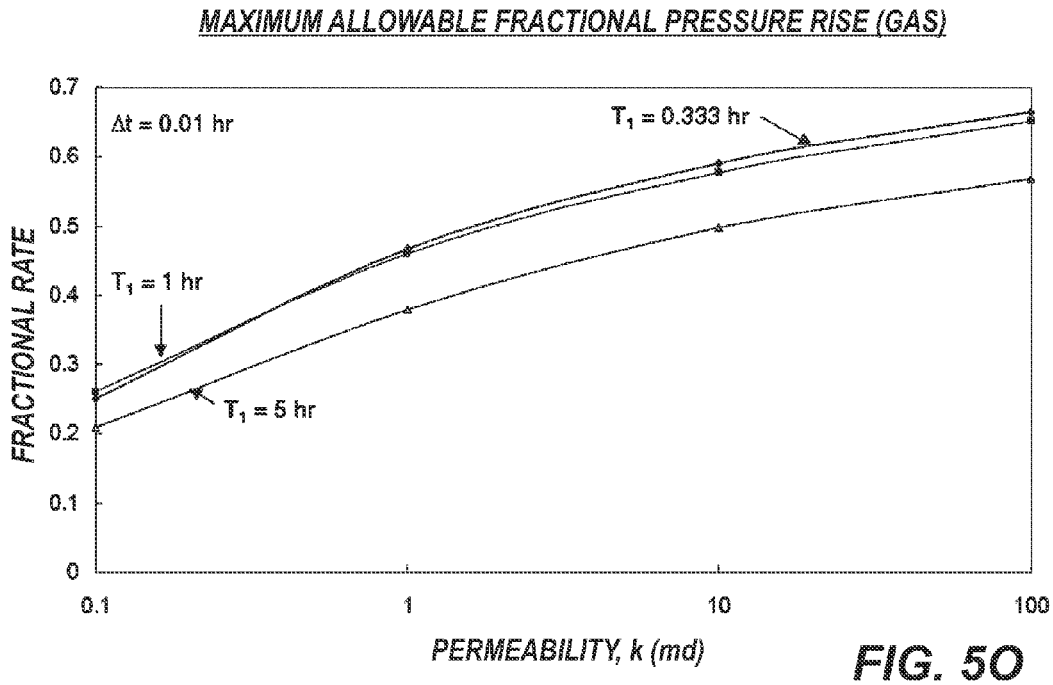
FIGS. 5O-5P are graphs of maximum allowable fractional pressure rise (Gas).

Sensitivity runs were made using the software to examine the effect of permeability, k, and initial flowing time, $T_1$, on the ratio $F_{max}$. The results for oil are shown in FIG. 5N for oil and for gas in FIG. 5O. The properties for the two cases are shown in the table below.

TABLE 5.3

Reservoir parameters for allowable underbalance sensitivities

| | | | |
|---|---|---|---|
| $\mu_o = 1.0$ cp | $c_{to} = 3.0 \times 10^{-5}$ psi$^{-1}$ | $\mu_g = 0.02$ cp | $c_{tg} = 3.0 \times 10^{-4}$ psi$^{-1}$ |
| $r_w = 0.3$ ft | $\phi = 0.2$ | | |

Figure 5P:
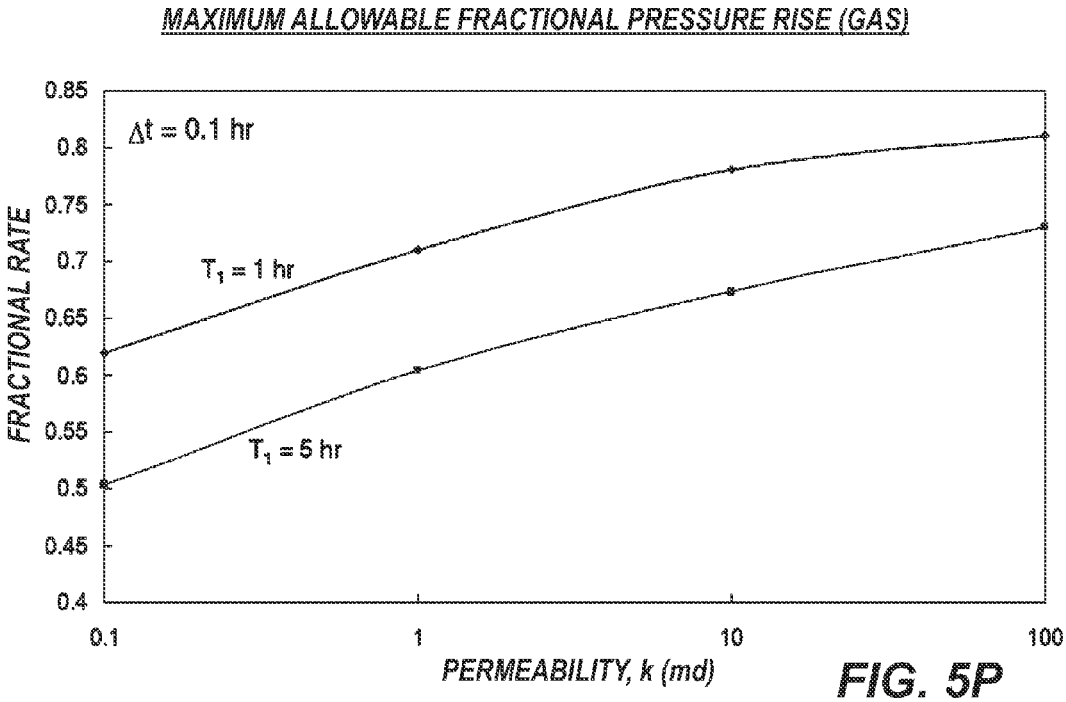
Figure 5Q:
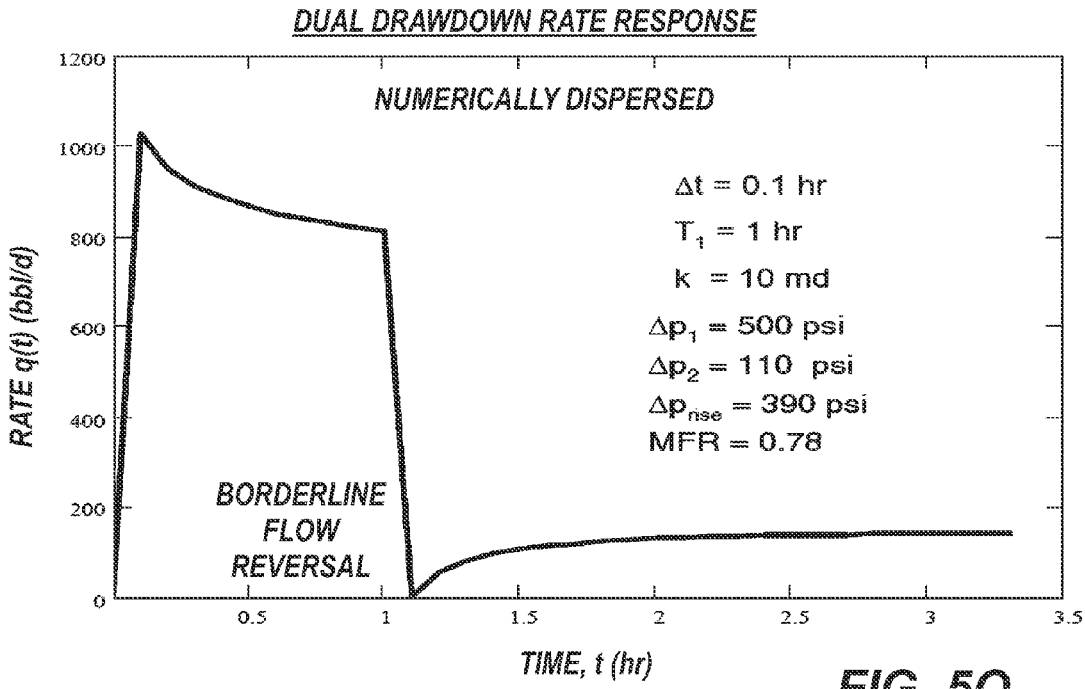
FIG. 5Q is a graph of a dual drawdown rate response.

The allowable ratio decreases with permeability decreasing and also decreases as the flowing time becomes longer. In the computation of the results in FIG. 5N, the time-step was set at $\Delta t$=0.01 hr in the superposition algorithm. This results in an almost instantaneous step change in pressure. A set of sensitivities was also run with a longer time-step (e.g., $\Delta t$=0.1 hr) to examine the effect of spreading out the pressure disturbance. The results of this work are shown in FIG. 5P where it is apparent that much larger changes in underbalance can be tolerated if the pressure disturbance is controlled in some way. The flow history of one of these cases is shown in FIG. 5Q, and it is apparent that the sharp spike has been (numerically) dispersed.

Figure 5R:
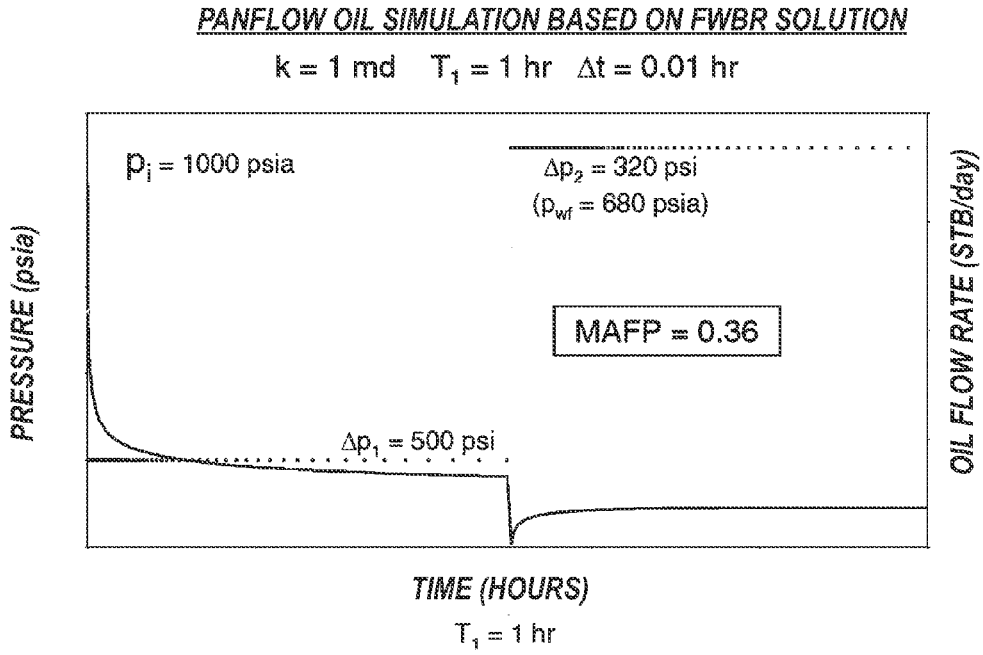
FIG. 5R is a graph of a panflow oil simulation based on a FWBR solution.

The preceding work was based on the Jacob and Lohman line source analytical solution to the constant wellbore pressure solution. For early time phenomena, the finite wellbore radius (FWBR) solution should properly be used, and a PanFlow option in the analysis software called PanSystem (available from e-Production Solutions, Inc., a Weatherford Company) can be used to generate rate responses for specified pressure conditions using convolution of the constant rate solution. In order to check the validity of the correlations derived previously, runs were made in PanFlow using exactly the same conditions. For the case of k=1 md, $T_1$=1 hr and $\Delta t$=0.01 hr, the result of a Panflow simulation is shown in FIG. 5R. This has employed the FWBR model. The MAPR ratio is 0.36, which is very close to the value of 0.34 obtained using Jacob and Lohman theory and given in FIG. 5N. The second bottomhole pressure of 680 psia was found by trial and error such that the rate just avoided going negative. Thus, the error in using the log approximation for the line source is quite small.

In many cases, the target of underbalance drilling is fractured zones described by the dual porosity model. The problem of predicting rate given a pressure signal and a model with identified parameters arose in the interpretation of layered well tests using production logging data. In the analysis software PanSystem, this facility is known as PanFlow, and it can be used to run the calculations for negative rate excursions. It is necessary to generate a pressure response exhibiting two periods—each at constant wellbore pressure. This can be conveniently done in Excel and the time-pressure file imported into PanSystem.

A dual porosity model has two additional dimensionless variables, $\omega$ and $\lambda$. The capacity parameter, $\omega$, is the ratio of the porosity of the fracture network divided by the total porosity and a typical value for this quantity is 0.01. The interporosity flow parameter, $\lambda$, is related to the matrix block height, $h_m$, and the matrix permeability, $k_{mb}$, and is defined as:

$$\lambda = \frac{60 k_{mb} r_w^2}{k_{fb} h_m^2}$$

Figure 5S:
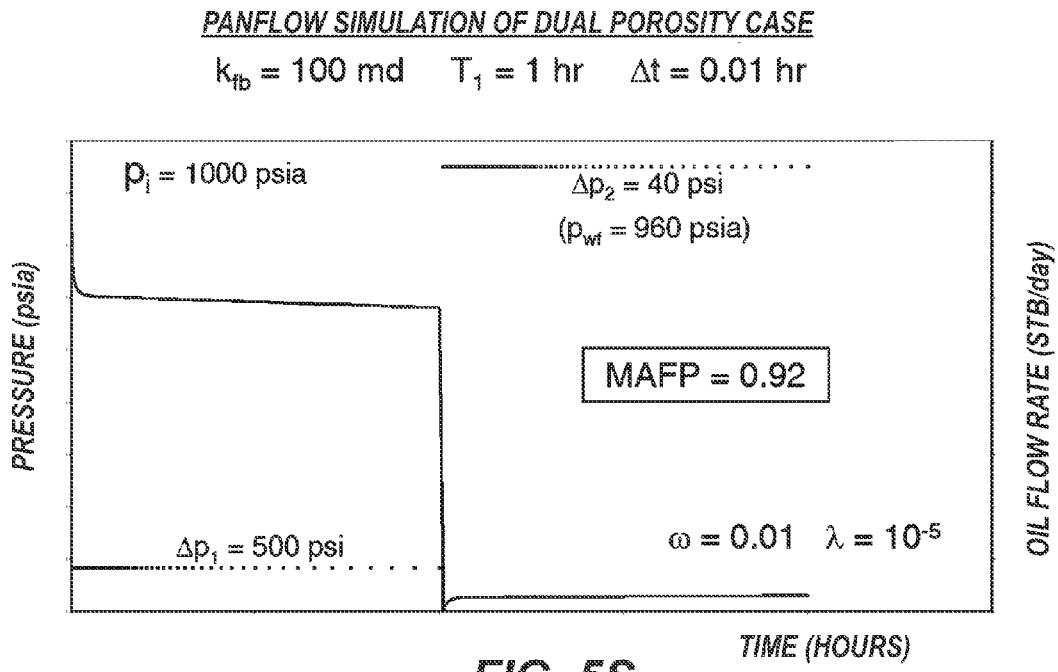
FIG. 5S is a graph of a panflow simulation of a dual porosity case.

Here, $k_{fb}$ is the bulk permeability (based on total area of matrix plus fractures) of the fracture network. A large value of $\lambda$, corresponding to quite small matrix blocks is $10^{-5}$. The first flow regime in dual porosity is radial flow in the fracture system alone Initially, a PanFlow run was made for k=100 md and $\phi$=0.2 which yielded an MAPR ratio of 0.61 ($\Delta t$=0.01 hr). The Jacob and Lohman theory gave 0.6 for this case so there is substantial agreement. The model was then changed to dual porosity with $\omega$=0.01 and $\lambda=10^{-5}$. The pressure in the second drawdown was adjusted until the rate again just failed to go negative. The PanFlow result is shown in FIG. 5S where the MAPR ratio is now 0.92—substantially higher than the homogeneous result of 0.61. Thus, it may be concluded that the correlations given here (FIG. 5N for oil) are conservative for fractured zones. Note that the permeability becomes the bulk fracture network permeability, $k_{fb}$. The reason for the marked contrast between the homogeneous and dual porosity situations is the low porosity, $\phi_f$, which controls the initial fracture system alone flow regime, which in the present case is $\phi_f$=0.01 $\phi_{m+f}$. Thus, in a fractured reservoir case, there is little capacity in the fracture network. The rate transient following a change in FBHP occurs essentially in the period with no support from the matrix. This is favorable because many candidates for UBD are fractured zones where the MAPR ratios are much larger than those predicted by homogeneous theory.

The PanFlow option in PanSystem can be used as a tool to study the conditions under which negative rate excursions will occur. The example quoted here ($k_{fb}$=100 md, $\phi_{f+m}$=0.2, $\omega$=0.01 and $\lambda=10^{-5}$) refers to typical (but specific) parameter values, but this can be extended to appropriate (particular) parameter sets relevant to actual field conditions. One consideration for this approach involves how the block size and the matrix permeability are assigned.

Figure 5T:
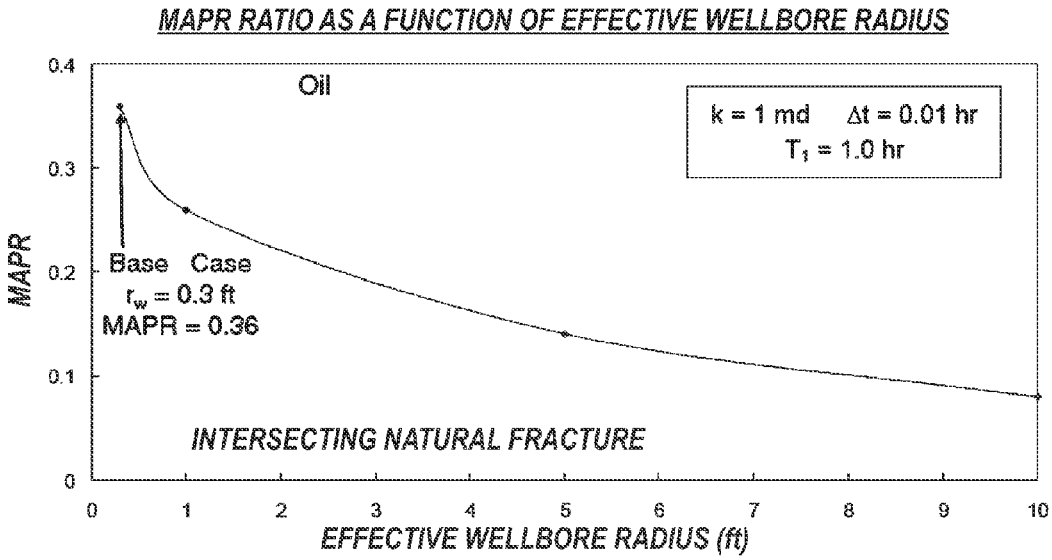
FIG. 5T is a graph of a MAPR ratio as a function of effective wellbore radius.

The FWBR model can substantially model the case where a natural fracture intersects the wellbore with $r_w$ replaced by $r_{w,eff}=x_f/2$. The FWBR radius model predicts linear flow at very early time and then radial flow with a transition region separating the two flow regimes. The results for three wellbore radii are shown in FIG. 5T, which shows that the presence of a natural fracture greatly reduces the allowable pressure rise. The effective wellbore radius of 5 ft corresponds to a 10 ft half length natural fracture. The result for an intersecting fracture is completely the opposite to that of a fracture network. Therefore, when analyzing a given well, an assessment is preferably performed to determine which of these cases the given well condition corresponds to.

6. Application to Underbalanced Drilling

Figure 6A:
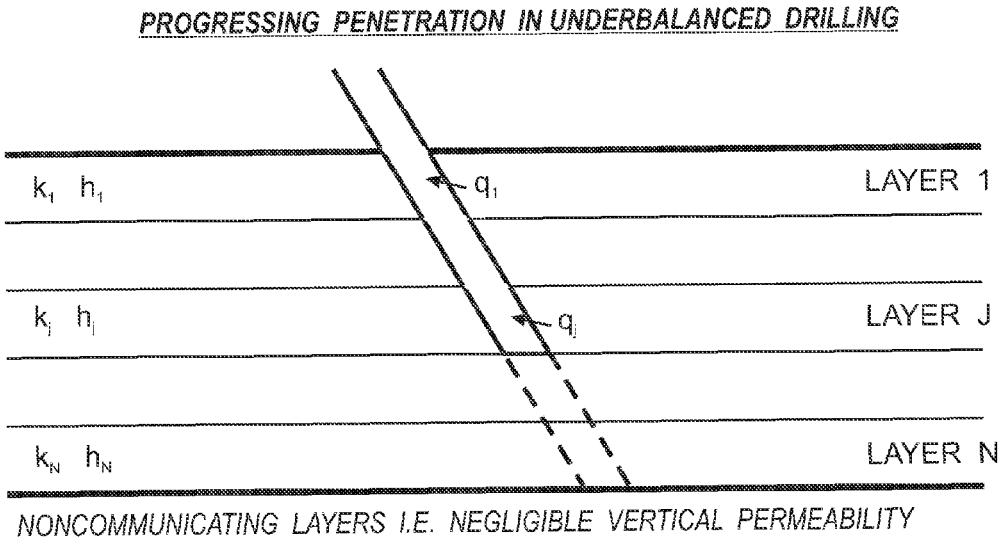
FIG. 6A illustrates an example of progressive penetration of layers in underbalanced drilling.

The multilayer convolution algorithm disclosed above in Section 5 can be applied in underbalanced drilling where the well is flowing during the drilling process. An analytical model of underbalanced drilling in multiple layers is illustrated in FIG. 6A. As the well progressively penetrates the reservoir, more layers (e.g., Layers 1, J, N, etc.) become available for flow. The superposition equation for an individual layer takes the form of:

$$p_j^i - P_w(t) = \left(\frac{\mu}{2\pi kh}\right)_j \left(\sum_{i=l}^{M} q_{ij}\left(p_{Dj}(t_j - T_{i-1})_{Dj} - p_{Dj}(t_j - T_i)_{Dj}\right) + q_j(t)p_{Dj}(t_j - T_M)_{Dj}\right) \tag{6.1}$$

Here, each layer has its own starting time, $\tau_j$, measured as the point where the drill bit penetrates the layer. The quantity, $t_j$, is the total flowing time for layer j given by:

$$t_j = t - \tau_j \tag{6.2}$$

Figure 6B:
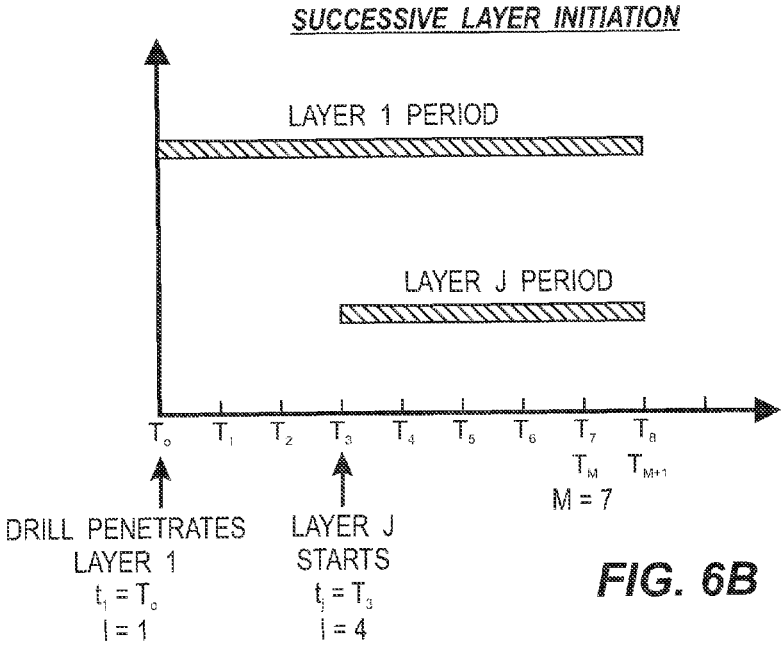
FIG. 6B illustrates successive layer initiation in the progressive penetration of layers in underbalanced drilling.

In the summation, l is the period at which layer j starts to flow as illustrated in FIG. 6B. For the moment, it is assumed that the layer pressures, $p_j^i$, are known independently. In underbalanced drilling, the bottom-hole pressure, $p_w(t)$, is measured, and the algorithm given above minor modification can be used to predict the layer flow-rates as a function of time if the permeability distribution is given. Thus,:

$$q_j(t) = \frac{2\pi k_j h_j(p_j^i - p_w(t))}{\mu p_{Dj}(t_j - T_M)_{Dj}} - \frac{\sum_{i=lj+1}^{M} q_{ij}\left(p_{Dj}(t_j - T_{i-1})_{Dj} - p_{Dj}(t_j - T_i)_{Dj}\right)}{p_{Dj}(t_j - T_M)_{Dj}} \tag{6.3}$$

Substitution of the canonical radial flow model i.e. equation (6.2) and writing $t_j = T_{M+1,j}$ yields:

$$q_{M+1,j} = \frac{2\pi k_j h_j(p_j^i - p_w(T_{M+1}))}{\mu \frac{1}{2}\ln\frac{4k_j(T_{M+1} - T_M)}{\gamma\phi\mu c_t r_w^2}} - \frac{\sum_{i=lj+1}^{M} q_{ij}\left(\frac{1}{2}\ln\frac{T_{M+1} - T_{i-1}}{T_{M+1} - T_i}\right)}{\frac{1}{2}\ln\frac{4k_j(T_{M+1} - T_M)}{\gamma\phi\mu c_t r_w^2}} \tag{6.4}$$

The total flow follows as:

$$q(t) = \sum_{j=1}^{N_a} q_j(t) \tag{6.5}$$

where $N_a$ is the number of active layers at time, t.

The case where the vertical permeability is negligible, corresponding to non-communication in the reservoir, implies that the appropriate $p_D$ function is infinite-acting radial flow such that:

$$p_{Dj}(t_{Dj}) = \frac{1}{2}\ln\frac{4k_j t}{\gamma\phi\mu c_t r_w^2} + S_j \tag{6.6}$$

Figure 6C:
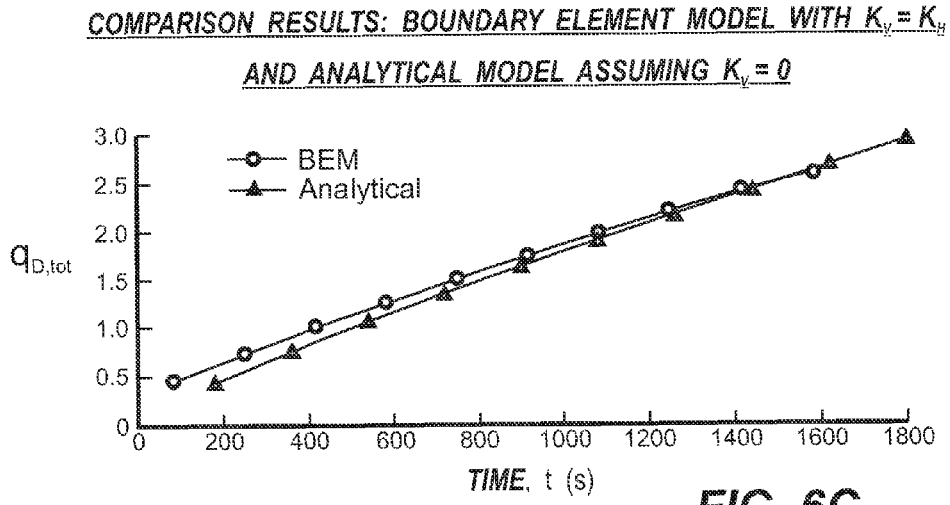
FIG. 6C is a graph of comparison results.

In underbalanced drilling, the mechanical skin is presumed to be zero and the skin contribution in equation (6.6) is geometric only. Thus, the effect of well deviation can be handled by the Cinco and Miller negative skin formulation. As disclosed in Kardolus, C. B. and van Kruijsdijk, C. P. J. W., "Formation Testing While Underbalanced Drilling," SPE 38754, Annual Tech. Conf., San Antonio, Tex., 1997 (which is incorporated herein by reference in its entirety), Kardolus and van Kruijsdijk have compared the non-communicating, progressive layer model to a numerical simulation using the boundary element method allowing vertical communication between the layers. The comparison in terms of dimensionless flow-rate is shown in FIG. 6C where it can be seen that the difference is small, suggesting that vertical permeability does not have a large influence on reservoir behavior in the condition of progressive penetration. Kardolus and van Kruijsdijk concluded that the analytical model is quite sufficient for determination of formation parameters.

One problem with the analytical model is the "steppiness" of the computed total flow due to the finite thickness of the layers. An individual layer commences flowing when the drill bit reaches the mid-point of the layer with a high rate due to the flush production effect. This means there is a "kick" in the predicted total flow each time a layer mid-point is reached. The initial or flush production from a layer is given by:

$$q_{lj+1,j} = \frac{2\pi k_j h_j(p_j^i - p_w(T_{lj+1}))}{\mu \frac{1}{2}\ln\frac{4k_j(T_{lj+1} - T_{lj})}{\gamma\phi\mu c_t r_w^2}} \tag{6.7}$$

which depends on the magnitude of the time step, $\Delta t = T_{lj+1} - T_{lj}$, and becomes infinite as $\Delta t \to 0$. In practice, the layer is opened progressively as the drill bit penetrates, and the superposition based on step rate behavior only handles this effect in a discretised fashion. In order to minimize this effect, the layer thickness is preferably kept small (i.e., a large number of layers is required to adequately represent the special inner boundary condition of progressive penetration).

a. Demonstration Simulation

In order to appreciate the nature of the problem, it is useful to generate flow transient results for various underbalance scenarios. The analytic simulation formula in equations (6.4) and (6.5) was programmed into a MATHCAD spreadsheet, and the rate response generated for different cases. The base situation was a 100-ft thick zone of uniform permeability, k=100 md, which was drilled over a 1 hr period with a vertical well. The well and reservoir properties are listed in Table 6.1 below.

TABLE 6.1

| Base case reservoir and well properties | | | | |
|---|---|---|---|---|
| h = 100 ft | k = 100 md | μ = 1 cp | $r_w$ = 0.3 ft | $c_t = 3.0 \times 10^{-5}$ $psi^{-1}$ |
| φ = 0.2 | γ = 1.781 | $p_j^i$ = 5000 psia | $p_{wf}(t)$ = 4500 psia | $h_{lay}$ = 2.5 ft |

Figure 6D:
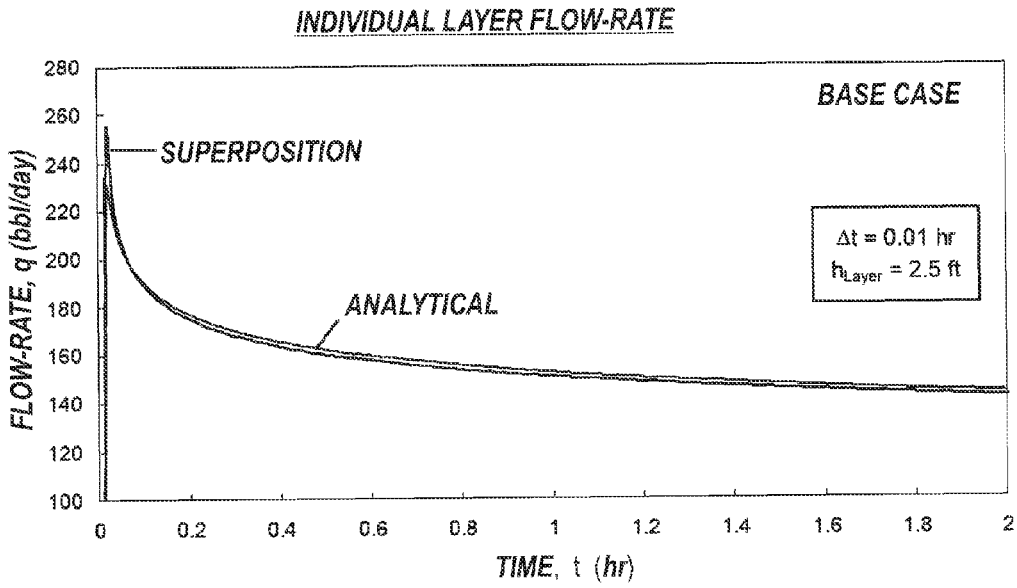
FIG. 6D is a graph of individual layer flow-rate for a base case and a graph of a flow prediction for layer 1 for the base case of 40 layers.

The individual flow prediction for the first layer is shown in FIG. 6D where the initial (flush) production is 253 bbl/d for a 2.5 ft layer. In this simulation, the 100 ft zone was divided into 40 layers and the drilling took 1 hr. The simulation was extended to 2 hr so that all the layers were flowing in the interval 1<t<2 hr. The individual layer flow schedule is quite smooth and exhibits the familiar form of a transient rate decline for a constant terminal pressure, inner boundary condition. The flow transient for deeper layers has exactly the same form but is displaced in time. The constant drawdown analytical solution (i.e., equation (5.4)) is also plotted in FIG. 6D. The superposition based on the CRD solution (i.e., Equation (6.4)) is seen to have an acceptable error of the order of 1%.

Figure 6E:
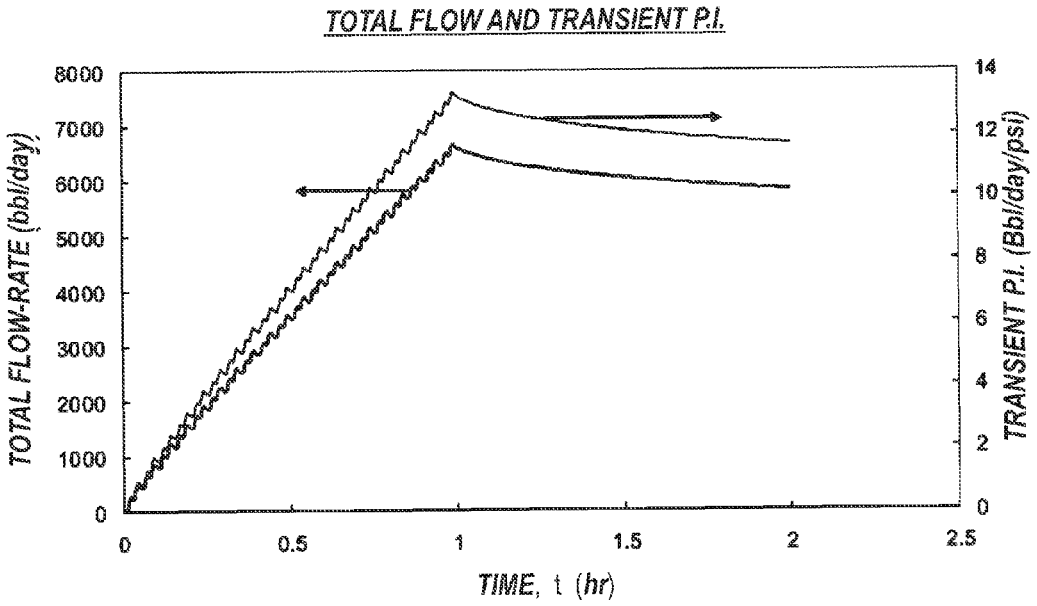
FIG. 6E is a graph of total flow and transient P.I.

The total flow, given by summation in equation (6.5), is plotted in FIG. 6E. This exhibits the steppiness alluded to earlier, even although 40 layers were used. The steppiness occurs because, as each new layer is added, its contribution is immediately in steep decline. The upward kicks are due to the new layers entering the process. It is possible to define an instantaneous, transient P.I. at any moment in time based on the definition of:

$$J_{tran} = \frac{q(t)}{p_i - p_{wf}(t)}. \tag{6.8}$$

This quantity is plotted for the base situation in FIG. 6E. Since the bottomhole flowing pressure is constant in this test case, the transient P.I. follows the total flow-rate, q(t), and exhibits the same steppiness. This transient P.I. is computed by existing software where it is called PWID.

Figure 6F:
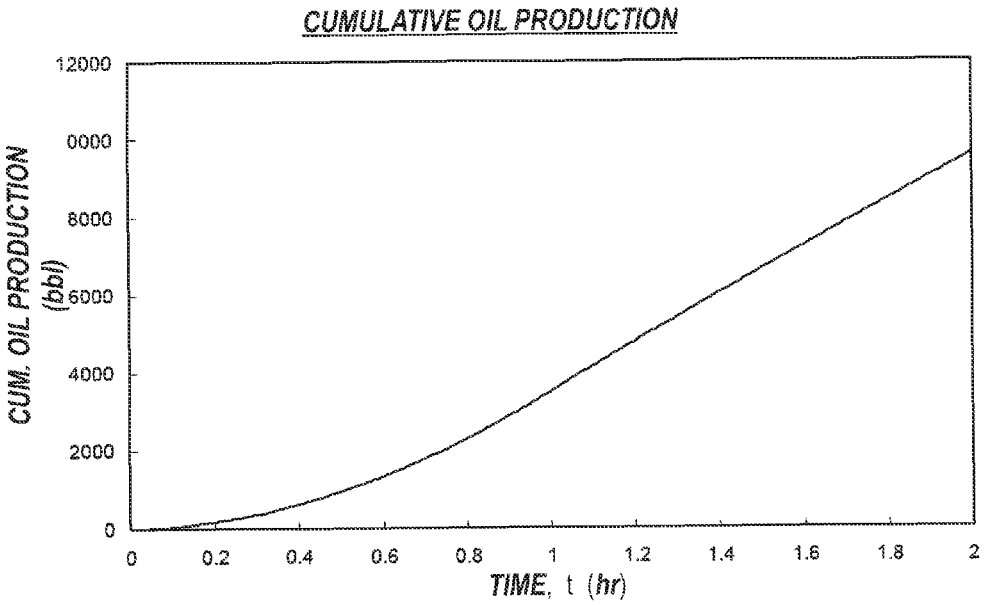
FIG. 6F is a graph of cumulative oil production.
Figure 6G:
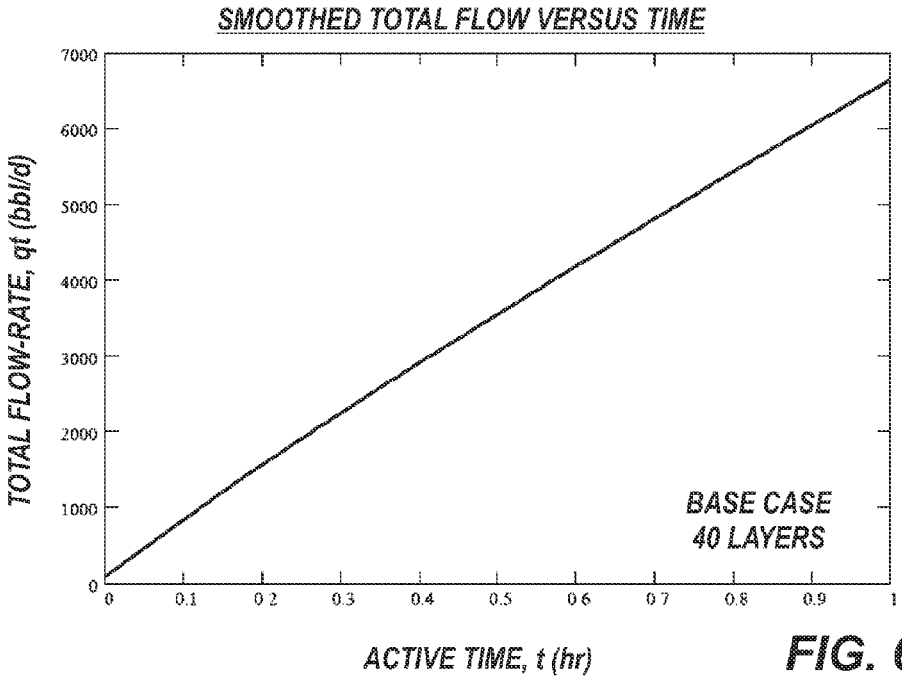
FIG. 6G is a graph of smoothed total flow versus time.

A continuing increase in the value of $J_{tran}$ has been taken as evidence that the formation is not being damaged by the drilling process. Existing software also plots the cumulative oil production, and this is plotted in FIG. 6F for the demonstration simulation. In FIG. 6G, the discretised flow history has been smoothed using a supplied MATHCAD algorithm. This discretised flow history may be a better representation of the true physical situation. Note that smoothing was only carried out on the active period of 1 hr during which drill bit penetration was occurring.

Figure 6H:
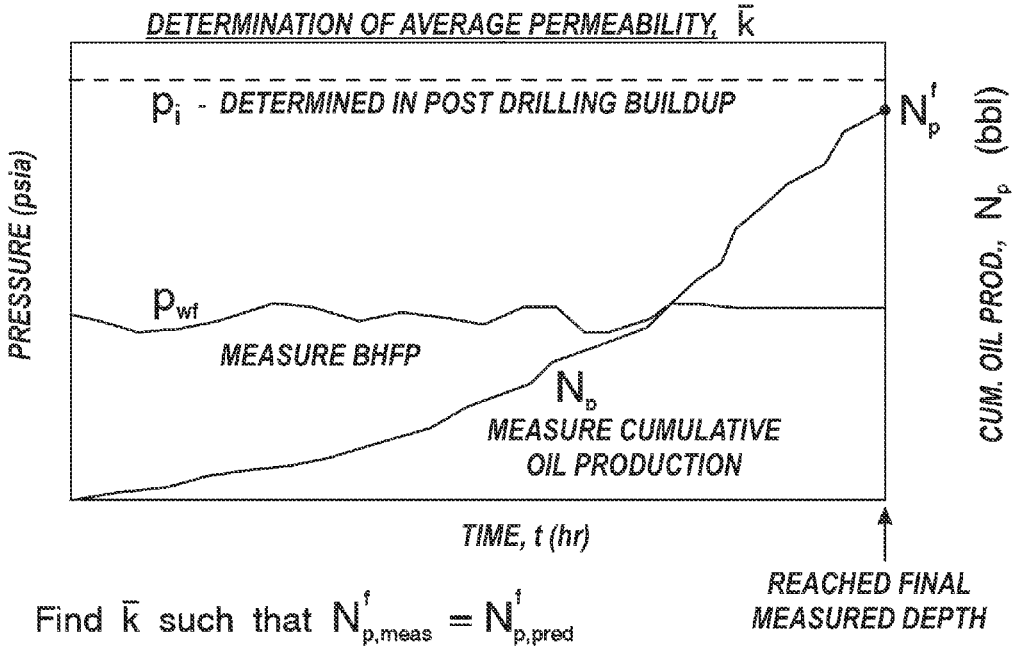
FIG. 6H is a graph showing determination of average permeability of the formation form cumulative production at the end of a drilling phase.

The average permeability of the formation, $\bar{k}$, can be determined from the cumulative production at the end of the drilling phase. This will be denoted $N_p^f$ as illustrated in FIG. 6H. If the superposition model, using the measured bottomhole pressure $p_{wf}(t)$, is run with a uniform permeability, k, this will generate a predicted cumulative production, $N_{pred}^f$, which can be compared with the measured value, $N_{meas}^f$. An iterative search for a value of $\bar{k}$ which minimizes the objective function, $(N_{pred}^f - N_{meas}^f)^2$, yields the average permeability of the formation for the given value of the formation pressure, $p_i$.

It will be demonstrated shortly, through analytical simulation, that the average permeability defined by this procedure is not the same as the arithmetic average permeability of a layered system which controls the eventual semi-steady-state P.I.

Figure 6I:
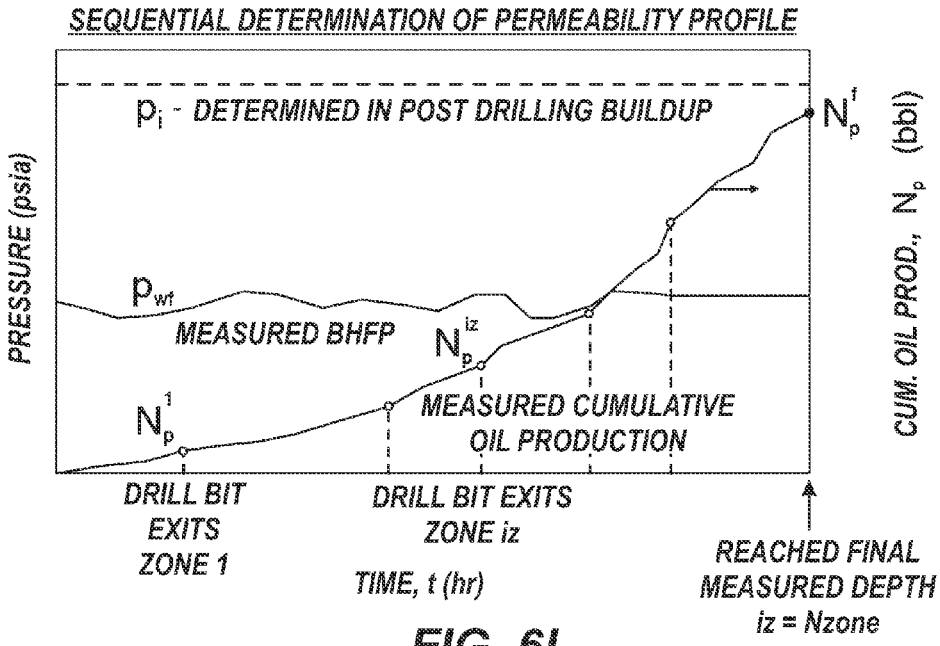
FIG. 6I is a graph showing sequential determination of permeability profile based on a zonation of the system.

A preferred approach is to develop the permeability profile sequentially based on a zonation of the system. Suppose a selection of points on the cumulative flow plot have been identified as shown on FIG. 6I. The reservoir has been partitioned into zones and the times, labeled iz on FIG. 6I, correspond to the drill bit exiting a given zone. The zonation will be based on the surface flow-rate (i.e., kicks in flow will indicate high permeability zones and decreasing flow-rates will indicate tight regions). The cumulative flow from the first zone is designated $N_p^1$, and the average permeability of the zone can be found by adjusting $\bar{k}^1$ until $f(\bar{k}^1)=(N_{pred}^1 - N_{meas}^1)=0$. Thus the problem of determining $\bar{k}^1$ has been reduced to the solution of a functional equation in one variable, and a secant method can be used to iterate to a solution. For the second zone of average permeability, $\bar{k}^2$, the functional equation may be written $f(\bar{k}^2)=(N_{pred}^2 - N_{meas}^2)=0$.

In the simulation, using the superposition algorithm to generate $N_{pred}^2$, the permeability of zone 1 is already known, and it is only the permeability of the additional segment which must be determined. This process is repeated until all zones have been identified and a complete permeability distribution has been obtained. At this level the formation pressure, $p_i$, has been treated as uniform (i.e., all zones are at the same potential. This may be determined from a post-drilling buildup.

b. Synthetic Three Zone Problem

In order to demonstrate this procedure, a three-zone problem was set up for analytical simulation. The parameters are the same as the preceding problem but the permeability profile was modified as follows:

TABLE 6.2

Permeability Profile for Three Zone Problem (Entry MD = 7000 ft)

| Measured Depth (ft) | Exit Time (hr) | Permeability (md) | Cumulative Production (bbl) |
|---|---|---|---|
| 7045 | 0.45 | 100 | 775.27 |
| 7055 | 0.55 | 400 | 1246.87 |
| 7100 | 1.0 | 50.0 | 4045.67 |

Figure 6J:
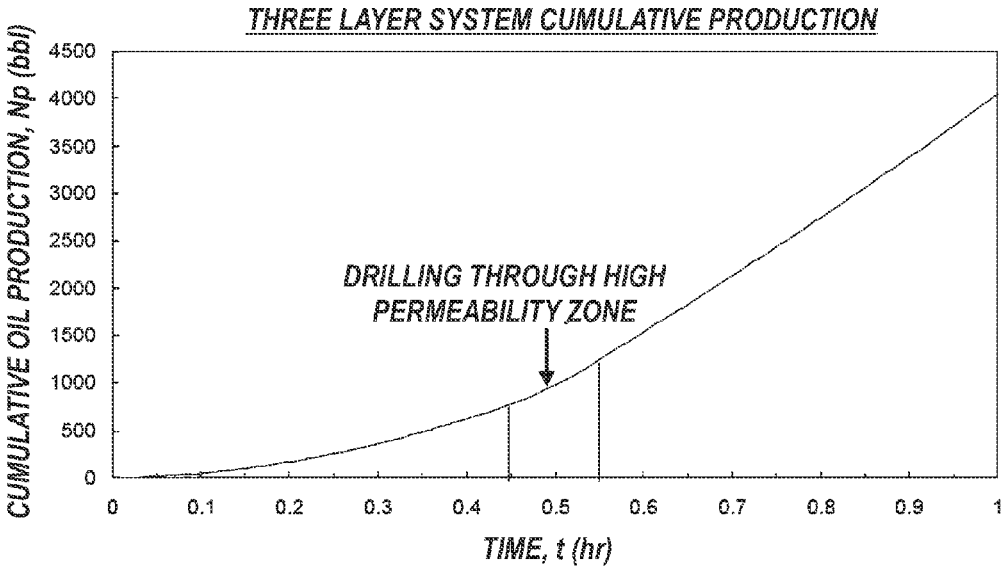
FIG. 6J is a graph of cumulative production for a three layer system.
Figure 6K:
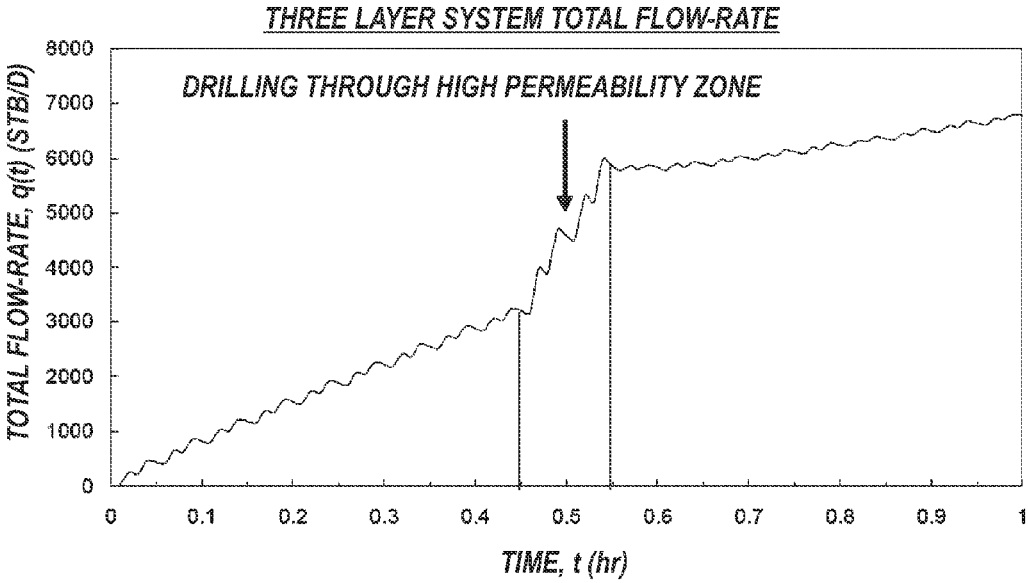
FIG. 6K is a graph of total flow-rate for a three layer system.

The simulation cumulative production at the break-points are listed in Table 6.2, and the full production profile is plotted in FIG. 6J. The cumulative production plot may not be adequate for zonation purposes. In FIG. 6K, the synthetic flow profile is plotted, and the kick due to the 10 ft thick high permeability zone is evident. In this plot, the noise is the steppiness due to the 2.5 ft layering. In real data, the flow profile may be even noisier, but it is still the vehicle for recognizing high or low permeability regions.

If the zonation implied in Table 6.2 is defined and the three simulated cumulative volumes are treated as measured data, then the superposition algorithm, in identification mode, yields the permeabilities shown in the third column of Table 6.2. The secant method converges the functional equation quickly. For synthetic data, an exact result can be obtained. This demonstrates that the identification process has been correctly coded. If the zonation is ignored and the overall average permeability based on the final cumulative production (i.e., 4045.67 bbl) is determined, the result is 117.17 md. The arithmetic average permeability of the three layer system is 107.5 md, and the value obtained by matching only the final point is somewhat different (i.e., 117.17 md). This discrepancy shows the advantage of the sequential approach in that the arithmetic average of the identified layer permeabilities will be closer to the true formation average permeability given by the post-drilling buildup. The eventual semi-steady-state P.I. of the formation is controlled by this quantity.

In the present case of a vertical well knowledge of the well spacing is required to allow a prediction of $J_{SSS}$ through the equation:

$$J_{SSS} = \frac{2\pi\bar{k}h}{887.2 \times B_o\mu\left(\ln\frac{r_e}{r_w} - \frac{3}{4}\right)} \tag{6.9}$$

For an $r_e$ of 3000 ft, this gives $J_{SSS}$=9.0 in the present case. Because the identification algorithm is based on zero skin, S has been omitted from equation (6.9). Note that the final transient P.I. at the end of a 2 hr period (1 hr drilling, 1 hr production) is 12.2 STB/D/psi, which is considered a considerable overestimate of the eventual stabilized value.

Figure 6L:
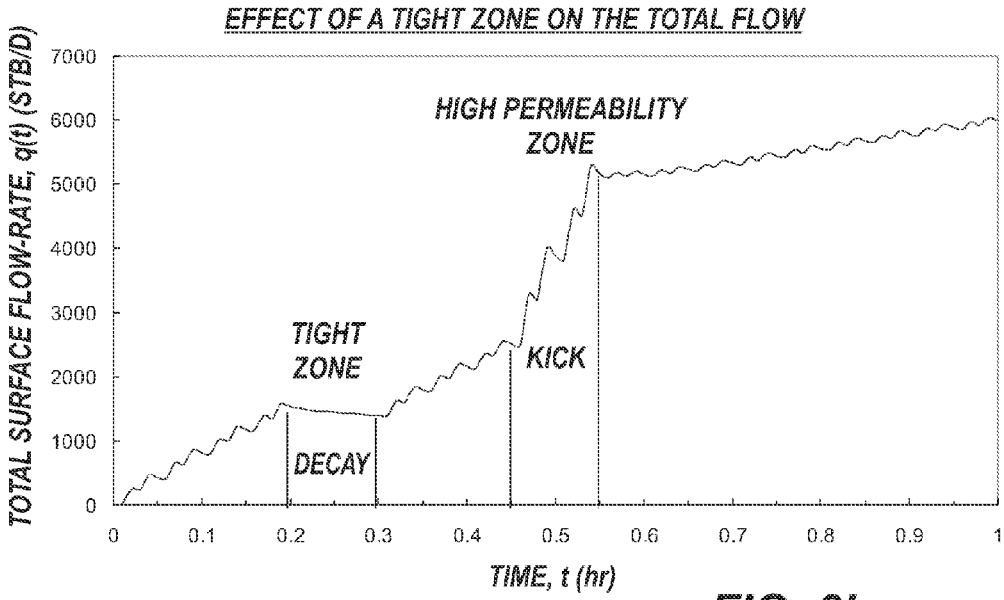
FIG. 6L illustrates a graph showing effect of a tight zone on the total flow.

The effect of a tight zone (7020-7030 ft MD) is illustrated in FIG. 6L where a decay in the total surface flow is evident. Thus, the two major types of heterogeneity have distinctive fingerprints that can be recognized in the flow-rate data. The zonation scheme should single out such events, and the matching algorithm will determine the appropriate permeabilities. It is also possible to devise a tight zone detection based on cumulative flow. The actual measured cumulative flow at the end of the penetration is compared to the cumulative flow assuming the last zone is completely impermeable. If the difference (i.e., the incremental contribution of the last zone drilled) is less than a certain minimum value, then the zone is classified as non-pay. This approach preferably includes inspection of the logs for petrophysical non-pay indication. The threshold for net pay depends on the error in rate measurement.

7. Distributed Pressure Situation

Figure 7A:
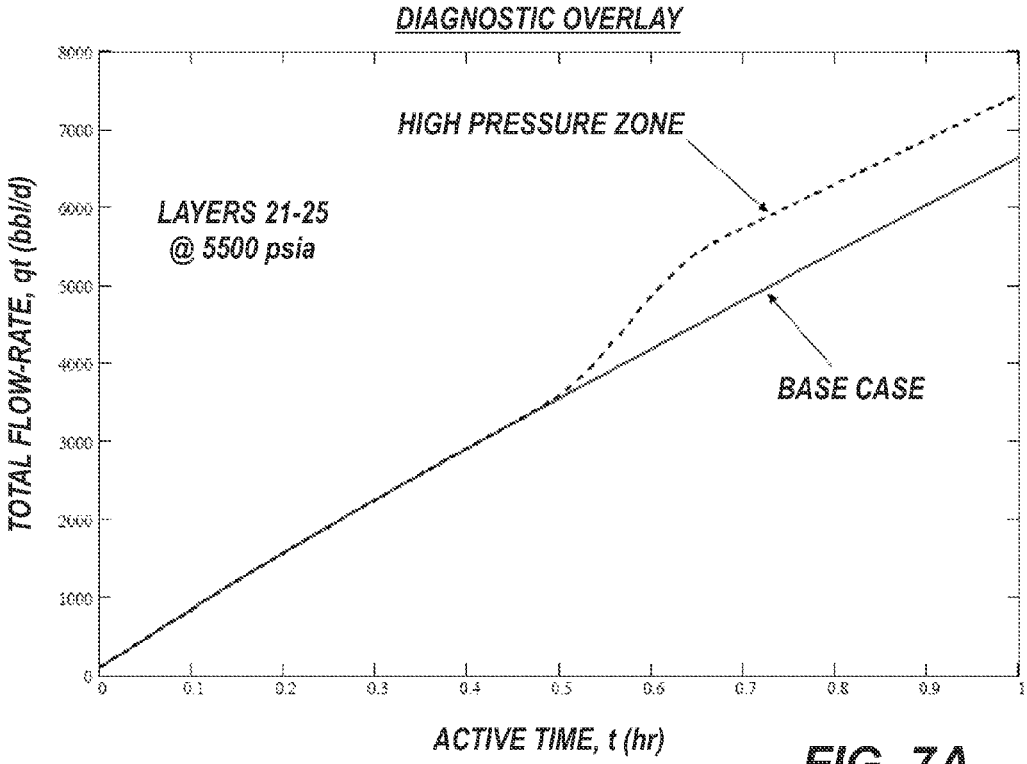
FIG. 7A is a graph of a resultant smoothed flow response of a first case overlain on a base case of uniform initial pressure.
Figure 7B:
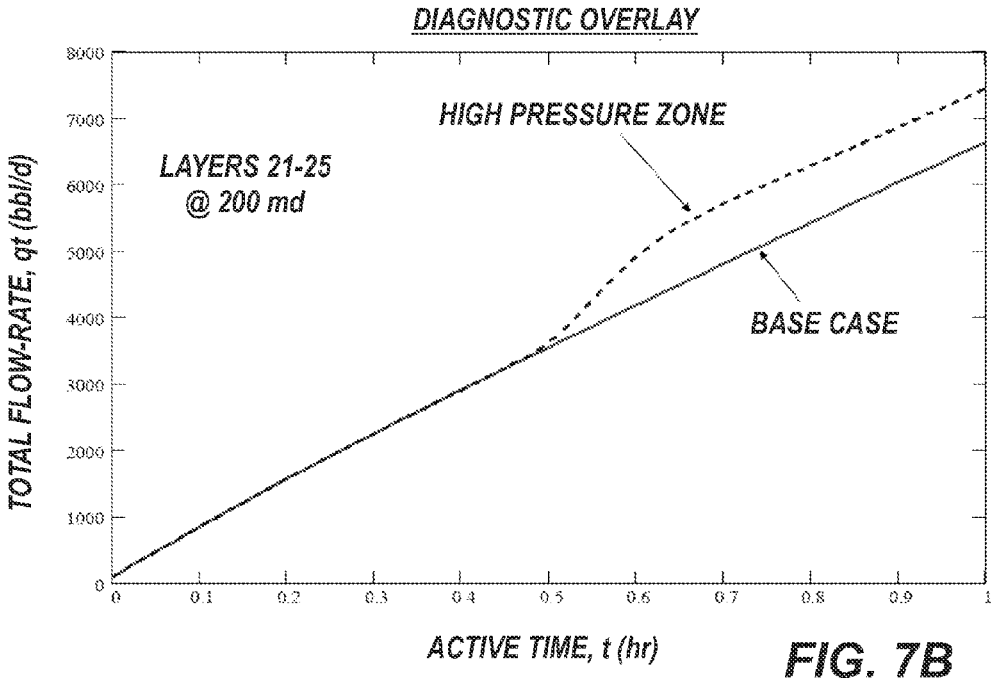
FIG. 7B is a graph of a resultant smoothed flow response of a second case overlain on a base case of uniform initial pressure.

One issue in underbalanced drilling is the detection of zones with high permeability or high pressure. To examine the latter case of high pressure, the initial pressure in layers 21-25 (out of 40) of the simulation was increased to 5500 psia (i.e., the drawdown was locally doubled). The resultant smoothed flow response is shown in FIG. 7A overlain on the base case of uniform initial pressure. There is a resultant "kick" in the flow-rate as the high pressure layers are penetrated. This overlay on the base case (uniform permeability and pressure) is a useful diagnostic plot for the detection of heterogeneity akin to the derivative log-log plot used in classical well test interpretation. A second additional case where the permeability of layers 21-25 was increased to 200 md in the simulation was then run with the result shown in FIG. 7B. The results in FIG. 7B are practically indistinguishable from FIG. 7A. This illustrates that the effect of varying permeability and pressure may not be separable in a constant bottom-hole pressure survey. This is one of the difficulties in testing while drilling. If the zone pressures are known independently, the problem is resolved but in many circumstances this will not be the case.

Figure 7C:
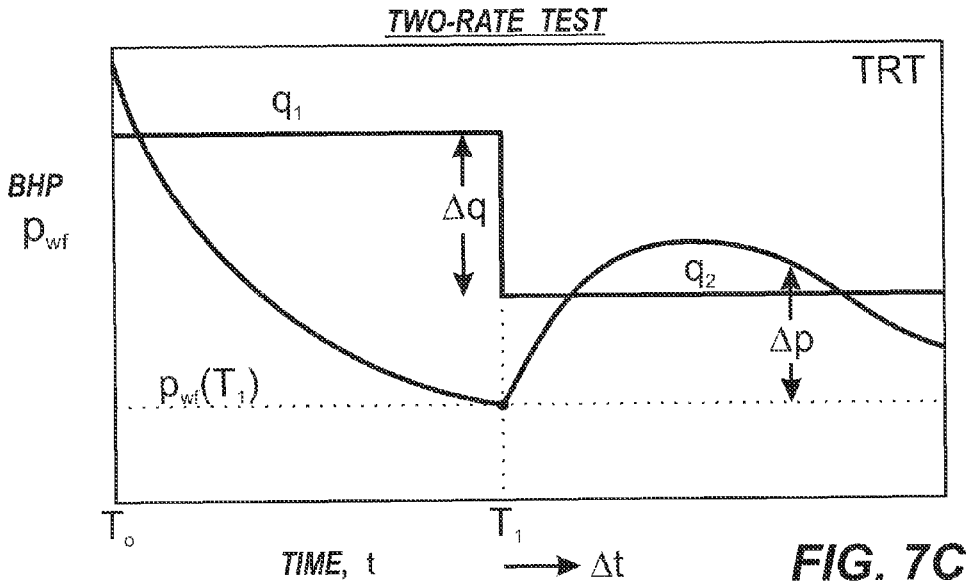
FIG. 7C is a graph of a two-rate test.
Figure 7D:
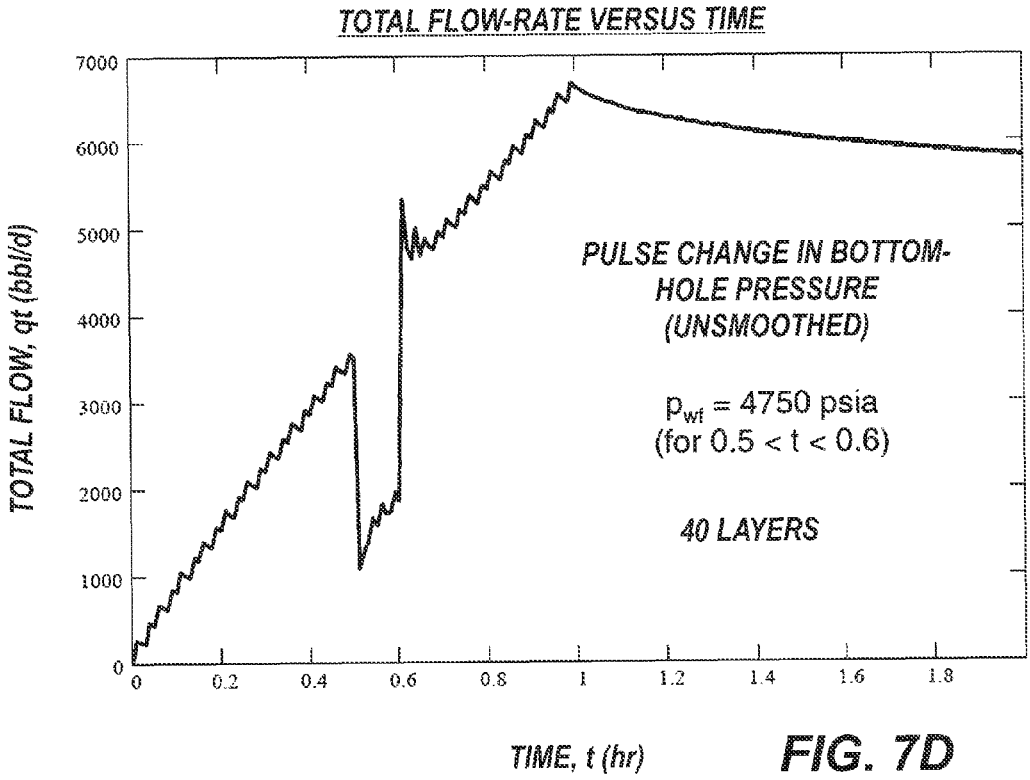
FIG. 7D is a graph of total flow-rate versus time for a case where $p_{wf}$ is increased to 4750 psia for a short period.
Figure 7E:
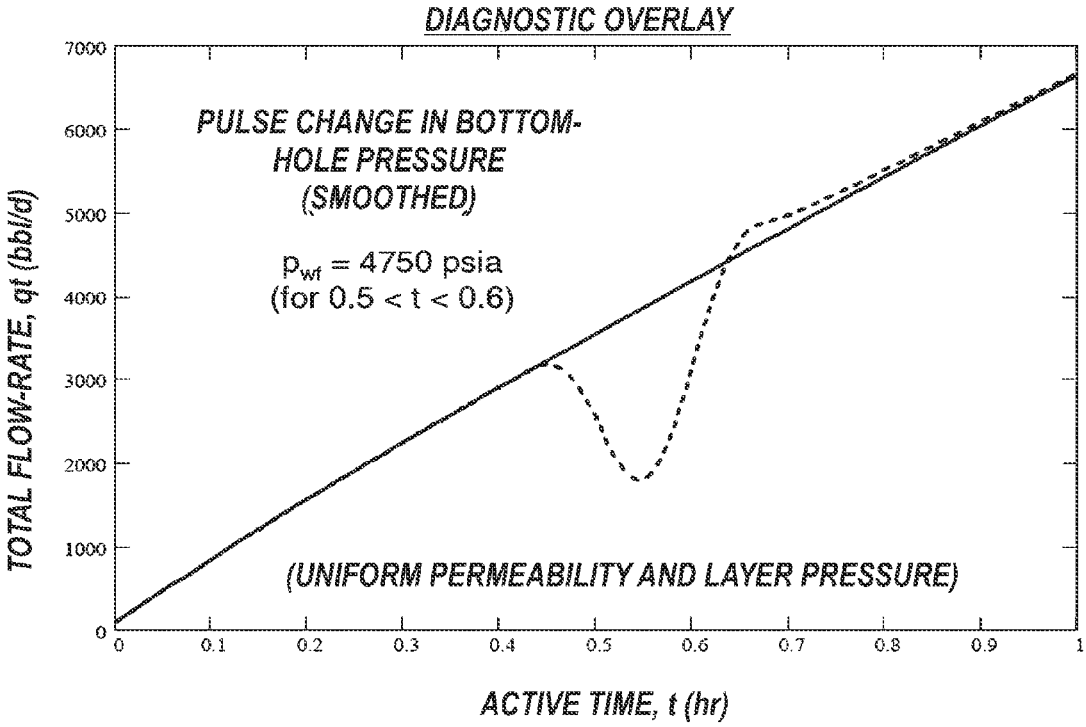
FIG. 7E is a graph of a diagnostic overlay.

In conventional well testing, the combination of a drawdown and a buildup is sufficient to resolve the determination of both permeability and pressure. It may not be necessary to have a shut-in period to detect both parameters. Instead, a change in rate and the two-rate test illustrated in FIG. 7C can yield permeability and pressure. The analogue for UBD is a step change in the flowing bottom-hole pressure (i.e., level of underbalance). FIG. 7D shows the raw (unsmoothed) rate transient for the case where $p_{wf}$ is increased to 4750 psia for a short period. The smoothed data is shown in FIG. 7E, which shows that a generalized smoothing approach may be questionable when pulse changes are present.

Figure 7F:
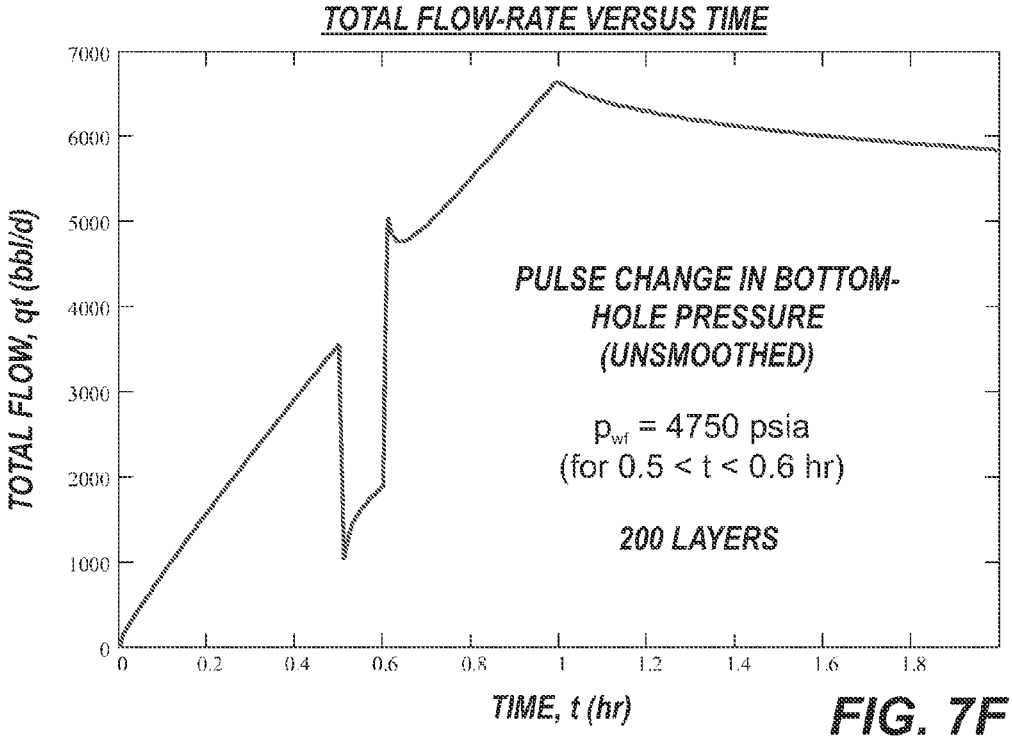
FIG. 7F is a graph of total flow-rate versus time for the analytical simulation repeated for a 200 layer division.

The role of numerical simulation now becomes an issue as this is one way of checking the true behavior when the degree of underbalance is changed for a short period. The analytical simulation was repeated for a 200 layer division with the unsmoothed result shown in FIG. 7F. The level of discretisation is now such that smoothing is not necessary. The converged response to the pulse change in underbalance (i.e., FIG. 7F) is quite different in character from the smoothed response of the 40 layer simulation given in FIG. 7E. Hence, smoothing is preferably rejected in favor of a large number of layers. However, it may not be possible to determine the permeability individually on such a fine basis, and the layers (properly referred to as sub-layers) may need to be considered in groups from the point of view of parameter estimation. Since the layer model is quite simple (i.e., infinite-acting radial flow of equation 6.6), there may be no problem computationally in having a fine structure.

Figure 7G:
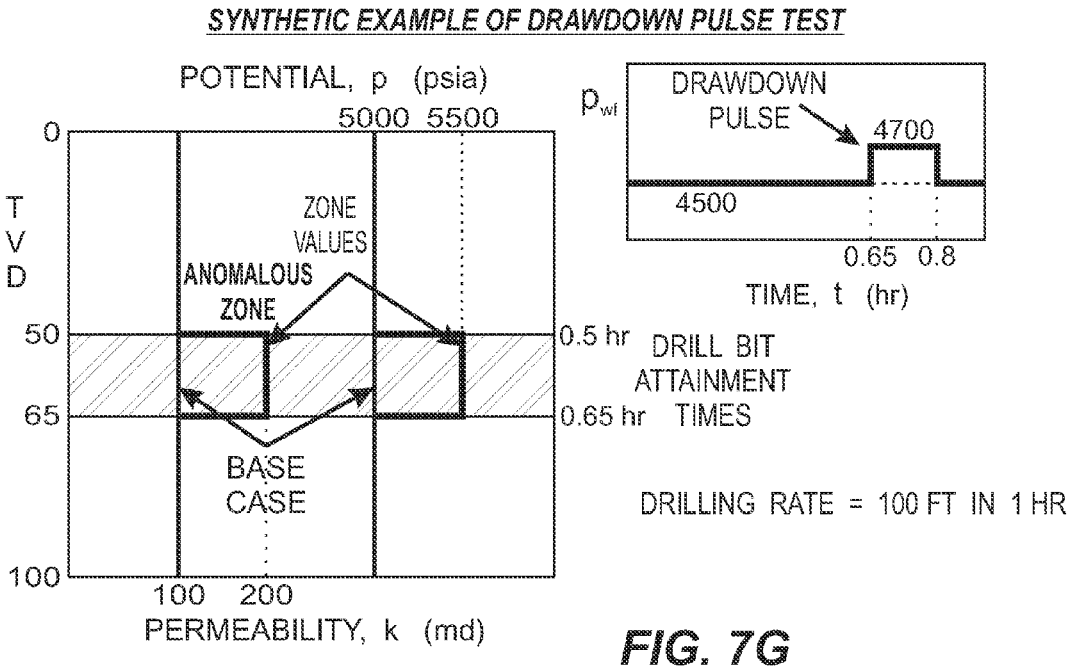
FIG. 7G illustrates a synthetic example of a drawdown pulse test.
Figure 7H:
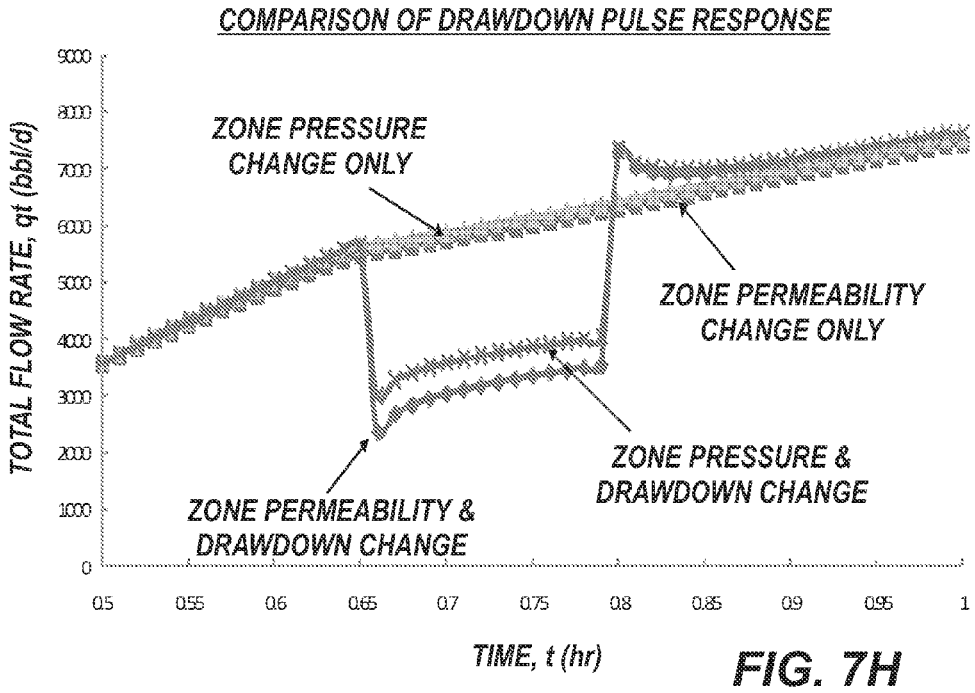
FIG. 7H is a graph comparing drawdown pulse responses.

It has already been demonstrated that the transient rate response of a layer of high permeability is almost identical to that of a layer of high pressure. A synthetic example was set up, as shown in FIG. 7G, with a 15 ft zone either at high permeability or at high pressure. The lack of uniqueness is illustrated again in FIG. 7H where the response of a zone of 200 md and is overlain on the response of a zone at 5500 psia. The remainder of the interval has k=100 md and $p_i$=5000 psia. The "kick" in the flow profile is almost identical, and a nonlinear regression on the data sets would find it difficult to tie down the exact properties of the zone between 50 ft and 65 ft.

The proposed strategy to resolve this issue is to initiate a change in the drawdown if such a kick is detected. In this case, a change in Δp from the base value of 500 psi to 300 psi is introduced for a limited time period (0.65-0.8 hr), and the resultant responses for the two cases are also plotted in FIG. 7H. As shown, the responses separate. Therefore, a regression analysis of the responses has the possibility of identifying the nature of the anomalous zone. As a result, the disclosed system and method can determine zone pressures, which is not only useful for predicting well inflow performance relation but is also of interest in controlling the underbalance during drilling.

Figure 7I:
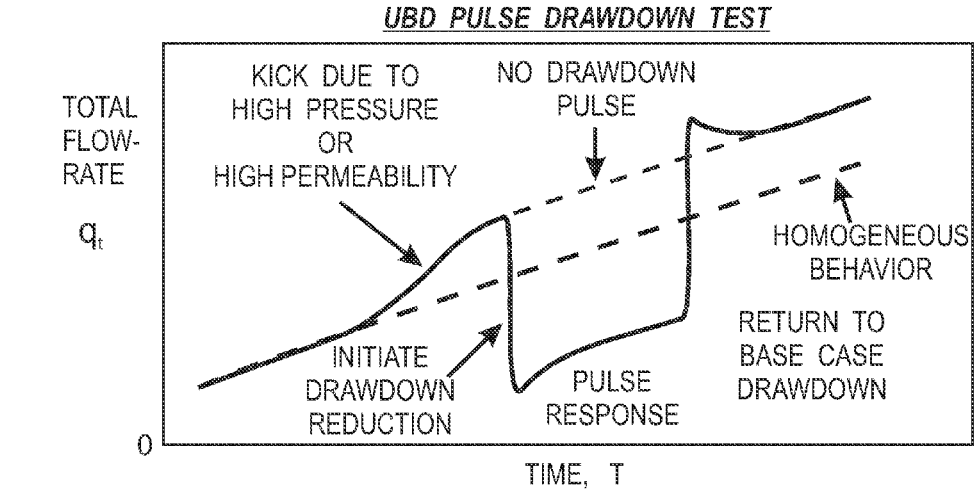
FIG. 7I is a graph a UBD pulse drawdown test.
Figure 7J:
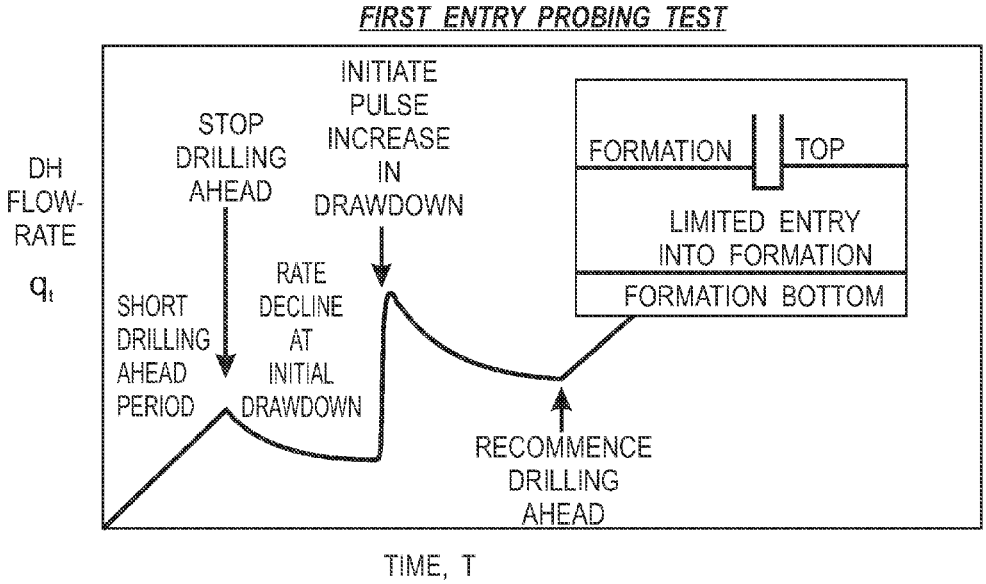
FIG. 7J is a graph of a first entry probing test.

The concept of a drawdown pulse test is summarized in FIG. 7I, while FIG. 7J is a graph of a first entry probing test. In FIG. 7I, the change in underbalance (Δp) is preferably not so large that a negative rate excursion takes place. However, it is preferably large enough that the difference in rate response between the two possibilities—high permeability or high zone pressure—is detectable within the limits of the resolution of the rate measurement. The object of the nonlinear regression is to determine four parameters—the permeability and pressure of the main formation and the permeability and pressure of the anomalous zone.

For the simulation's layers, the horizontal permeability distribution can be denoted k where:

$$k=(k_l, \ldots k_j, \ldots k_N)^T \tag{7.10}$$

Figure 7K:
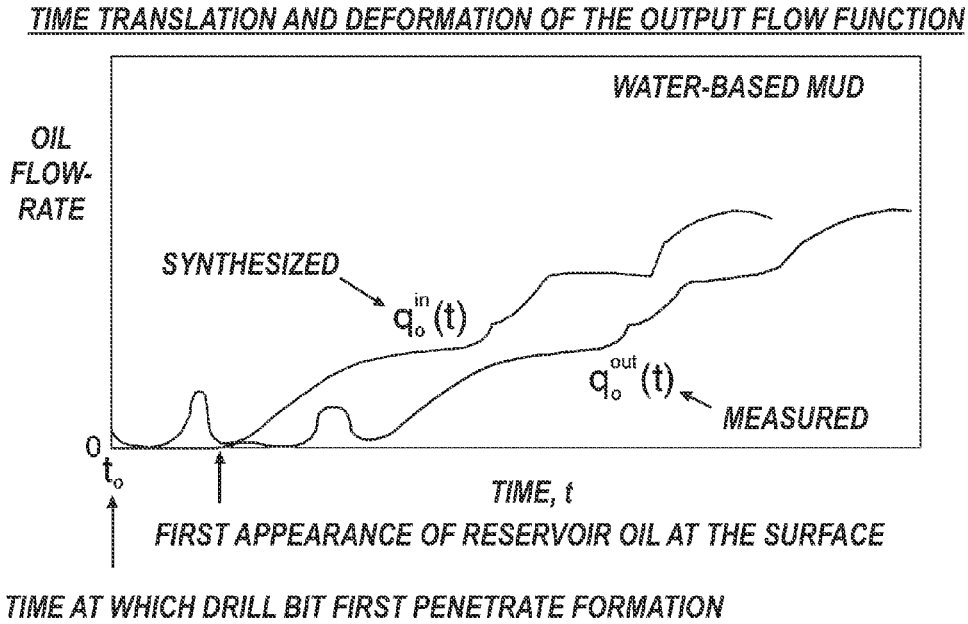
FIG. 7K is a graph of time translation and deformation of the output flow function.

Thus given the measured pressure response, $p_w(t)$, the assumed pressure distribution, $p_j^i$, and a trial permeability distribution, k, the convolution model can be used to predict the varying total well flow, $q_p(t)$, on an in-situ basis. Suppose now a wellbore transient model is available which will allow a reconstruction of the down-hole flow history, denoted $q_m(t)$ illustrated in FIG. 7K (where it is labeled $q^{in}{}_O(t)$), from measured surface flow-rates of produced oil, produced gas and injected gas then the determination of the permeability distribution can be regarded as a problem in nonlinear estimation (i.e., find k) such that:

$$\chi^2 = \sum_{i=1}^{N} \left( \frac{y_i - y(x_i:k)}{\sigma_i} \right)^2 \tag{7.11}$$

is a minimum where:

$$y_i = q_m(t_i)\ y(x_i:k) = q_m(t_i)$$

The nonlinear regression algorithms for a sum of squares objective function, such as Levenberg-Marquardt or modern equivalents, can be used to search for a permeability distribution which brings the predicted flow profile as close as possible to the measured one.

The term "flow profile" used here in the context of underbalanced drilling is not the same as the cumulative one obtained by running a production log in a flowing well. Rather, the increasing flow as more formation is contacted constitutes a progressive flow profile which reflects the permeability (and pressure) distribution. The summation over the currently active layers expressed in equation (6.5) defines the nature of the progressive flow profile, q(t).

Figure 7L:
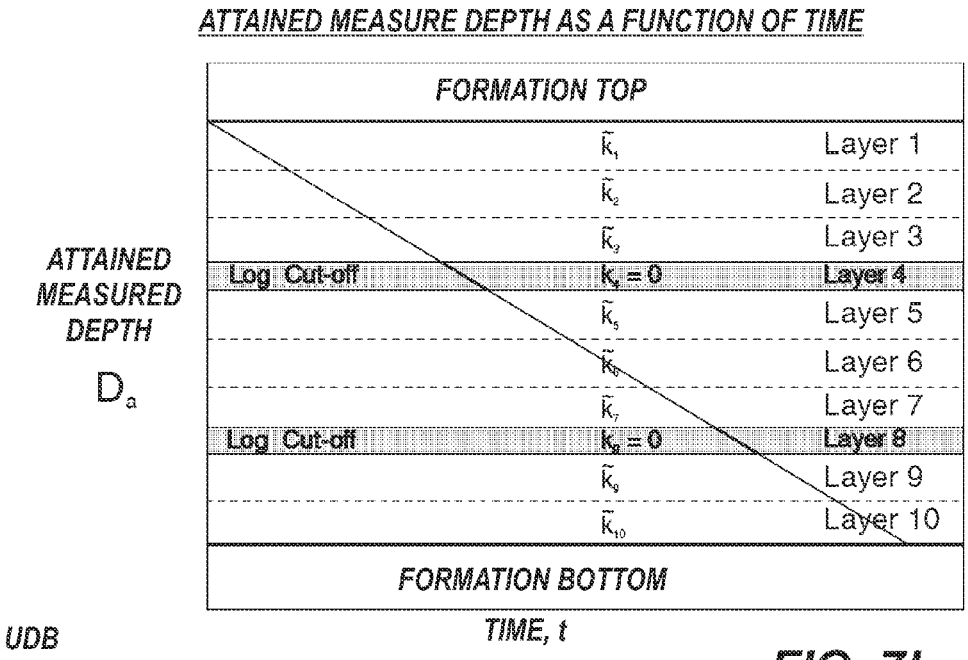
FIG. 7L illustrates attained measured depth as a function of time.

Another useful piece of data in UBD is the attained measured depth as a function of time, illustrated in FIG. 7L. Presuming that logs are being run on drillpipe, the inactive zones defined by the log cut-offs on $V_{sh}$ and $S_w$ are also marked on FIG. 7L, and the permeability of these layers is forced to zero. An estimate of the hydraulic average permeability, denoted $\tilde{k}_j$, of the remaining layers can be computed from a log permeability transform (e.g., the Timur correlation):

$$k = 10{,}000\frac{\phi^{4.5}}{S_{wc}^2} \tag{7.12}$$

In this approach, equation (7.12) is used to predict the permeability from the logs on a foot-by-foot (or half-foot) basis and the arithmetic average taken over the thickness of the layer in question. This defines the hydraulic average of the layer, $\tilde{k}_j$. Since the Levenberg-Marquardt and related algorithms are Newton methods, starting values for the layer permeabilities, $k_j$, are required, and the computed $\tilde{k}_j$ are a good choice.

If a well is being drilled underbalance, it is not possible to run a formation tester, either on wireline or drillpipe, to determine the static pressure profile, $p_j^i$. Once the well is cased, it would be possible to run a cased hole formation tester, such as the CHDT of Schlumberger, to measure the pressure distribution. However, cost will often mitigate against this.

Figure 7M:
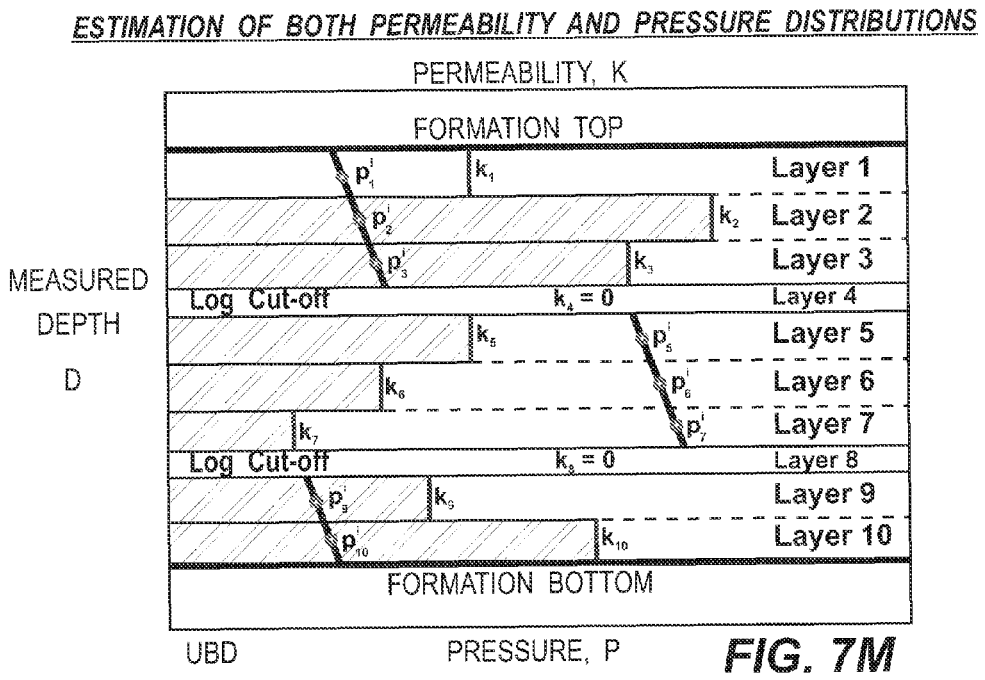
FIG. 7M illustrates estimation of both permeability and pressure distributions.

One target of underbalance drilling is differentially depleted reservoirs where some zones may be at quite low pressure. In this case, the objective is to determine both the permeability distribution, $k_j$, and the pressure distribution, $p_j^i$ as shown schematically in the model of FIG. 7M. In the example shown, there are only three unknown pressures since layers 1, 2 and 3, layers 5 and 6, and layers 9 and 10 are at vertical pressure equilibrium because of communication. The strong barriers (i.e., layers 4 and 5) are necessary to sustain appreciable pressure (potential) differences during depletion. The vector of unknown parameters to be fixed by nonlinear regression becomes:

$$a=(k_1, k_2, k_3, k_5, k_6, k_7, k_9, k_{10}, P_{1,2,3}, P_{5,6,7}, P_{9,10}) \tag{7.13}$$

so that there are a total of 11 variables. Because the problem of combined permeability and pressure estimation is difficult, a form of testing is preferably devised that contains significant rate change to allow this process to be successful. A period of zero or low flow following penetration of layers 3, 7 and 10 is one possibility, giving rise to something akin to build-ups for pressure detection. Decreasing the underbalance until a zone essentially stops flowing is a way of determining pressure. Here, a zone is taken to mean a group of layers at the same potential.

Synthetic Five Zone Problem

The problem of determining both the pressure and the permeability of a zone has been formulated in terms of nonlinear regression in two variables. In order to test the efficacy of the Levenberg-Marquardt algorithm, a synthetic test problem involving five zones in a vertical well was set up with the permeabilities and measured depths shown in Table 7.3 below.

TABLE 7.3

Permeability and Pressure Profile for Test Problem

| Start of Zone | Measured Depth (TVD ft) | Time (hr) | Permeability (md) | Pressure (psia) |
|---|---|---|---|---|
| 1 | 7000 | 0.0 | | |
| 2 | 7020 | 0.2 | 100.0 | 5000.0 |
| 3 | 7030 | 0.3 | 1.0 | 5000.0 |
| 4 | 7045 | 0.45 | 100.0 | 5000.0 |
| 5 | 7055 | 0.55 | 400.0 | 5500.0 |
| | 7100 | 1.0 | 50.0 | 5000.0 |

Zone 4 (7045-7055 ft) is a high permeability region also with a high pressure of 5500 psia. In the test problem, the flowing bottom-hole pressure (FBHP) was held constant at 4500 psia except for zone 4 where a $p_{wf}$ disturbance was introduced. For a period of 0.05 hr, period (0.5-0.55 hr) $p_{wf}$ was dropped to 4250 psia to introduce a transient into the rate response. From the simulated surface flow during the period of drilling zone 4 five points were selected for application of the nonlinear regression routine. These are listed below.

TABLE 7.4

Synthetic Flow Data

| Time (hr) | Flow-Rate (bbl/day) |
|---|---|
| 0.47 | 4155.33 |
| 0.49 | 5599.91 |
| 0.51 | 5810.69 |
| 0.53 | 8379.85 |
| 0.55 | 11110.83 |

This data set was chosen as the y-vector in the regression algorithm, and a search was made in the variables k and $p_4^i$ to minimize the $\chi^2$ objective function. From far initial starting values, the Levenberg-Marquardt algorithm converged rapidly to the solution (i.e., 400 md and 5500.0 psia).

In the simulated surface flow data, no disturbance to FBHP i.e. $p_{wf}$=4500 psia occurred throughout the whole test period. In this case, the algorithm did reach an answer of k=427 md and $p_4^i$=5442.9 psia but failed to get the exact solution. This demonstrates the need for a bottom-hole pressure disturbance if it is desired to determine formation pressure. Camparison between the total surface flow over the whole time period for both the base case (uniform FHBP) and the FHBP perturbation case indicates that the perturbation can have a large effect on the flow profile.

In the case of synthetic data, it is expected that the search algorithm will retrieve the exact parameter values input into the simulation used to generate the flow response. In the case of field data, the values will be subject to measurement error and this will affect the parameter estimation. Since flow measurement, as opposed to pressure measurement, is subject to quite severe measurement error, this effect is preferably assessed and accounted for. This can be achieved by adding random noise to the simulation result such that:

$$q_m(t_i)=q_m^*(t_i)(1+\delta\times RAN) \tag{7.14}$$

where: $q_m^*$=perfect flow generated by simulation $q_m(t_i)$=flow data with added noise $\delta$=fractional error in flow measurement RAN=random number in the range $-1 \leqq RAN \leqq +1$ This procedure was followed for the estimation of the permeability and pressure of zone 4 in the previous problem with the following results:

TABLE 7.5

Effect of Flow Measurement Error on Estimated Parameters

| Fractional Error δ | Estimated Permeability k (md) | Estimated Pressure $p_4^i$ (psia) |
|---|---|---|
| 0.0 | 400.0 | 5500.0 |
| 0.01 | 413 md | 5469 |
| 0.05 | 464.9 | 5361 |
| 0.1 | 531 | 5253 |

The effect of random measurement error is to give an increased permeability and a reduced pressure. In each case, the starting values for the nonlinear regression were 5000.0 psia and 350 md. This result demonstrates that a good rate measurement is preferred if the objective is to determine formation pressure. A value of δ of the order of 0.01 (i.e., 1%) is ostensibly required to give a concomitant pressure error of 0.5%. A value of δ of the order of 0.05 (5%) is perhaps achievable in the field which may lead to an error in estimated pressure of the order of 140 psi (2.5%).

The effect of error in cumulative flow when only permeability is being investigated is shown in Table 7.6 below for the five zone problem.

TABLE 7.6

Effect of Error in Cumulative Flow

| Fractional Error δ | Zone 1 k (md) | Zone 2 k (md) | Zone 3 k (md) | Zone 4 k (md) | Zone 5 k (md) |
|---|---|---|---|---|---|
| 0 | 100.0 | 1.0 | 100.0 | 400.0 | 50.0 |
| 0.01 | 99.54 (0.46%) | 4.96 (396%) | 86.34 (13.7%) | 434.1 (8.51%) | 34.76 (30.5%) |
| 0.05 | 97.73 (2.27%) | 24.94 (2394%) | 33.47 (66.5%) | 572.8 (43%) | — |
| 0.1 | 95.46 (4.5%) | 53.32 | — | — | — |

In this case, the error in estimated permeability becomes larger as the calculation proceeds from zone to zone. Uncertainty in earlier zones has a large influence on the calculated permeability of later ones (i.e., the error is cumulative in this mode). This can be so large that the iteration cannot converge, and no permeability estimate is possible. It is particularly the detection of tight zones which is affected by cumulative flow error.

8. Limited Entry Model

Figure 8A:
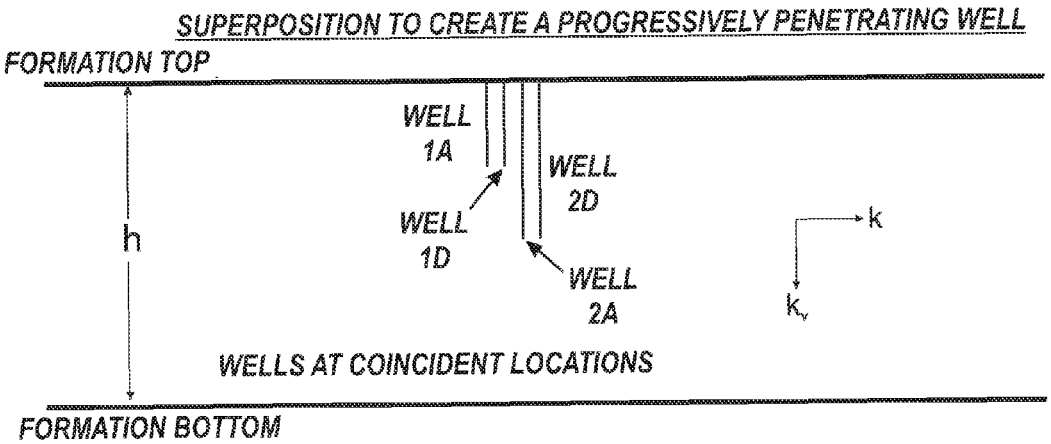
FIG. 8A illustrates superposition procedure to create a progressively penetrating well.
Figure 8B:
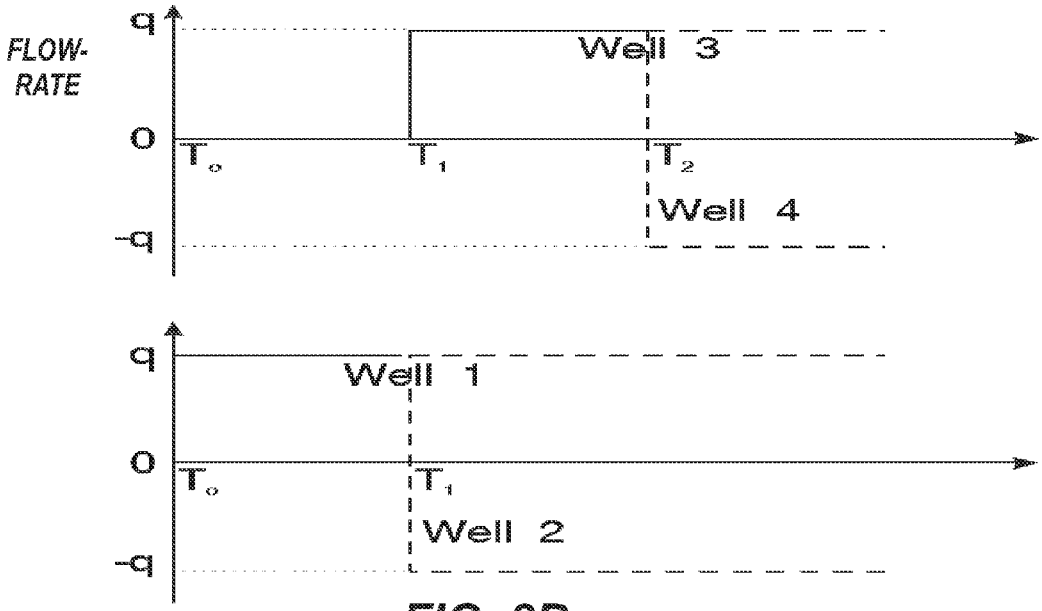
FIG. 8B illustrates flow-rate schedules.

The non-communicating layer model described above is applicable when vertical communication is negligible (i.e., there is low vertical permeability). This will be the case in many sandstone reservoirs that are highly anisotropic, particularly if shale laminations are present. The layer model is useful since it allows the determination of a permeability distribution. An alternative limiting case is the limited entry model for a homogeneous reservoir with the added complication of the progressive penetration in the UBD situation. This effect can be handled by a special superposition procedure illustrated in FIG. 8A. Here, four wells are located at coincident position and well 1A—an active well flowing at rate, q,—is started at time, $T_0$. This well has a perforated interval, $h_p^1$. At time, $T_1$, a second active well, denoted 2A, with a larger penetration, $h_p^2$, is started also at rate, q. To remove the influence of the first well, a third de-superposition well, denoted 1D, and flowing at −q is also started at time, $T_1$. The rate schedules are shown in FIG. 8B where the total rate is +q in both time periods, $T_0$-$T_1$ and $T_1$-$T_2$. During the first period, only well 1A is flowing, and the bottom-hole pressure is given by the expression:

$$p_{wf}(t) = p_i - \frac{q\mu}{2\pi kh} p_D^1(t - T_o) \tag{8.15}$$

Here, $p_D^1$ is a limited entry $p_D$ function for a penetration, $h_p^1$. At time, $T_1$, wells 1D and 2A are set in flow, and the bottom-hole pressure during the second period is given by the three term superposition:

$$p_{wf}(t) = p_i - \frac{q\mu}{2\pi kh}(p_D^1(t - T_o) - p_D^1(t - T_1) + p_D^2(t - T_1)) \tag{8.16}$$

In this case, $p_D^2$ is a limited entry $p_D$ function for an increased penetration, $h_p^2$. The superposition process can be extended for as many penetrations as required, and the constant rate drawdown behavior of a progressively entering well simulated. Suppose now that the total rate is different in the two time periods (i.e., $q_1$ in the first and $q_2$ in the second). The superposition equation then becomes:

$$p_{wf}(t) = p_i - \frac{\mu}{2\pi kh}(q_1 p_D^1(t - T_o) - q_1 p_D^1(t - T_1) + q_2 p_D^2(t - T_1)) \tag{8.17}$$

In the case where the $p_D$ functions are identical (i.e., $p_D^1 = p_D^2 = p_D$) this reduces to:

$$p_{wf}(t) = p_i - \frac{\mu}{2\pi kh}(q_1 p_D(t - T_o) + (q_2 - q_1) p_D(t - T_1)) \tag{8.18}$$

which is the classical two-rate superposition equation derived in Section 6 of the present disclosure. In the form that the rate schedules are presented in FIG. 8B, the total rate is zero for times greater than $T_2$, and this buildup is simulated by:

$$p_{ws}(t) = p_i - \frac{\mu}{2\pi kh} (q_1 p_D^1(t - T_o) - q_1 p_D^1(t - T_1) + q_2 p_D^2(t - T_1) - q_2 p_D^2(t - T_2)) \tag{8.19}$$

For the general situation, where the well progressively penetrates more of the formation, the drawdown superposition equation takes the form of:

$$p_i - p_{wf}(t) = \frac{\mu}{2\pi kh}[q_1[p_D^1(t_D) - p_D^1(t-T_1)_D] + q_2(p_D^2(t-T_1)_D - p_D^2(t-T_2)_D) + q_i(p_D^i(t-T_{i-1})_D - p_D^i(t-T_i)_D) + q_M(p_D^M(t-T_{M-1})_D - p_D^M(t-T_M)_D) + q(t)p_D^{M+1}(t-T_M)_D] \tag{8.20}$$

such that $$p_{wf}(t) = p_i - \frac{\mu}{2\pi kh}\left(\left(\sum_{i=1}^{M} q_i(p_D^i(t-T_{i-1})_D - p_D^i(t-T_i)_D)\right) + q(t)p_D^{M+1}(t-T_M)_D\right)$$

The inner boundary condition for the progressively penetrating well takes the form of:

$$\frac{\partial p}{\partial r}\Big|_{r_w} = \frac{q(t)\mu}{2\pi kh_p(t)r_w} \tag{8.21}$$

where both the rate, q, and the flowing interval, $h_p$, are time dependent quantities. The convolution for this situation takes twice as many $p_D$ function evaluations as in the case where only the rate is varying. One issue with equation (8.20) is that the limited entry $p_D$ function is time-consuming to calculate as it contains a Fourier series that is difficult to converge. This constant rate analytical solution for limited entry takes the form of:

$$p_D^* = \left(-\frac{1}{2}Ei(-u) + s_p(t_D, r_D)\right) \tag{8.22}$$

where $$u = \frac{1}{4t_D}$$

$$\beta = n\pi r_D$$

$$r_D = \frac{r_w}{h}\sqrt{\frac{k_z}{k}}$$

$$s_p(t_D, r_D) = \frac{1}{\pi^2 b^2}\sum_{n=1}^{\infty} R_n w(u, \beta)$$

$$R_n = \frac{1}{n^2}[\sin(n\pi h_{2D}) - \sin(n\pi h_{1D})]^2$$

and the quantity W(u, β)—the leaky aquifer function—is defined as:

$$W(u, \beta) = \int_u^{\infty} \frac{1}{y}\exp\left(-y - \frac{\beta^2}{4y}\right)dy$$

The application of this model to the underbalanced drilling problem only allows an average permeability of the zone to be determined. However, flow from formation ahead of the bit is modeled and, in principle, both the horizontal and vertical components of the permeability can be estimated. Thus, the parameter vector for nonlinear regression is:

$$a = (\bar{k}, \bar{k}_v, p^i) \tag{8.23}$$

Figure 8C:
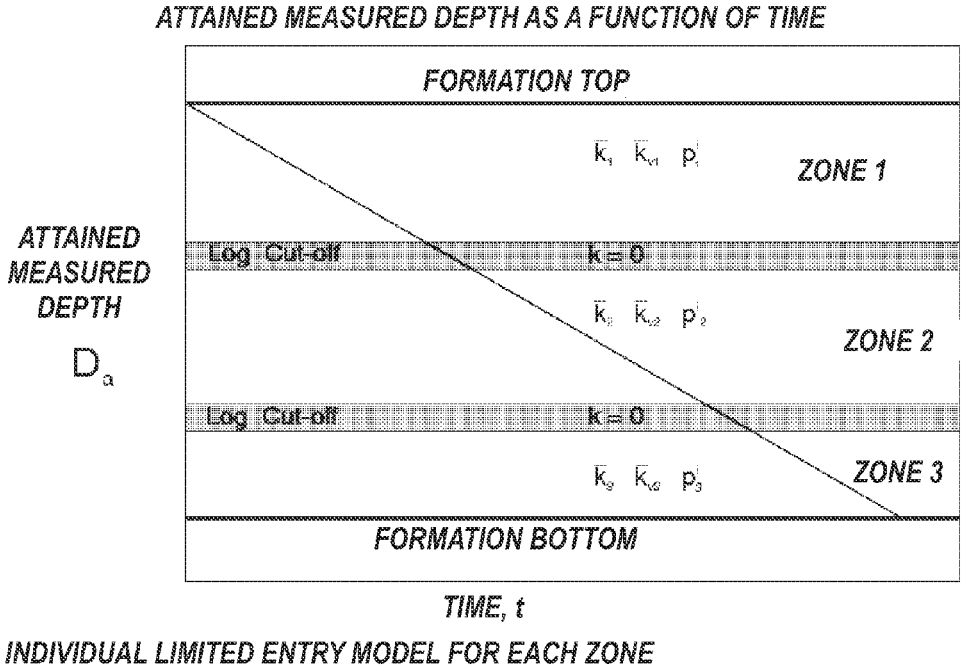
FIG. 8C illustrates attained measured depth as a function of time.

If the logs indicate the presence of barriers to vertical flow, as illustrated in FIG. 8C, then the model can be applied to each zone and the parameter vector becomes:

$$a = (\bar{k}_1, \bar{k}_{v1}, p_1^i, \bar{k}_2, \bar{k}_{v2}, p_2^i, \bar{k}_3, \bar{k}_{v3}, p_3^i) \tag{8.27}$$

Figure 8D:
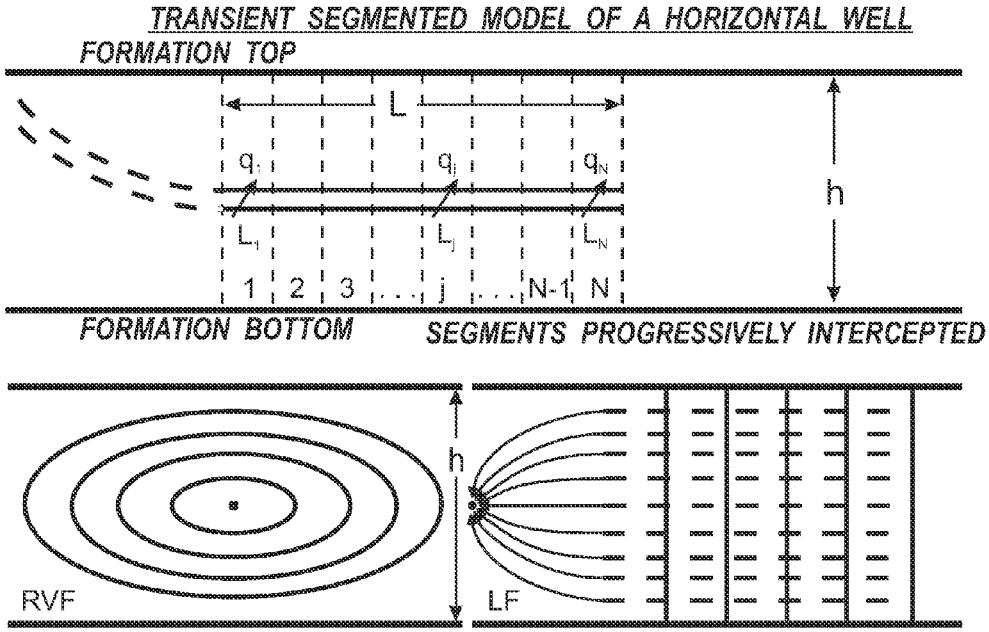
FIG. 8D illustrates a transient segmented model of a horizontal well.

The preceding treatment refers to vertical or slant wells. Now attention will be focused on horizontal wells. As an initial approach, it is possible to consider a sequence of non-communicating segments as illustrated in FIG. 8D. This is the analogue of the non-communicating layer system in the vertical well case. However, the absence of lateral communication is much harder to justify than negligible vertical communication although sub-seismic faulting can lead to such a situation. If each vertical segment flows independently of the others, then a period of radial vertical flow (RVF) will be followed by a period of linear flow with a geometric skin for near wellbore flow convergence as shown in FIG. 8D. During the drilling sequence, the segments are progressively penetrated just as in the vertical well case and each one, again, has a different starting time. The flow-rate for segment, j, is given by equation (6.3) modified for commingled production in a compartmentalized horizontal well such that:

$$q_j(t) = \frac{2p\bar{k}_j L_j(p_j^i - p_w(t))}{\mu p_{DLj}(t_j - T_M)Dj} - \frac{\sum_{i=1}^{M} q_{ij}\left(p_{DLj}(t_j - T_{i-1})_{Dj} - p_{DLj}(t_j - T_i)_{Dj}\right)}{p_{DLj}(t_j - T_M)_{Dj}} \tag{8.25}$$

The $p_D$ function for a horizontal well is defined in terms of the length of connection, $L_j$, and the average permeability, $\bar{k}$, defined for radial vertical flow as:

$$\bar{k} = \sqrt{\bar{k}_y \bar{k}_z} \tag{8.26}$$

Flow in a rectangular segment with a horizontal source exhibits two transient flow regimes as shown in FIG. 8D so that there is radial vertical flow and linear flow with steady-state flow convergence into the line source. In radial vertical flow, existing before the propagating pressure disturbance reaches the formation top and bottom, the constant rate solution to the diffusion equation is:

$$p_{DL} = \frac{(p_i - p_{wf})2\pi\bar{k}L}{q\mu} = \frac{1}{2}\ln\frac{4t_D}{\gamma} + s_e = \frac{1}{2}\ln\frac{4\bar{k}t}{\gamma\phi\mu c_t r_w^2} + s_e \tag{8.27}$$

where $S_e$ is a small negative skin due to distortion of the well shape under the coordinate transformation which handles anisotropy:

$$s_e = -\ln\left(\frac{\sqrt{k_z} + \sqrt{k_y}}{2\sqrt[4]{k_z k_y}}\right) \tag{8.28}$$

Once transient, linear flow is established the dimensionless pressure drop is given by:

$$p_{DL} = \frac{p_{DL}}{A^{\frac{1}{2}}} = 2\sqrt{\pi t_{Dh}} + \frac{s_c + s_e}{A^{\frac{1}{2}}} \tag{8.29}$$

where:

$$s_c = \ln\frac{h}{r_w(1 + A^{\frac{1}{2}})\pi\sin(\pi z_{wD})}$$

The transition between the two flow regimes is handled by an image well summation to represent the effect of the parallel boundaries (i.e., the formation top and bottom). Thus:

$$p_{DL} = \frac{1}{2}\ln\frac{4t_D}{\gamma} + s_e + \frac{1}{2}\sum_{j=1}^{\infty} Ei\left(\frac{\alpha_j}{t_{Dz}}\right) \tag{8.30}$$

The theory of transient production for a segmented horizontal well is identical to that of the non-communicating layered vertical well except the $p_D$ function for pure radial flow is replaced by the $p_{DL}$ function for radial vertical, transition, and linear flow. In the latter case, the nonlinear regression approach leads to a distribution of average permeability, k:

$$k = (\bar{k}_1, \ldots \bar{k}_j, \ldots \bar{k}_N)^T \tag{8.31}$$

Figure 8E:
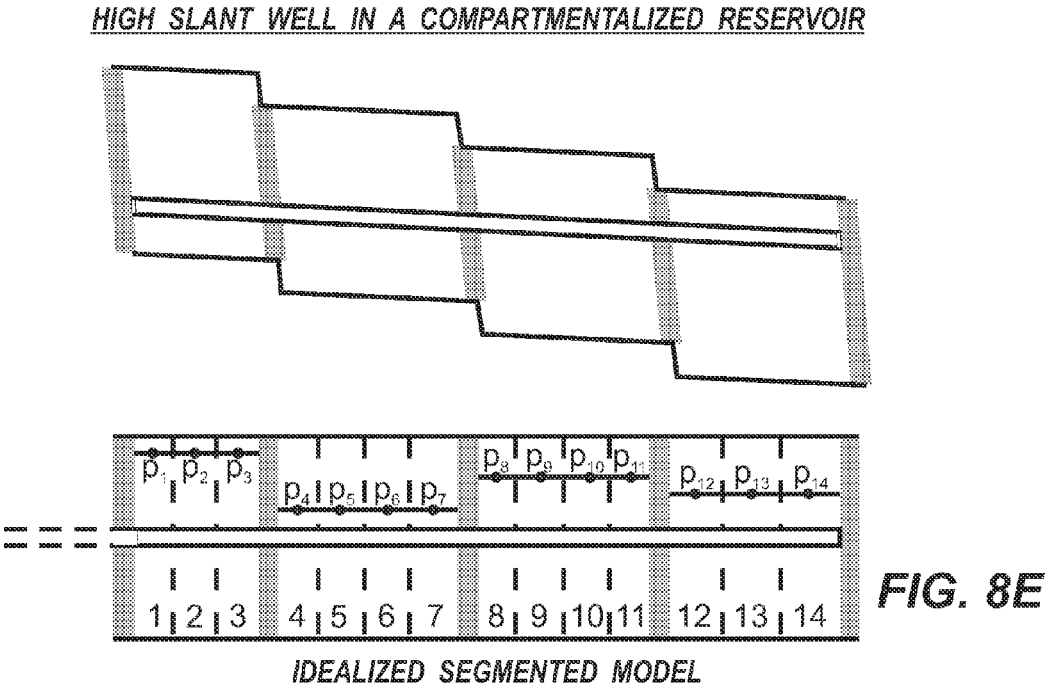
FIG. 8E illustrates a high slant well in a compartmentalized reservoir.
Figure 8F:
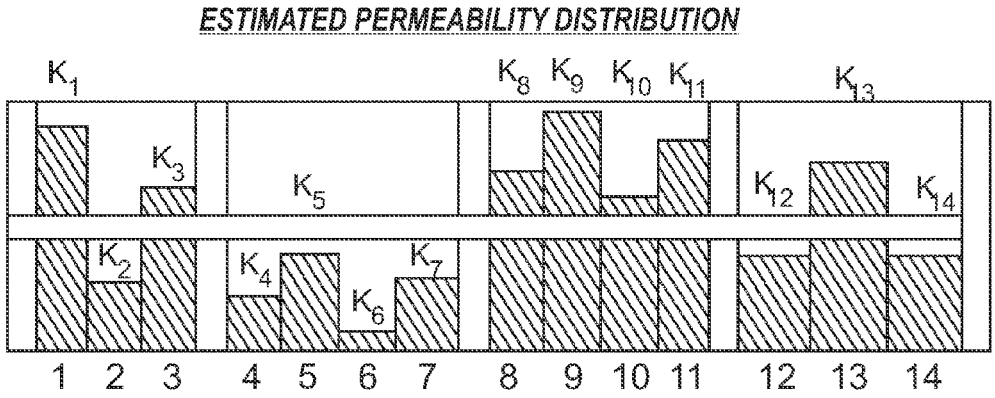
FIG. 8F illustrates estimated permeability distribution.

Again, the problem is much simpler if the compartment pressure distribution, $p_j^i$, is known. The assumption that the pressure is uniform is more tenable in the horizontal well case. A more realistic scenario is shown in FIG. 8E where a high slant well penetrates several compartments generated by sub-seismic faulting. The fault blocks have depleted to different pressures and the situation is analogous to the zoned vertical system as shown. In addition to the 14 segment permeabilities, four compartment pressures may have to be identified in the nonlinear regression process. The estimated permeability distribution is illustrated diagrammatically in FIG. 8F.

Figure 8G:
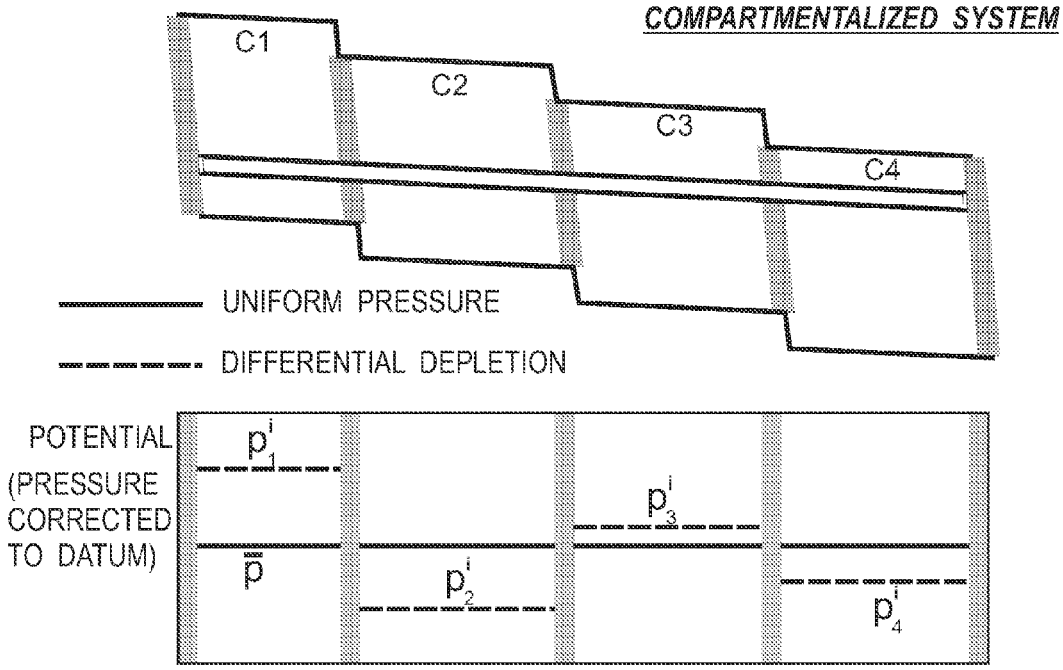
FIG. 8G illustrates a compartmentalized system.

The analysis of UBD data is difficult when the reservoir (compartments or zones) is differentially depleted and there is a pressure distribution as well as a permeability distribution. However, in many cases, the reservoir is at a uniform pressure, $p^i$, which may be determined in a post-drilling buildup. These two cases are illustrated in FIG. 8G where the uniform pressure has been denoted $\bar{p}$. It is then possible to compute the permeability profile with $p^i$ or $\bar{p}$ taken as known. Such a profile—based on the assumption of zero skin and uniform deep reservoir pressure—will be referred to as proximate. This can be readily obtain and can be the first step in any UBD data analysis.

Figure 8H:
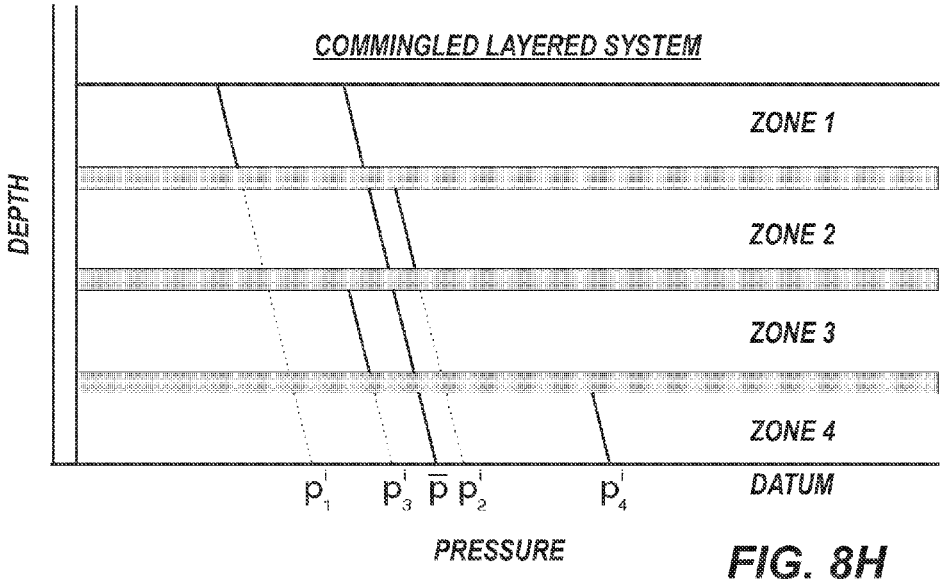
FIG. 8H illustrates a commingled layered system.

The corresponding situation for a vertical well is depicted in FIG. 8H. In this case, the average permeability is still given by the slope of the semilog plot even when crossflow through the wellbore is occurring during the buildup. The ideas for determining zone or compartment pressures developed here for UBD are descended from the techniques for layered well testing using production logging surveys to measure the flow distribution. When a buildup is carried out in a well exhibiting a pressure distribution, the intercept on the semilog (Homer) plot yields the P.I. weighted average of the individual zone pressures such that:

$$p^{**} = \bar{p} = \frac{\sum_{j=1}^{NL} J_j p_j^i}{\sum_{j=1}^{NL} J_j} \tag{8.32}$$

9. Field Data

The theoretical basis for the analysis of UBD data in terms of permeability profile and formation pressure has been described in the preceding section of the present disclosure. We next examine field data and determine some practical possibilities. The analysis methods depend on good rate measurement, and the issue of error in the downhole rate channel must be addressed. The uncertainty in $q_{so}^{in}(t)$ arises from two sources—the error in measuring the surface rate $q_{so}^{out}(t)$ and the error in the virtual flowmeter generating $q_{so}^{in}(t)$. It is expected that the error in measurement at the surface will dominate and impose a practical limit on what can be achieved.

Figure 9:
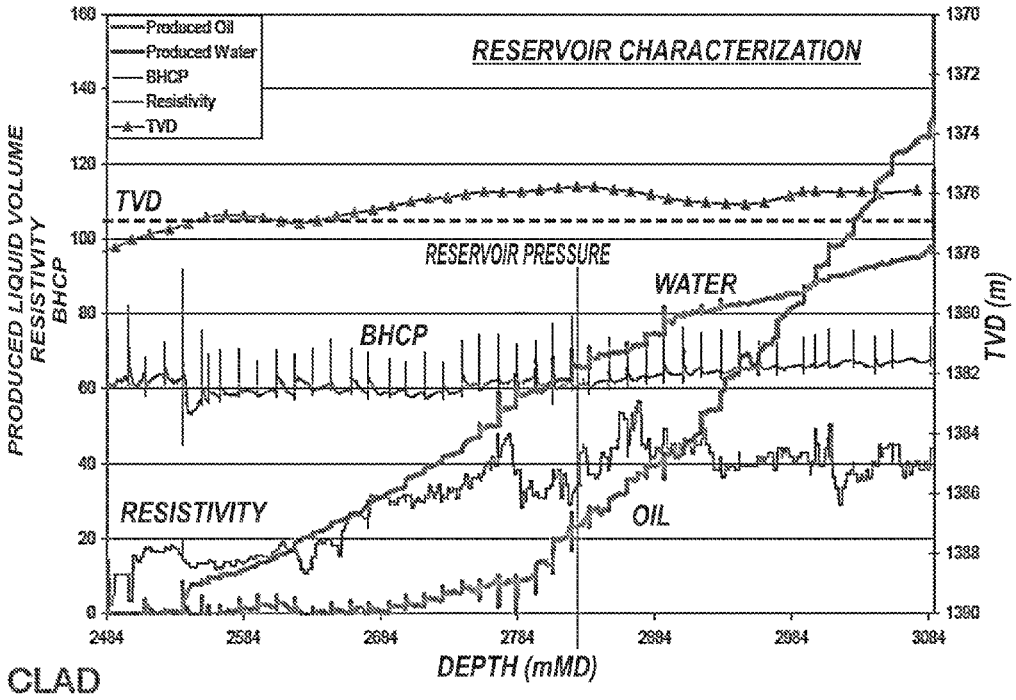
FIG. 9 is a graph of reservoir characterization from field data of a well.

A typical set of field data from a well in Canada is shown in FIG. 9 where the reservoir pressure, $p^i$, is marked as a dotted line. In most UBD operations at the present time, this pressure is inferred from neighbouring wells and is not directly measured. The data sets generated by the drilling contractor do not usually include a post-drilling buildup, which would allow the formation pressure to be directly measured. Accordingly, a conscious effort to obtain this data is preferably made, and these tests may well often indicate the negative skin due to near wellbore fracturing.

The measured bottomhole pressure is indicated by the legend "BHCP." The effect of pipe connections on the pressure can be determined from this data. Each time circulation is stopped to connect a stand, there is a pressure disturbance. The time period in which the circulation rate is zero is of the order of 15 minutes. The well is still underbalanced, and the formation will continue to flow into the wellbore leading to holdup changes. When circulation is re-commenced, the bottomhole pressure is re-established. In the data plot, the cumulative oil production is presented, and this exhibits significant noise. Consequently, the flow-rate, $q_{so}^{out}(t)$, which is the derivative of cumulative volume, will likely be even noisier. In this situation, where holdup transients are important, OLGA is preferably used to assess the wellbore storage implications.

10. Final Buildup

The analysis of the data gathered while drilling ahead produces a permeability profile for the formation assuming the skin is zero. Preferably, the well is shut-in for a buildup after it has produced for some time so that the average permeability can be determined from the slope of a Homer plot. Since most UBD wells are horizontal, the vertical radial flow period will give the average permeability-length product, $\bar{k}L$. Thus, the local permeability is an average of the local vertical and horizontal components such that:

$$\bar{k} = \sqrt{\bar{k}_z \bar{k}_y} \tag{10.1}$$

The quantity, $\bar{k}$, is the length average of the local $\bar{k}$.

This buildup will also yield an average formation pressure, $\bar{p}$. If the assumption is made that there is no compartmentalization leading to differential depletion, then this pressure can be used in the determination of the permeability profile. Thus, a final buildup is a preferred component of the procedure to determine a permeability profile.

In principle the skin factor from this buildup should be zero since the reservoir objective of UBD is to eliminate formation damage. However, if the operations have not been correctly designed or carried out, then some injection of the aqueous drilling fluid may have occurred leading to positive mechanical skin.

Figure 10A:
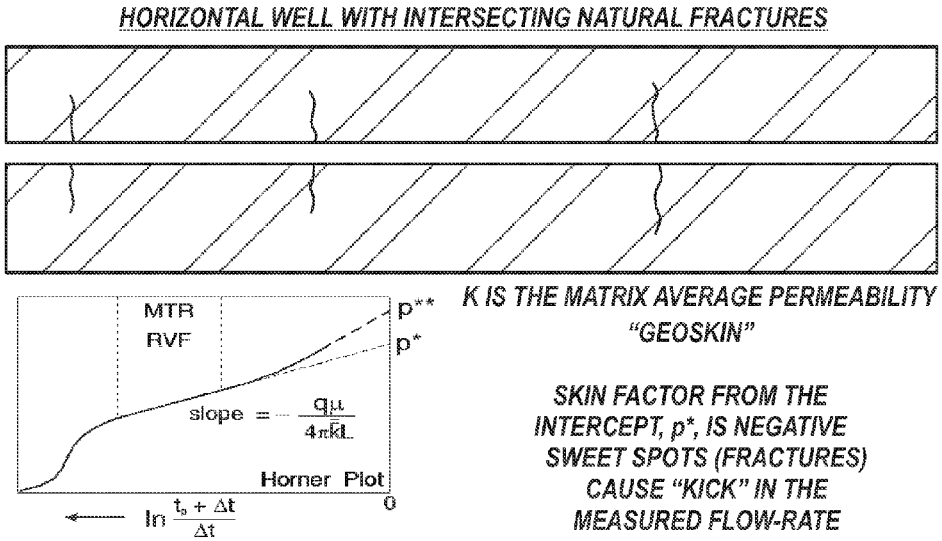
FIG. 10A illustrates a horizontal well with intersecting natural fractures.

Many of the formations that are candidates for UBD are fractured. One possibility is shown in FIG. 10A where the fractures are of limited extent as opposed to a connected fracture network. This is an example of what has been termed "geoskin." The effect of the limited extent fractures will appear in a buildup semilog plot as a negative skin. The slope of the Homer plot reflects $\bar{k}L$ where $\bar{k}$ is the length average matrix permeability excluding the fracture contribution that is embodied in the skin factor. With respect to the buildup in the compartmentalized case with differential depletion, the semilog slope may still be based on the average permeability even though crossflow through the wellbore is occurring. In this situation, the pressure determined from the intersect p** is the P.I. weighted average of the individual compartment pressures such that:

$$\bar{p} = p^{**} = \frac{\sum_{j=1}^{NC} p_j^i J_j}{\sum_{j=1}^{NC} J_j} \tag{10.2}$$

The individual compartment pressures, $p_j^i$, are illustrated in FIG. 8G and the uniform pressure, $p^i$, in this diagram corresponds to the pressure which would be detected in a buildup i.e. $\bar{p}$ as defined above. These represent pressures determined by the disclosed techniques.

Suppose that this final buildup pressure is used to analyze the UBD data assuming uniform reservoir pressure. The estimated permeability profile will not be strictly correct but it will give an excellent prediction of deliverability. A permeability profile based on the assumption of zero skin and uniform reservoir pressure was previously designated as proximate.

Figure 10B:
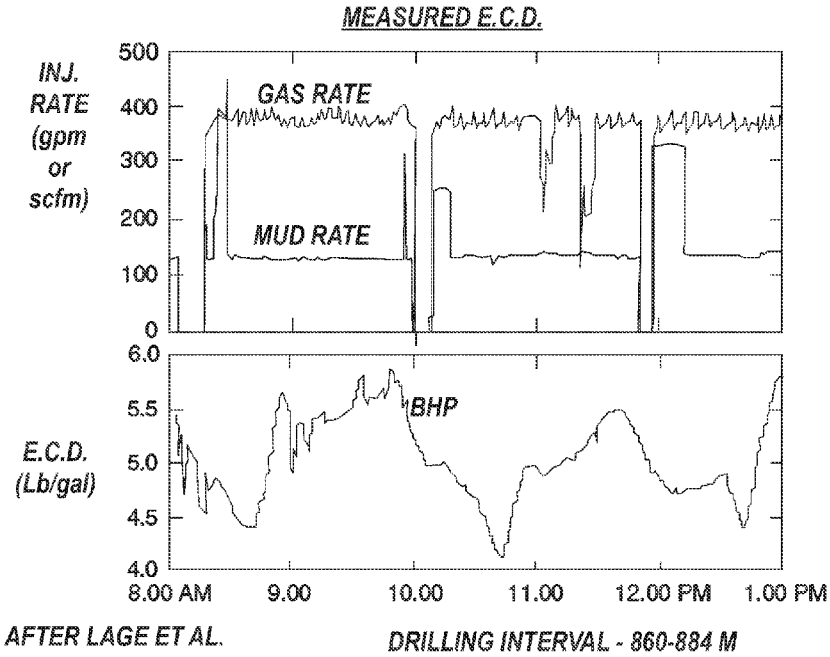
FIG. 10B illustrates measured Equivalent Circulating Density (ECD).

For reference, FIG. 10B illustrates an example of measured Equivalent Circulating Density (ECD). This graph shows the form in which the data can be presented in the current technology and shows a way of expressing the measured bottom hole pressure.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An underbalanced drilling method, comprising performing underbalanced drilling using an underbalanced drilling system:

inducing a change in flowing bottom hole pressure in a wellbore using the underbalanced drilling system;

measuring surface flow rate data of effluent in response to the induced change using a multi-phase flow meter before a separator of the underbalanced drilling system;

determining both permeability and formation pressure for a portion of the wellbore by analyzing flowing bottomhole pressure and the measured surface flow rate data; and characterizing the portion of the wellbore with the determined permeability and formation pressure.

2. The method of claim 1, wherein inducing a change in flowing bottom hole pressure in a wellbore using an underbalanced drilling system comprises creating a pressure disturbance by stopping circulation of the underbalanced drilling system to connect a stand.

3. The method of claim 1, wherein inducing a change in flowing bottom hole pressure in a wellbore using an underbalanced drilling system comprises changing flow rate of gas into drill pipe of the underbalanced drilling system.

4. The method of claim 1, further comprising translating variations in the measured surface flow rate data to downhole conditions before determining permeability and formation pressure.

5. The method of claim 4, wherein translating variations comprises correcting for wellbore capacity effects.

6. The method of claim 1, wherein using the multi-phase flow meter comprises installing the multi-phase flow meter in-line between a wellhead and the separator of the underbalanced drilling system.

7. The method of claim 1, wherein the multi-phase flow meter comprises an error rating of at least 5% or less.

8. An underbalanced drilling method, comprising performing underbalanced drilling using an underbalanced drilling system:

inducing a change in flowing bottom hole pressure in a wellbore using the underbalanced drilling system;

measuring flow rate data of effluent in response to the induced change using a multi-phase flow meter between a wellhead and a separator of the underbalanced drilling system;

determining at least a formation pressure for a portion of the wellbore by analyzing flowing bottomhole pressure and the flow rate data; and using the determined formation pressure for the portion of the wellbore to continue the underbalance drilling.

9. The method of claim 8, wherein inducing a change in flowing bottom hole pressure in a wellbore using an underbalanced drilling system comprises creating a pressure disturbance by stopping circulation of the underbalanced drilling system to connect a stand.

10. The method of claim 8, wherein inducing a change in flowing bottom hole pressure in a wellbore using an underbalanced drilling system comprises changing flow rate of gas into drill pipe of the underbalanced drilling system.

11. The method of claim 8, further comprising translating variations in the measured surface flow rate data to downhole conditions before determining permeability and formation pressure.

12. The method of claim 11, wherein translating variations comprises correcting for wellbore capacity effects.

13. The method of claim 8, wherein using the multi-phase flow meter comprises installing the multi-phase flow meter in-line between a wellhead and the separator of the underbalanced drilling system.

14. The method of claim 8, wherein the multi-phase flow meter comprises an error rating of at least 5% or less.

15. An underbalanced drilling system, comprising:

wellhead equipment sealing a wellbore annulus from drill-pipe;

separator equipment connected to the wellhead equipment and separating phases of effluent communicated from the wellbore annulus;

a multiphase flow meter positioned between the wellhead equipment and the separator equipment and measuring flow rate data of the effluent communicated from the wellbore annulus to the separator equipment; and an analysis system receiving measured flow rate data from the multiphase flow meter in response to a change in flowing bottom hole pressure in the wellbore, the change induced using the underbalanced drilling system, the analysis system analyzing flowing bottomhole pressure and the measured flow rate data and determining at least a formation pressure for a portion of the wellbore.

16. The system of claim 15, wherein the analysis system uses the determined formation pressure for the portion of the wellbore to conduct the underbalance drilling.

17. The system of claim 15, wherein the analysis system analyzes the flowing bottomhole pressure and the measured surface flow rate data and determines permeability for the portion of the wellbore.

18. The system of claim 15, wherein the multiphase flow meter comprises tubing positioned in-line between the wellhead equipment and the separator equipment.

19. The system of claim 15, wherein the multiphase flow meter measures three-phases of the effluent from the wellhead equipment.

20. The system of claim 15, wherein the multiphase flow meter has an accuracy of at least 95%.

21. The system of claim 15, wherein multiphase flow meter is non-radioactive and non-intrusive to flow of the effluent from the wellhead equipment.

* * * * *